US006669391B2

(12) United States Patent
Policicchio et al.

(10) Patent No.: US 6,669,391 B2
(45) Date of Patent: Dec. 30, 2003

(54) CLEANING COMPOSITION, PAD, WIPE, IMPLEMENT, AND SYSTEM AND METHOD OF USE THEREOF

(75) Inventors: Nicola John Policicchio, Mason, OH (US); Preston James Rhamy, Cincinnati, OH (US); Michael William Dusing, Louisville, KY (US); Kenneth William Willman, Fairfield, OH (US); Rhonda Jean Jackson, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/093,652

(22) Filed: Mar. 8, 2002

(65) Prior Publication Data

US 2003/0133740 A1 Jul. 17, 2003

Related U.S. Application Data

(63) Continuation of application No. 09/831,480, filed on May 9, 2001.

(60) Provisional application No. 60/162,935, filed on Nov. 2, 1999, provisional application No. 60/156,286, filed on Sep. 27, 1999, and provisional application No. 60/110,476, filed on Dec. 1, 1998.

(51) Int. Cl.[7] ..... A46B 11/04; A46B 11/00; A47L 1/08

(52) U.S. Cl. ..... 401/270; 401/138; 401/137; 401/139; 401/140

(58) Field of Search ..... 401/137, 138, 401/139, 140, 268, 270, 276, 282, 271

(56) References Cited

U.S. PATENT DOCUMENTS 371,515 A 10/1887 Nowotny
412,092 A 10/1889 Jacoby
419,871 A 1/1890 Orcutt (List continued on next page.)

FOREIGN PATENT DOCUMENTS

| | | |
|---|---|---|
| CA | 1 269 210 | 5/1922 |
| CA | 65044 | 1/1990 |
| CA | 2225303 | 6/1998 |
| CH | 624 290 A5 | 7/1981 |
| CH | 686 656 A5 | 5/1996 |
| FR | 2 639 818 | 8/1990 |
| JP | 051376 | 6/1993 |
| WO | WO 98/35599 | 8/1998 |
| WO | WO 99/05955 | 2/1999 |
| WO | WO 99/65819 | 12/1999 |
| WO | WO 00/54647 | 9/2000 |
| WO | WO 01/26531 A2 | 4/2001 |
| WO | WO 01/72195 A1 | 10/2001 |

*Primary Examiner*—David J. Walczak
(74) *Attorney, Agent, or Firm*—Thibault Fayette; Kim William Zerby; Steven W. Miller

(57) ABSTRACT

The cleaning implement has a handle a mop head attached to the handle and the mop head comprises a plurality of attachment structures formed from a flexible material. The cleaning implement also comprises a liquid delivery system having a container filled with a cleaning solution, fitment which has a fluid transfer check valve communicating with a nozzle and a vent valve. The vent valve has a cracking pressure such that venting occurs in the container when the pressure differential defined by P1–P2 is superior to the cracking pressure, where P1 is the atmospheric pressure and P2 is the pressure inside said container. The cleaning implement also includes a disposable cleaning pad which has an absorbent layer and an attachment layer. The attachment layer has at least one notch located on the leading edge of the attachment layer such that the cleaning solution is dispensed from the nozzle without being obstructed by the attachment layer.

33 Claims, 14 Drawing Sheets

U.S. PATENT DOCUMENTS 539,313 A 5/1895 Thierry et al.
595,761 A 12/1897 Brockmann
726,480 A 4/1903 Tate
775,460 A 11/1904 Shroyer
1,021,708 A 3/1912 Schaeneman
1,033,222 A 7/1912 Whitehead
1,048,715 A 12/1912 Malone
1,049,797 A 1/1913 Arntt
1,065,975 A 7/1913 Shaw
1,122,079 A 12/1914 Cunneen
1,165,208 A 12/1915 Ricard
1,413,700 A 4/1922 Allen
1,536,676 A 5/1925 Leraas
1,554,875 A 9/1925 Miles
1,618,930 A 2/1927 Istrico
1,656,334 A 1/1928 McKenney
1,715,632 A 6/1929 Wertheimer
1,739,983 A 12/1929 Nelson et al.
1,903,896 A 4/1933 Greenberg
1,986,199 A 1/1935 Henninger
1,995,592 A 3/1935 Tillack
2,000,167 A 5/1935 Forman
2,047,199 A 7/1936 Gewalt
2,053,282 A 9/1936 Gewalt
2,061,216 A 11/1936 Thompson
2,073,170 A 3/1937 Pieper
2,106,280 A 1/1938 Sandhop
RE20,762 E 6/1938 Thompson
2,137,944 A 11/1938 MacLeod
2,187,671 A * 1/1940 Suddarth ..... 401/140
2,194,819 A 3/1940 Brownstein
2,228,573 A 1/1941 Lowe
2,228,574 A 1/1941 Lowe
2,254,487 A 9/1941 McCune
2,262,334 A 11/1941 Rugaard
2,307,858 A 1/1943 Rufo
2,318,087 A 5/1943 Lowe
2,470,837 A 5/1949 Polson
2,489,162 A 11/1949 Schulman
2,551,220 A 5/1951 Ploner
2,557,214 A 6/1951 Bales
2,566,429 A 9/1951 Schulman
2,575,124 A 11/1951 Pollitt
2,618,799 A 11/1952 Barbato
2,768,401 A 10/1956 Becker et al.
2,815,522 A 12/1957 Hexter
2,851,201 A 9/1958 Poitras et al.
2,875,463 A 3/1959 Minerley
2,876,476 A 3/1959 Woods
2,990,979 A 7/1961 Harrison et al.
3,069,717 A * 12/1962 Cote ..... 401/138
3,080,590 A 3/1963 Mullinix et al.
3,092,293 A * 6/1963 Helm ..... 401/140
3,094,152 A 6/1963 Kenny et al.
3,099,028 A 7/1963 Ardito
3,113,335 A 12/1963 Baicker
3,126,573 A 3/1964 Vosbikian et al.
RE25,556 E 4/1964 Nohl et al.
3,127,631 A 4/1964 Hershberger et al.
3,188,669 A 6/1965 Beardslee
3,210,794 A 10/1965 Vosbikian
3,278,974 A 10/1966 Nighswander
3,600,100 A 8/1971 Arones
3,679,319 A 7/1972 Munchel et al.
3,820,905 A 6/1974 Sims
3,926,339 A 12/1975 Openchowski
4,119,386 A 10/1978 Cushing
4,151,955 A 5/1979 Stouffer
4,353,488 A 10/1982 Schneiter et al.
4,432,472 A 2/1984 Lamm
4,507,004 A 3/1985 Moffitt, Jr.
4,508,267 A 4/1985 Stouffer
4,747,518 A 5/1988 Laauwe
4,806,037 A 2/1989 Berglund
4,863,299 A 9/1989 Osberghaus et al.
4,971,471 A * 11/1990 Sloan ..... 401/140
4,983,060 A 1/1991 Steinbach
5,007,753 A 4/1991 England, Jr.
5,012,542 A 5/1991 Lynn
5,080,517 A 1/1992 Lynn
5,092,699 A 3/1992 Silvenis
5,232,298 A 8/1993 Mitsunari et al.
5,244,124 A 9/1993 Raffo
5,373,970 A 12/1994 Ophardt
5,472,122 A 12/1995 Appleby
5,496,123 A 3/1996 Gaither
5,636,402 A 6/1997 Kubo et al.
5,735,959 A 4/1998 Kubo et al.
D396,908 S 8/1998 Beechuk et al.
D401,703 S 11/1998 Beechuk et al.
5,864,914 A 2/1999 Salmon
5,865,551 A 2/1999 Lalli et al.
5,888,006 A 3/1999 Ping et al.
5,988,920 A 11/1999 Kunkler et al.
6,000,088 A 12/1999 Wright et al.
6,045,622 A 4/2000 Holt et al.
6,170,114 B1 1/2001 Woodnorth et al.
6,171,004 B1 1/2001 Derhammer
6,206,058 B1 3/2001 Nagel et al.
6,227,744 B1 5/2001 Fodrocy et al.
D462,150 S 8/2002 Rader et al.
6,427,730 B2 8/2002 Nagel et al.
6,491,069 B2 12/2002 Nagel et al.
2001/0006588 A1 7/2001 Zorzo
2002/0083964 A1 7/2002 McKay
2003/0034084 A1 2/2003 Nagel et al.

* cited by examiner

CLEANING COMPOSITION, PAD, WIPE, IMPLEMENT, AND SYSTEM AND METHOD OF USE THEREOF

CROSS-REFERENCE TO RELATED APPLICATIONS

This application is a continuation of U.S. application Ser. No. 09/831,480, filed May 9, 2001 which claims priority under 35 U.S.C. 371 to International Patent Application Serial No. PCT/US99/26579 filed Nov. 9, 1999 by Policicchio et al. and which further claims the benefit of Ser. No. 60/110,476, filed Dec. 1, 1998 by Policicchio et al., Ser. No. 60/156,286 filed Sep. 27, 1999 by Sherry et al., and Ser. No. 60/162,935 filed Nov. 2, 1999 by Policicchio et al.

Further, this application is related to the following applications, which are hereby incorporated by reference herein: U.S. application Ser. No. 09/188,604 filed Nov. 9, 1998 by Nagel et al. and U.S. application Ser. No. 09/201,618 filed Nov. 30, 1998 by Benecke.

TECHNICAL FIELD

The present invention relates to cleaning compositions, pads, sheets, wipes, and implements useful in removing soils from hard surfaces. The cleaning pads and/or sheets contain improved structure comprising apertured formed films, functional cuffs, density gradients, adhesive scrubbing strips, and/or perfume carrier complex. The cleaning sheets are designed so as to provide functional cuffs. The present invention also relates to a cleaning implement comprising a handle and, preferably, an improved removable absorbent cleaning pad. The present invention further relates to methods of using cleaning compositions, pads, sheets, wipes, and implements to clean hard surfaces.

BACKGROUND OF THE INVENTION

The literature is replete with products capable of cleaning hard surfaces such as ceramic tile floors, hardwood floors, counter tops and the like. In the context of cleaning floors, numerous devices are described comprising a handle and some means for absorbing a fluid cleaning composition. Such devices include those that are reusable, including mops containing cotton strings, cellulose and/or synthetic strips, sponges, and the like. While these mops are successful in removing many soils from hard surfaces, they typically require the inconvenience of performing one or more rinsing steps during use to avoid saturation of the material with dirt, soil, and other residues. These mops therefore require the use of a separate container to perform the rinsing step(s), and typically these rinsing steps fail to sufficiently remove dirt residues. This can result in redeposition of significant amounts of soil during subsequent passes of the mop. Furthermore, as reusable mops are used over time, they become increasingly soiled and malodorous. This negatively impacts subsequent cleaning performance.

To alleviate some of the negative attributes associated with reusable mops, attempts have been made to provide mops having disposable cleaning pads. For example, U.S. Pat. No. 5,094,559, issued Mar. 10, 1992 to Rivera et al., describes a mop that includes a disposable cleaning pad comprising a scrubber layer for removing soil from a soiled surface, a blotter layer to absorb fluid after the cleaning process, and a liquid impervious layer positioned between the scrubber and blotter layer. The pad further contains a rupturable packet means positioned between the scrubber layer and the liquid impervious layer. The rupturable packets are so located such that upon rupture, fluid is directed onto the surface to be cleaned. During the cleaning action with the scrubber layer, the impervious sheet prevents fluid from moving to the absorbent blotter layer. After the cleaning action is completed, the pad is removed from the mop handle and reattached such that the blotter layer contacts the floor. While this device can alleviate the need to use multiple rinsing steps, it does require that the user physically handle the pad and reattach a soiled, damp pad in order to complete the cleaning process.

Similarly, U.S. Pat. No. 5,419,015, issued May 30, 1995 to Garcia, describes a mop having removable, washable work pads. The pad is described as comprising an upper layer which is capable of attaching to hooks on a mop head, a central layer of synthetic plastic microporous foam, and a lower layer for contacting a surface during the cleaning operation. The lower layer's composition is stated to depend on the end-use of the device, i.e., washing, polishing or scrubbing. While the reference addresses the problems associated with mops that require rinsing during use, the patent fails to provide a cleaning implement that sufficiently removes the soil deposited on typical household hard surfaces, in particular floors, such that the surface is perceived as essentially free of soil. In particular, the synthetic foam described by Garcia for absorbing the cleaning solution has a relatively low absorbent capacity for water and water-based solutions. As such, the user must either use small amounts of cleaning solution to remain within the absorbent capacity of the pad, or the user must leave a significant amount of cleaning solution on the surface being cleaned. In either situation, the overall performance of the cleaning pad is not optimal.

While many known devices for cleaning hard surfaces are successful at removing a vast majority of the soil encountered by the typical consumer during the cleaning process, they are inconvenient in that they require one or more cleaning steps. The prior art devices that have addressed the issue of convenience typically do so at the cost of cleaning performance. As such, there remains a need for a device that offers both convenience and beneficial soil removal.

SUMMARY OF THE INVENTION

In one aspect, the present invention encompasses hard surface cleaning compositions, preferably for use with the cleaning pads and/or cleaning implements described herein, comprising:

(a) optionally, from about 0.001% to about 0.5% by weight of the composition of surfactant, preferably selected from the group consisting of alkylpolysaccharides, alkyl ethoxylates, alkyl sulfonates, and mixtures thereof;

(b) optionally, hydrophilic polymer, preferably less than about 0.5% by weight of the composition;

(c) optionally, organic solvent, preferably from about 0.25% to about 7% by weight of the composition and preferably having a boiling point of from about 120° C. to about 180° C.;

(d) optionally, from about 0.01% to about 1% by weight of the composition of mono- or polycarboxylic acid;

(e) optionally, from about 0.01% to about 1% by weight of the composition of odor control agent, preferably cyclodextrin;

(f) optionally, a source of peroxide, preferably from about 0.05% to about 5% by weight of the composition and preferably selected from the group consisting of benzoyl peroxide, hydrogen peroxide, and mixtures thereof;

(g) optionally, from about 0.001% to about 0.1% by weight of the composition of thickening polymer;

(h) aqueous solvent system, preferably at least about 80% by weight of the composition;

(i) optionally, suds suppressor;

(j) optionally, from about 0.005% to about 0.2% by weight of the composition of a perfume comprising:

(i) optionally, from about 0.05% to about 90% by weight of the perfume of volatile, hydrophilic perfume material;

(ii) optionally, at least about 0.2% by weight of the perfume of volatile, hydrophobic perfume material;

(iii) optionally, less than about 10% by weight of the perfume of residual, hydrophilic perfume material;

(iv) less than about 10% by weight of the perfume of residual, hydrophobic perfume material;

(k) optionally, a detergent adjuvant, preferably selected from the group consisting of detergency builder, buffer, preservative, antibacterial agent, colorant, bleaching agents, chelants, enzymes, hydrotropes, corrosion inhibitors, and mixtures thereof.

In another aspect, the present invention relates to a cleaning pad, preferably disposable, for cleaning a hard surface, the cleaning pad comprising:

(a) at least one absorbent layer;

(b) optionally, a liquid pervious scrubbing layer; wherein the liquid pervious scrubbing layer is preferably an apertured formed film, more preferably a macroscopically expanded three-dimensional plastic web, having tapered or funnel-shaped apertures and/or surface aberrations and preferably comprising a hydrophobic material;

(c) optionally, an attachment layer, wherein the attachment layer preferably comprises a clear or translucent material, more preferably a clear or translucent polyethylene film, and wherein the attachment layer preferably comprises loop and/or hook material for attachment to a support head of a handle of a cleaning implement;

(d) optionally, multiple planar surfaces;

(e) optionally, at least one functional cuff, preferably at least one free-floating, looped functional cuff;

(f) optionally, a density gradient throughout at least one absorbent layer; wherein the density gradient preferably comprises a first absorbent layer having a density of from about 0.01 g/cm$^3$ to about 0.15 g/cm$^3$, preferably from about 0.03 g/cm$^3$ to about 0.1 g/cm$^3$, and more preferably from about 0.04 g/cm$^3$ to about 0.06 g/cm$^3$, and a second absorbent layer having a density of from about 0.04 g/cm$^3$ to about 0.2 g/cm$^3$, preferably from about 0.1 g/cm$^3$ to about 0.2 g/cm$^3$, and more preferably from about 0.12 g/cm$^3$ to about 0.17 g/cm$^3$; wherein the density of the first absorbent layer is about 0.04 g/cm$^3$, preferably about 0.07 g/cm$^3$, and more preferably about 0.1 g/cm$^3$, less than the density of the second absorbent layer;

(g) optionally, at least one adhesive scrubbing strip, preferably comprising a material selected from the group consisting of nylon, polyester, polypropylene, abrasive material, and mixtures thereof; and (h) optionally, perfume carrier complex, preferably selected from the group consisting of cyclodextrin inclusion complex, matrix perfume microcapsules, and mixtures thereof; wherein the perfume carrier complex is preferably located in an absorbent layer. Preferably, the cleaning pad has a $t_{1200}$ absorbent capacity of at least about 5 grams/gram.

In another aspect, the present invention relates to a cleaning implement, comprising:

a handle;

a support head pivotally attached to said handle;

a cleaning substrate removeably attached to the support head, wherein said cleaning substrate has an absorbent capacity of at least about 5 g/g; and a liquid delivery system for providing a cleaning liquid to a surface to be cleaned, wherein said liquid delivery system is configured to spray at least about 2 mils/sec of a cleaning liquid.

In another aspect, the present invention relates to a method of cleaning a hard surface comprising:

(a) contacting the surface with a cleaning implement comprising a handle and a removable, dry, cleaning substrate, preferably a nonwoven hydroentangled cleaning sheet as described herein before, to remove dust and fine particulate matter from the surface;

(b) contacting the surface with a hard surface cleaning composition, preferably a hard surface cleaning composition as described herein, to wet the surface;

(c) contacting the wet surface with a cleaning implement comprising a handle and a removable cleaning pad, preferably a cleaning pad as described herein, to substantially remove the hard surface cleaning composition from the surface; and (d) allowing the surface to dry without rinsing the surface with a separate rinse solution.

DETAILED DESCRIPTION OF THE INVENTION

Figure 1:
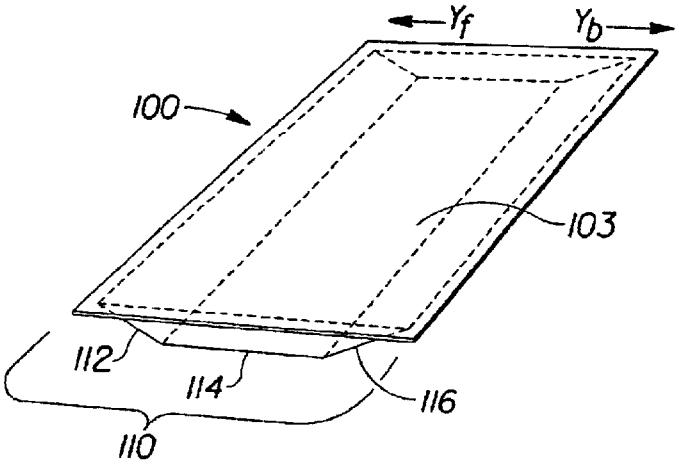
FIG. 1 is a perspective view of a cleaning pad of the present invention.

Reference will now be made in detail to the present preferred embodiments of the invention, examples of which are illustrated in the accompanying drawings wherein like numerals indicate the same elements throughout the views and wherein reference numerals having the same last two digits (e.g., 20 and 120) connote similar elements.

I. Definitions

As used herein, the term "comprising" means that the various components, ingredients, or steps, can be conjointly employed in practicing the present invention. Accordingly, the term "comprising" encompasses the more restrictive terms "consisting essentially of" and "consisting of."

As used herein, the term "direct fluid communication" means that fluid can transfer readily between two cleaning pad components or layers (e.g., the scrubbing layer and the absorbent layer) without substantial accumulation, transport, or restriction by an interposed layer. For example, tissues, nonwoven webs, construction adhesives, and the like can be present between the two distinct components while maintaining "direct fluid communication", as long as they do not substantially impede or restrict fluid as it passes from one component or layer to another.

As used herein, the term "macroscopically expanded", when used to describe three-dimensional plastic webs, ribbons, and films, refers to webs, ribbons, and films which have been caused to conform to the surface of a three-dimensional forming structure so that both surfaces thereof exhibit the three-dimensional pattern of said forming structure, said pattern being readily visible to the naked eye when the perpendicular distance between the viewer's eye and the plane of the web is about 12 inches. Such macroscopically expanded webs, ribbons and films are typically caused to conform to the surface of said forming structures by embossing, i.e., when the forming structure exhibits a pattern comprised primarily of male projections, by debossing, i.e., when the forming structure exhibits a pattern comprised primarily of female capillary networks, or by extrusion of a resinous melt directly onto the surface of a forming structure of either type. By way of contrast, the term "planar", when utilized herein to describe plastic webs, ribbons and films, refers to the overall condition of the web, ribbon or film when viewed by the naked eye on a macroscopic scale. In this context, "planar" webs, ribbons and films can include webs, ribbons and films having fine scale surface aberrations on one or both sides, said surface aberrations not being readily visible to the naked eye when the perpendicular distance between the viewer's eye and the plane of the web is about 12 inches or greater.

As used herein, the term "z-dimension" refers to the dimension orthogonal to the length and width of the cleaning pad of the present invention, or a component thereof. The z-dimension therefore corresponds to the thickness of the cleaning pad or a pad component.

As used herein, the term "x-y dimension" refers to the plane orthogonal to the thickness of the cleaning pad, or a component thereof. The x and y dimensions correspond to the length and width, respectively, of the cleaning pad or a pad component. In general, when the cleaning pad is used in conjunction with a handle, the implement will be moved in a direction parallel to the y-dimension (or width) of the pad. (See FIG. 1, and the discussion below.) Of course, the present invention is not limited to cleaning pads having four sides. Other shapes, such as circular, elliptical, and the like, can also be used. When determining the width of the pad at any point in the z-dimension, it is understood that the pad is assessed according to its intended use.

As used herein, the term "layer" refers to a member or component of a cleaning pad whose primary dimension is x-y, i.e., along its length and width. It should be understood that the term layer is not necessarily limited to single layers or sheets of material. Thus a layer can comprise laminates or combinations of several sheets or webs of the requisite type of materials. Accordingly, the term "layer" includes the terms "layers" and "layered."

As used herein, the term "hydrophilic" is used to refer to surfaces that are wettable by aqueous fluids deposited thereon. Hydrophilicity and wettability are typically defined in terms of contact angle and the surface tension of the fluids and solid surfaces involved. This is discussed in detail in the American Chemical Society publication entitled *Contact Angle, Wettability and Adhesion*, edited by Robert F. Gould (Copyright 1964), which is hereby incorporated herein by reference. A surface is said to be wetted by a fluid (i.e., hydrophilic) when either the contact angle between the fluid and the surface is less than 90°, or when the fluid tends to spread spontaneously across the surface, both conditions normally co-existing. Conversely, a surface is considered to be "hydrophobic" if the contact angle is greater than 90° and the fluid does not spread spontaneously across the surface.

As used herein, the term "scrim" means any durable material that provides texture to the surface-contacting side of the cleaning pad's scrubbing layer, and also has a sufficient degree of openness to allow the requisite movement of fluid to the absorbent layer of the cleaning pad. Suitable materials include materials that have a continuous, open structure, such as synthetic and wire mesh screens. The open areas of these materials can be readily controlled by varying the number of interconnected strands that comprise the mesh, by controlling the thickness of those interconnected strands, etc. Other suitable materials include those where texture is provided by a discontinuous pattern printed on a substrate. In this aspect, a durable material (e.g., a synthetic) can be printed on a substrate in a continuous or discontinuous pattern, such as individual dots and/or lines, to provide the requisite texture. Similarly, the continuous or discontinuous pattern can be printed onto a release material that will then act as the scrim. These patterns can be repeating or they can be random. It will be understood that one or more of the approaches described for providing the desired texture can be combined to form the optional scrim material. The z direction height and open area of the scrim and or scrubbing substrate layer help to control and or retard the flow of liquid into the absorbent core material. The z height of the scrim and or scrubbing substrate help provide a means of controlling the volume of liquid in contact with the cleaning surface while at the same time controlling the rate of liquid absorption, fluid communication into the absorption core material.

For purposes of the present invention, an "upper" layer of a cleaning pad is a layer that is relatively further away from the surface that is to be cleaned (i.e., in the implement context, relatively closer to the implement handle during use). The term "lower" layer conversely means a layer of a cleaning pad that is relatively closer to the surface that is to be cleaned (i.e., in the implement context, relatively further away from the implement handle during use). As such, the scrubbing layer is preferably the lower-most layer and the absorbent layer is preferably an upper layer relative to the scrubber layer. The terms "upper" and "lower" are similarly used when referring to layers that are multiply (e.g., when the scrubbing layer is a two-ply material). In terms of sequential ordering of layers (e.g., first layer, second layer, and third layer), a first layer is a "lower" layer relative to a second layer. Conversely, a third layer is an "upper" layer relative to a second layer. The terms "above" and "below" are used to describe relative locations of two or more materials in a cleaning pad's thickness. By way of illustration, a material A is "above" material B if material B is positioned closer to the scrubbing layer than material A. Similarly, material B is "below" material A in this illustration.

All of the documents and references referred to herein are incorporated by reference, unless otherwise specified. All parts, ratios, and percentages herein, in the Specification, Examples, and Claims, are by weight and all numerical limits are used with the normal degree of accuracy afforded by the art, unless otherwise specified.

II. Hard Surface Cleaning Composition

In one aspect, the present invention encompasses hard surface cleaning compositions, preferably for use with the cleaning pads and/or cleaning implements described herein, comprising:

(a) optionally, from about 0.001% to about 0.5% by weight of the composition of surfactant, preferably selected from the group consisting of alkylpolysaccharides, alkyl ethoxylates, alkyl sulfonates, and mixtures thereof;

(b) optionally, hydrophilic polymer, preferably less than about 0.5% by weight of the composition;

(c) optionally, organic solvent, preferably from about 0.25% to about 7% by weight of the composition and preferably having a boiling point of from about 120° C. to about 180° C.;

(d) optionally, from about 0.01% to about 1% by weight of the composition of mono- or polycarboxylic acid;

(e) optionally, from about 0.01% to about 1% by weight of the composition of odor control agent, preferably cyclodextrin;

(f) optionally, a source of peroxide, preferably from about 0.05% to about 5% by weight of the composition and preferably selected from the group consisting of benzoyl peroxide, hydrogen peroxide, and mixtures thereof;

(g) optionally, from about 0.001% to about 0.1% by weight of the composition of thickening polymer;

(h) aqueous solvent system, preferably at least about 80% by weight of the composition;

(i) optionally, suds suppressor;

(j) optionally, from about 0.005% to about 0.2% by weight of the composition of a perfume comprising:

(i) optionally, from about 0.05% to about 90% by weight of the perfume of volatile, hydrophilic perfume material;

(ii) optionally, at least about 0.2% by weight of the perfume of volatile, hydrophobic perfume material;

(iii) optionally, less than about 10% by weight of the perfume of residual, hydrophilic perfume material;

(iv) less than about 10% by weight of the perfume of residual, hydrophobic perfume material;

(k) optionally, a detergent adjuvant, preferably selected from the group consisting of detergency builder, buffer, preservative, antibacterial agent, colorant, bleaching agents, chelants, enzymes, hydrotropes, corrosion inhibitors, and mixtures thereof.

A. Optional Surfactant

When a hydrophilic polymer, as described below, is not present in the hard surface cleaning compositions herein, the compositions will normally have one of the preferred surfactants present. A preferred surfactant for use herein are the alkylpolysaccharides that are disclosed in U.S. Pat. No. 5,776,872, Cleansing compositions, issued Jul. 7, 1998, to Giret, Michel Joseph; Langlois, Anne; and Duke, Roland Philip; U.S. Pat. No. 5,883,059, Three in one ultra mild lathering antibacterial liquid personal cleansing composition, issued Mar. 16, 1999, to Furman, Christopher Allen; Giret, Michel Joseph; and Dunbar, James Charles; etc.; U.S. Pat. No. 5,883,062, Manual dishwashing compositions, issued Mar. 16, 1999, to Addison, Michael Crombie; Foley, Peter Robert; and Allsebrook, Andrew Micheal; and U.S. Pat. No. 5,906,973, issued May 25, 1999, Process for cleaning vertical or inclined hard surfaces, by Ouzounis, Dimitrios and Nierhaus, Wolfgang.

Suitable alkylpolysaccharides for use herein are disclosed in U.S. Pat. No. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group. For acidic or alkaline cleaning compositions/solutions suitable for use in no-rinse methods, the preferred alkyl polysaccharide preferably comprises a broad distribution of chain lengths, as these provide the best combination of wetting, cleaning, and low residue upon drying. This "broad distribution" is defined by at least about 50% of the chainlength mixture comprising from about 10 carbon atoms to about 16 carbon atoms. Preferably, the alkyl group of the alkyl polysaccharide consists of a mixtures of chainlength, preferably from about 6 to about 18 carbon atoms, more preferably from about 8 to about 16 carbon atoms, and hydrophilic group containing from about one to about 1.5 saccharide, preferably glucoside, groups per molecule. This "broad chainlength distribution" is defined by at least about 50% of the chainlength mixture comprising from about 10 carbon atoms to about 16 carbon atoms. A broad mixture of chain lengths, particularly $C_8$–$C_{16}$, is highly desirable relative to narrower range chain length mixtures, and particularly versus lower (i.e., $C_8$–$C_{10}$ or $C_8$–$C_{12}$) chainlength alkyl polyglucoside mixtures. It is also found that the preferred $C_{8-16}$ alkyl polyglucoside provides much improved perfume solubility versus lower and narrower chainlength alkyl polyglucosides, as well as other preferred surfactants, including the $C_8$–$C_{14}$ alkyl ethoxylates. Any reducing saccharide containing 5 or 6 carbon atoms can be used, e.g., glucose, galactose and galactosyl moieties can be substituted for the glucosyl moieties. (optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6- positions on the preceding saccharide units. The glycosyl is preferably derived from glucose.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from 8 to 18, preferably from 10 to 16, carbon atoms. Preferably, the alkyl group is a straight-chain saturated alkyl group. The alkyl group can contain up to about 3 hydroxyl groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides and/or galatoses. Suitable mixtures include coconut alkyl, di-, tri-, tetra-, and pentaglucosides and tallow alkyl tetra-, penta- and hexaglucosides.

To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-,3-, 4- and/or 6-position, preferably predominantly the 2-position.

In the alkyl polyglycosides, the alkyl moieties can be derived from the usual sources like fats, oils or chemically produced alcohols while their sugar moieties are created from hydrolyzed polysaccharides. Alkyl polyglycosides are the condensation product of fatty alcohol and sugars like glucose with the number of glucose units defining the relative hydrophilicity. As discussed above, the sugar units can additionally be alkoxylated either before or after reaction with the fatty alcohols. Such alkyl polyglycosides are described in detail in WO 86/05199 for example. Technical alkyl polyglycosides are generally not molecularly uniform products, but represent mixtures of alkyl groups and mixtures of monosaccharides and different oligosaccharides. Alkyl polyglycosides (also sometimes referred to as "APG's") are preferred for the purposes of the invention since they provide additional improvement in surface appearance relative to other surfactants. The glycoside moieties are preferably glucose moieties. The alkyl substituent is preferably a saturated or unsaturated alkyl moiety containing from about 8 to about 18 carbon atoms, preferably from about 8 to about 10 carbon atoms or a mixture of such alkyl moieties. $C_8$–$C_{16}$ alkyl polyglucosides are commercially available (e.g., Simusol® surfactants from Seppic Corporation, 75 Quai d'Orsay, 75321 Paris, Cedex 7, France, and Glucopon®425 available from Henkel. However, it has been found that purity of the alkyl polyglucoside can also impact performance, particularly end result for certain applications, including daily shower product technology. In the present invention, the preferred alkyl polyglucosides are those which have been purified enough for use in personal cleansing. Most preferred are "cosmetic grade" alkyl polyglucosides, particularly C8 to $C_{16}$ alkyl polyglucosides, such as Plantaren 2000®, Plantaren 2000 N®, and Plantaren 2000 N UP®, available from Henkel Corporation (Postfach 101100, D 40191 Dusseldorf, Germany).

In the context of floor, counter, wall, etc. applications, another class of preferred nonionic surfactant is alkyl ethoxylates. The alkyl ethoxylates of the present invention are either linear or branched, and contain from about 8 carbon atoms to about 14 carbon atoms, and from about 3 ethylene oxide units to about 25 ethylene oxide units. Examples of alkyl ethoxylates include Neodol® 91-6, Neodol 91-8® supplied by the Shell Corporation (P.O. Box 2463, 1 Shell Plaza, Houston, Tex.), and Alfonic® 810-60 supplied by Vista corporation, (900 Threadneedle P.O. Box 19029, Houston, Tex.). More preferred surfactants are the alkyl ethoxylates comprising from about 9 to about 12 carbon atoms, and from about 4 to about 8 ethylene oxide units. These surfactants offer excellent cleaning benefits and work synergistically with the required hydrophilic polymers. A most preferred alkyl ethoxylate is $C_{11}EO_5$, available from the Shell Chemical Company under the trademark Neodol® 1–5. Combinations of alkyl ethoxylates of varying chain-lengths and/or degree of ethoxylation can also be used, such as Neodol 1–3 with Neodol 1–7. These alkyl ethoxyaltes are found to provide desirable wetting and cleaning properties, and can be advantageously combined with the preferred $C_{8-16}$ alkyl polyglucoside in a matrix that includes the wetting polymers of the present invention. While not wishing to be limited by theory, it is believed that the $C_{8-6}$ alkyl polyglucoside can provide a superior end result (i.e., reduce hazing) in compositions that additionally contain the preferred alkyl ethoxylate particularly when the preferred alkyl ethoxylate is required for superior cleaning. The preferred the $C_{8-16}$ alkyl polyglucoside is also found to improve perfume solubility of compositions comprising alkyl ethoxylates. Higher levels of perfume can be advantageous for consumer acceptance.

The usage of liquid compositions according to the present invention are prepared with relatively low levels of active. Typically, compositions will comprise sufficient surfactant and optional solvent, as discussed hereinafter, to be effective as hard surface cleaners yet remain economical; accordingly they typically contain from about 0.002% to about 0.5% by weight of the composition of surfactant, preferably alkylpolyglycoside and/or $C_{8-14}$ alkylethoxylate surfactant, more preferably from about 0.004% to about 0.4% surfactant, and even more preferably from about 0.01% to about 0.3% surfactant. It has been found that use of low, rather than high levels of surfactant are advantageous to overall end result performance. It is also been found that when the primary surfactant system includes preferred alkyl ethoxylates that end result hazing is mitigated by specific cosurfactants. These preferred cosurfactants are $C_8$ sulfonate and Poly-Tergent CS-1.

The liquid compositions of the present invention optionally can include a small amount of additional anionic and/or nonionic detergent surfactant. Such anionic surfactants typically comprise a hydrophobic chain containing from about 8 carbon atoms to about 18, preferably from about 8 to about 16, carbon atoms, and typically include a sulfate, sulfonate, or carboxylate hydrophilic head group. In general, the level of optional, e.g., anionic, surfactants in the compositions herein is from about 0.001% to about 0.25%, more preferably from about 0.01% to about 0.2%, most preferably from about 0.01% to about 0. 1%, by weight of the composition.

In the context of floor, counter and other surface applications, the choice of cosurfactant can be critical in both selection of type and level. In compositions comprising $C_8$–$C_{14}$ alkyl ethoxylates, it is found that low levels of $C_8$ sulfonate can improve end result by providing a "toning" effect. By toning, it is meant an improvement in the visual appearance of the end result, due to less haziness. If present, the $C_8$ sulfonate is preferably used in from about 1:10 to about 1:1 weight ratio with respect to the primary surfactant (s). $C_8$ sulfonate is commercially available from Stepan under the tradename Bio-Terge PAS-8® as well as from the Witco Corporation under the tradename Witconate NAS-8®. Another outstanding "toning" surfactant of benefit to the present invention is Poly-Tergent CS-1 which can be purchased from BASF. If present, the Poly-Tergent CS-1 is preferably used in from about 1:20 to about 1:1 weight ratio with respect to the primary surfactant(s).

Other surfactants which can be used, though less preferably, and typically at very low levels, include $C_8$–$C_{18}$ alkyl sulfonates (Hostapur SAS® from Hoechst, Aktiengesellschaft, D-6230 Frankfurt, Germany), $C_{10}$–$C_{14}$ linear or branched alkyl benzene sulfonates, $C_9$–$C_{15}$ alkyl ethoxy carboxylates detergent surfactant (Neodox® surfactants available from Shell Chemical Corporation), $C_{10-14}$ alkyl sulfates and ethoxysulfates (e.g., Stepanol AM® from Stepan). Alkyl ethoxy carboxylates can be advantageously used at extremely low levels (about 0.01% or lower) to dissolve perfume. This can be an important benefit given the low levels of active needed for the present invention to be most effective. Other anionic, nonionic, or zwitterionic surfactants can also be useful as primary surfactants and/or co-surfactants in the present compositions, such as the betaines, examples being cocoamidopropyl betaine (e.g., Lonzaine C from Lonza), Cetyl betaine (e.g., Lonzaine 16SP from Lonza), hydroxysultaines (e.g., Mirataine CBS from Rhone-Poulenc), sulfobetaines (e.g., Rewoteric AM CAS-15 from Witco), sulfosuccinates (e.g., Aerosol TO from American Cyanamid) or amine oxides (e.g., Barlox 14 or Barlox C from Lonzaine).

Alternative nonionic detergent surfactants for use herein are alkoxylated alcohols generally comprising from about 6 to about 16 carbon atoms in the hydrophobic alkyl chain of the alcohol. Typical alkoxylation groups are propoxy groups or propoxy groups in combination with ethoxy groups. Such compounds are commercially available under the tradename Antarox® available from Rhodia (P.O. Box 425 Cranberry, N.J. 08512) with a wide variety of chain length and alkoxylation degrees. Block copolymers of ethylene oxide and propylene oxide can also be used and are available from BASF under the tradename Pluronic®. Preferred nonionic detergent surfactants for use herein are according to the formula $R(X)_nH$, were R is an alkyl chain having from about 6 to about 16 carbon atoms, preferably from about 8 to about 12, X is a propoxy, or a mixture of ethoxy and propoxy groups, n is an integer of from about 4 to about 30, preferably from about 5 to about 8. Other non-ionic surfactants that can be used include those derived from natural sources such as sugars and include $C_8$–$C_{16}$ N-alkyl glucose amide surfactants. If present, the concentration of alternative nonionic surfactant is from about 0.01% to about 0.2%, more preferably from about 0.01% to about 0.1%, by weight of the composition.

Other surfactants useful in the present hard surface cleaning compositions include those described in U.S. application Ser. No. 09/170,426 filed Oct. 13, 1998 (P&G Case 6401C); U.S. application Ser. No. 09/170,167 filed Oct. 13, 1998 (P&G Case 6403C); U.S. Provisional Application Ser. No. 60/031,917 filed Nov. 26, 1996, and published as WO98/237,102 on Jun. 4, 1998 (P&G Case 6404C); U.S. Provisional Application Ser. No. 60/061,970 filed Oct. 14, 1997, and published as WO99/19,448 (P&G Case 6885); U.S. Provisional Application Ser. No. 60/062,407 filed Oct. 14, 1997, and published as WO99/19,449 (P&G Case 6886).

B. Optional Hydrophilic Polymer

In preferred embodiments of the invention, polymeric material that improves the hydrophilicity of the surface being treated is incorporated into the present compositions. The increase in hydrophilicity provides improved final appearance by providing "sheeting" of the water from the surface and/or spreading of the water on the surface, and this effect is preferably seen when the surface is rewetted and even when subsequently dried after the rewetting.

"Sheeting" effects have been noted on a variety of surfaces such as glass, ceramic and even tougher to wet surfaces such as porcelain enamel. When the water "sheets" evenly off the surface and/or spreads on the surface, it minimizes the formation of, e.g., "hard water spots" that form upon drying. For a product intended to be used in the context of a floor cleaner, the polymer improves surface wetting and assists cleaning performance.

Polymer substantivity is beneficial as it prolongs the sheeting and cleaning benefits. Another important feature of preferred polymers is lack of residue upon drying. Compositions comprising preferred polymers dry more evenly on floors while promoting an end result with little or no haze.

Many materials can provide the sheeting and anti-spotting benefits, but the preferred materials are polymers that contain amine oxide hydrophilic groups. Polymers that contain other hydrophilic groups such a sulfonate, pyrrolidone, and/or carboxylate groups can also be used. Examples of desirable polysulfonate polymers include polyvinylsulfonate, and more preferably polystyrene sulfonate, such as those sold by Monomer-Polymer Dajac (1675 Bustleton Pike, Feasterville, Pa. 19053). A typical formula is as follows.

$$-[CH(C_6H_4SO_3Na)-CH_2]_n-CH(C_6H_5)-CH_2-$$

wherein n is a number to give the appropriate molecular weight as disclosed below.

Typical molecular weights are from about 10,000 to about 1,000,000, preferably from about 200,000 to about 700,000. Preferred polymers containing pyrrolidone functionalities include polyvinyl pyrrolidone, quaternized pyrrolidone derivatives (such as Gafquat 755N from International Specialty Products), and co-polymers containing pyrrolidone, such as polyvinylpyrrolidone/dimethylaminoethylmethacrylate (available from ISP) and polyvinyl pyrrolidone/acrylate (available from BASF). Other materials can also provide substantivity and hydrophilicity including cationic materials that also contain hydrophilic groups and polymers that contain multiple ether linkages. Cationic materials include cationic sugar and/or starch derivatives and the typical block copolymer detergent surfactants based on mixtures of polypropylene oxide and ethylene oxide are representative of the polyether materials. The polyether materials are less substantive, however.

The preferred polymers comprise water soluble amine oxide moieties. It is believed that the partial positive charge of the amine oxide group can act to adhere the polymer to the surface of the surface substrate, thus allowing water to "sheet" more readily. The amine oxide moiety can also hydrogen-bond with hard surface substrates, such as ceramic tile, glass, fiberglass, porcelain enamel, linoleum, no-wax tile, and other hard surfaces commonly encountered in consumer homes. To the extent that polymer anchoring promotes better "sheeting" higher molecular materials are preferred. Increased molecular weight improves efficiency and effectiveness of the amine oxide-based polymer. The preferred polymers of this invention have one or more monomeric units containing at least one N-oxide group. At least about 10%, preferably more than about 50%, more preferably greater than about 90% of said monomers forming said polymers contain an amine oxide group. These polymers can be described by the general formula:

P(B)

wherein each P is selected from homopolymerizable and copolymerizable moieties which attach to form the polymer backbone, preferably vinyl moieties, e.g. C(R)2—C(R)2, wherein each R is H, $C_1$–$C_{12}$ (preferably C.sub.1–C.sub.4) alkyl(ene), $C_6$–$C_{12}$ aryl(ene) and/or B; B is a moiety selected from substituted and unsubstituted, linear and cyclic $C_1$–$C_{12}$ alkyl, $C_1$–$C_{12}$ alkylene, $C_1$–$C_{12}$ heterocyclic, aromatic $C_6$–$C_{12}$ groups and wherein at least one of said B moieties has at least one amine oxide (—N→O) group present; u is from a number that will provide at least about 10% monomers containing an amine oxide group to about 90%; and t is a number such that the average molecular weight of the polymer is from about 2,000 to about 500,000, preferably from about 5,000 to about 250,000, and more preferably from about 7,500 to about 200,000.

The preferred polymers of this invention possess the unexpected property of being substantive without leaving a visible residue that would render the surface substrate unappealing to consumers. The preferred polymers include poly (4-vinylpyridine N-oxide) polymers (PVNO), e.g. those formed by polymerization of monomers that include the following moiety:

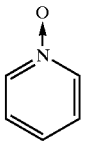

wherein the average molecular weight of the polymer is from about 2,000 to about 500,000 preferably from about 5,000 to about 400,000, and more preferably from about 7,500 to about 300,000. In general, higher molecular weight polymers are preferred. Often, higher molecular weight polymers allow for use of lower levels of the wetting polymer, which can provide benefits in floor cleaner applications. The desirable molecular weight range of polymers useful in the present invention stands in contrast to that found in the art relating to polycarboxylate, polystyrene sulfonate, and polyether based additives which prefer molecular weights in the range of 400,000 to 1,500,000. Lower molecular weights for the preferred poly-amine oxide polymers of the present invention are due to greater difficulty in manufacturing these polymers in higher molecular weight.

The level of amine oxide polymer will normally be less than about 0.5%, preferably from about 0.001% to about 0.4%, more preferably from about 0.01% to about 0.3%, by weight of the end use composition/solution.

Some non-limiting examples of homopolymers and copolymers which can be used as water soluble polymers of the present invention are: adipic acid/dimethylaminohydroxypropyl diethylenetriamine copolymer; adipic acid/epoxypropyl diethylenetriamine copolymer; polyvinyl alcohol; methacryloyl ethyl betaine/methacrylates copolymer; ethyl acrylate/methyl methacrylate/methacrylic acid/acrylic acid copolymer; polyamine resins; and polyquaternary amine resins; poly (ethenylformamide); poly(vinylamine) hydrochloride; poly (vinyl alcohol-co-6% vinylamine); poly(vinyl alcohol-co-12% vinylamine); poly(vinyl alcohol-co-6% vinylamine hydrochloride); and poly(vinyl alcohol-co-12% vinylamine hydrochloride). Preferably, said copolymer and/or homopolymers are selected from the group consisting of adipic acid/dimethylaminohydroxypropyl diethylenetriamine copolymer; poly(vinylpyrrolidone/dimethylaminoethyl methacrylate); polyvinyl alcohol; ethyl acrylate/methyl methacrylate/methacrylic acid/acrylic acid copolymer; methacryloyl ethyl betaine/methacrylates copolymer; polyquatemary amine resins; poly (ethenylformamide); poly(vinylamine) hydrochloride; poly (vinyl alcohol-co-6% vinylamine); poly(vinyl alcohol-co-12% vinylamine); poly(vinyl alcohol-co-6% vinylamine hydrochloride); and poly(vinyl alcohol-co-12% vinylamine hydrochloride).

Polymers useful in the present invention can be selected from the group consisting of copolymers of hydrophilic monomers. The polymer can be linear random or block copolymers, and mixtures thereof. The term "hydrophilic" is used herein consistent with its standard meaning of having affinity for water. As used herein in relation to monomer units and polymeric materials, including the copolymers, "hydrophilic" means substantially water soluble. In this regard, "substantially water soluble" shall refer to a material that is soluble in distilled (or equivalent) water, at 25° C., at a concentration of about 0.2% by weight, and are preferably soluble at about 1% by weight. The terms "soluble", "solubility" and the like, for purposes hereof, correspond to the maximum concentration of monomer or polymer, as applicable, that can dissolve in water or other solvents to form a homogeneous solution, as is well understood to those skilled in the art.

Nonlimiting examples of useful hydrophilic monomers are unsaturated organic mono- and polycarboxylic acids, such as acrylic acid, methacrylic acid, crotonic acid, maleic acid and its half esters, itaconic acid; unsaturated alcohols, such as vinyl alcohol, allyl alcohol; polar vinyl heterocyclics, such as, vinyl caprolactam, vinyl pyridine, vinyl imidazole; vinyl amine; vinyl sulfonate; unsaturated amides, such as acrylamides, e.g., N,N-dimethylacrylamide, N-t-butyl acrylamide; hydroxyethyl methacrylate; dimethylaminoethyl methacrylate; salts of acids and amines listed above; and the like; and mixtures thereof. Some preferred hydrophilic monomers are acrylic acid, methacrylic acid, N,N-dimethyl acrylamide, N,N-dimethyl methacrylamide, N-t-butyl acrylamide, dimethylamino ethyl methacrylate, thereof, and mixtures thereof.

Polycarboxylate polymers are those formed by polymerization of monomers, at least some of which contain carboxylic functionality. Common monomers include acrylic acid, maleic acid, ethylene, vinyl pyrrolidone, methacrylic acid, methacryloylethylbetaine, etc. Preferred polymers for substantivity are those having higher molecular weights. For example, polyacrylic acid having molecular weights below about 10,000 are not particularly substantive and therefore do not normally provide hydrophilicity for three rewettings with all compositions, although with higher levels and/or certain surfactants like amphoteric and/or zwitterionic detergent surfactants, molecular weights down to about 1000 can provide some results. In general, the polymers should have molecular weights of more than about 10,000, preferably more than about 20,000, more preferably more than about 300,000, and even more preferably more than about 400,000. It has also been found that higher molecular weight polymers, e.g., those having molecular weights of more than about 3,000,000, are extremely difficult to formulate and are less effective in providing anti-spotting benefits than lower molecular weight polymers. Accordingly, the molecular weight should normally be, especially for polyacrylates, from about 20,000 to about 3,000,000; preferably from about 20,000 to about 2,500,000; more preferably from about 300,000 to about 2,000,000; and even more preferably from about 400,000 to about 1,500,000.

An advantage for some polycarboxylate polymers is the detergent builder effectiveness of such polymers. Although such polymers do hurt filming/streaking, like other detergent builders, they provide increased cleaning effectiveness on typical, common "hard-to-remove" soils that contain particulate matter.

Some polymers, especially polycarboxylate polymers, thicken the compositions that are aqueous liquids. This can be desirable. However, when the compositions are placed in containers with trigger spray devices or with cleaning implements comprising a liquid delievery system as described hereinafter in Section V.A, the compositions are desirably not so thick as to require excessive trigger pressure or pump pressure. Typically, the viscosity under shear should be less than about 200 cp, preferably less than about 100 cp, more preferably less than about 50 cp.

Non limiting examples of polymers for use in the present invention include the following: poly(vinyl pyrrolidone/acrylic acid) sold under the name "Acrylidone"® by ISP and poly(acrylic acid) sold under the name "Accumer"® by Rohm & Haas. Other suitable materials include sulfonated polystyrene polymers sold under the name Versaflex® sold by National Starch and Chemical Company, especially Versaflex 7000.

The level of polymeric material will normally be less than about 0.5%, preferably from about 0.001% to about 0.4%, more preferably from about 0.01% to about 0.3%. In general, lower molecular weight materials such as lower molecular weight poly(acrylic acid), e.g., those having molecular weights below about 10,000, and especially about 2,000, do not provide good anti-spotting benefits upon rewetting, especially at the lower levels, e.g., about 0.02%. One should use only the more effective materials at the lower levels. In order to use lower molecular weight materials, substantivity should be increased, e.g., by adding groups that provide improved attachment to the surface, such as cationic groups, or the materials should be used at higher levels, e.g., more than about 0.05.

C. Optional Organic Solvent

The compositions, optionally, can also contain one, or more, organic cleaning solvents at effective levels, typically no less than about 0.25%, and, at least about, in increasing order of preference, about 0.5% and about 3.0%, and no more than about, in increasing order of preference, about 7% and about 5% by weight of the composition.

The surfactant provides cleaning and/or wetting even without a hydrophobic cleaning solvent present. However, the cleaning can normally be further improved by the use of the right organic cleaning solvent. By organic cleaning solvent, it is meant an agent which assists the surfactant to remove soils such as those commonly encountered in the kitchen or bathroom. The organic cleaning solvent also can participate in the building of viscosity, if needed, in increasing the stability of the composition, and/or enhancing the wetting properties of the cleaning solution. The compositions containing $C_{8-16}$ alkyl polyglucosides and $C_{8-14}$ alkylethoxylates also have lower sudsing when the solvent is present. Thus, the suds profile can be controlled in large part by simply controlling the level of hydrophobic solvent in the formulation.

Such solvents typically have a terminal $C_3$–$C_6$ hydrocarbon attached to from one to three ethylene glycol or propylene glycol moieties to provide the appropriate degree of hydrophobicity and, preferably, surface activity. Examples of commercially available hydrophobic cleaning solvents based on ethylene glycol chemistry include mono-ethylene glycol n-hexyl ether (Hexyl Cellosolve® available from Union Carbide). Examples of commercially available hydrophobic cleaning solvents based on propylene glycol chemistry include the di-, and tri-propylene glycol derivatives of propyl and butyl alcohol, which are available from Arco Chemical, 3801 West Chester Pike, Newtown Square, Pa. 19073) and Dow Chemical (1691 N. Swede Road, Midland, Mich.) under the trade names Arcosolv® and Dowanol®.

In the context of the present invention, preferred solvents are selected from the group consisting of mono-propylene glycol mono-propyl ether, di-propylene glycol mono-propyl ether, mono-propylene glycol mono-butyl ether, di-propylene glycol mono-propyl ether, di-propylene glycol mono-butyl ether; tri-propylene glycol mono-butyl ether; ethylene glycol mono-butyl ether; di-ethylene glycol mono-butyl ether, ethylene glycol mono-hexyl ether and di-ethylene glycol mono-hexyl ether, 3-methoxy-3-methyl-butanol, and mixtures thereof. "Butyl" includes both normal butyl, isobutyl and tertiary butyl groups. Mono-propylene glycol and mono-propylene glycol mono-butyl ether are the most preferred cleaning solvent and are available under the tradenames Dowanol DPnP®and Dowanol DPnB®. Di-propylene glycol mono-t-butyl ether is commercially available from Arco Chemical under the tradename Arcosolv PTB®. In some instances, it might be preferred to use combinations of these cleaning solvents, such as Hexyl cellusolve with Butyl cellusolve, or Dowanol PnB with 3-methoxy-3-methyl-butanol.

Highly preferred solvents for incorporation in the present compositions are selected based upon the boiling point of the solvent in order to minimize the filming and/or streaking left on the surface being cleaned. It has been found that solvents having a boiling point of at least about 120° C., preferably at least about 130° C., more preferably at least about 140° C., and no greater than about 180° C., preferably no greater than about 170° C., more preferably no greater than about 160° C., exhibit excellent results in terms of minimizing the filming and/or streaking left behind on a treated surface, especially in a no-rinse cleaning method. A highly preferred solvent for incorporation in the present compositions is a glycol ether solvent having a boiling point of about 140° C. to about 160° C.

The amount of organic cleaning solvent can vary depending on the amount of other ingredients present in the composition. The hydrophobic cleaning solvent is normally helpful in providing good cleaning, such as in floor cleaner applications.

D. Optional Mono- and Polycarboxylic Acids

For purposes of soap scum and hard water stain removal and/or prevention, the compositions can be made acidic with a pH of from about 2 to about 5, more preferably about 3. Acidity is accomplished, at least in part, through the use of one or more organic acids that have a pKa of less than about 5, preferably less than about 4. Such organic acids also can assist in phase formation for thickening, if needed, as well as provide hard water stain removal properties. It is found that organic acids are very efficient in promoting good hard water removal properties within the framework of the compositions of the present invention. Lower pH and use of one or more suitable acids is also found to be advantageous for disinfectancy benefits.

Examples of suitable mono-carboxylic acids include acetic acid, glycolic acid or β-hydroxy propionic acid and the like. Examples of suitable polycarboxylic acids include citric acid, tartaric acid, succinic acid, glutaric acid, adipic acid, and mixtures thereof. Such acids are readily available in the trade. Examples of more preferred polycarboxylic acids, especially non-polymeric polycarboxylic acids, include citric acid (available from Aldrich Corporation, 1001 West Saint Paul Avenue, Milwaukee, Wis.), a mixture of succinic, glutaric and adipic acids available from DuPont (Wilmington, Del.) sold as "refined AGS di-basic acids", maleic acid (also available from Aldrich), and mixtures thereof. Citric acid is most preferred, particularly for applications requiring cleaning of soap scum. Glycolic acid and the mixture of adipic, glutaric and succinic acids provide greater benefits for hard water removal. The amount of organic acid in the compositions herein can be from about 0.01% to about 1%, more preferably from about 0.01% to about 0.5%, most preferably from about 0.025% to about 0.25% by weight of the composition.

E. Optional Odor Control Agents

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins rigid, conical molecular structures with hollow interiors of specific volumes. The "lining" of each internal cavity is formed by hydrogen atoms and glycosidic bridging oxygen atoms; therefore, this surface is fairly hydrophobic. The unique shape and physical-chemical properties of the cavity enable the cyclodextrin molecules to absorb (form inclusion complexes with) organic molecules or parts of organic molecules which can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may, or may not, contain reactive functional groups. The complexation between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels on wet surfaces. As the water is being removed however, e.g., the surface is being dried off, some low molecular weight organic amines and acids have more affinity and will complex with the cyclodextrins more readily.

The cavities within the cyclodextrin in the solution of the present invention should remain essentially unfilled (the cyclodextrin remains uncomplexed) while in solution, in order to allow the cyclodextrin to absorb various odor molecules when the solution is applied to a surface. Non-derivatised (normal) beta-cyclodextrin can be present at a level up to its solubility limit of about 1.85% (about 1.85 g in 100 grams of water) at room temperature. Beta-cyclodextrin is not preferred in compositions which call for a level of cyclodextrin higher than its water solubility limit. Non-derivatised beta-cyclodextrin is generally not preferred when the composition contains surfactant since it affects the surface activity of most of the preferred surfactants that are compatible with the derivatised cyclodextrins.

Preferably, the cyclodextrins used in the present invention are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2–CH(OH)—CH_3$ or a $—CH_2CH_2—OH$ group; branched cyclodextrins such as maltose-bonded cyclodextrins; cationic cyclodextrins such as those containing 2-hydroxy-3-(dimethylamino)propyl ether, wherein R is $CH_2—CH(OH)—CH_2—N(CH_3)_2$ which is cationic at low pH; quaternary ammonium, e.g., 2-hydroxy-3-(trimethylammonio) propyl ether chloride groups, wherein R is $CH_2—CH(OH)—CH_2—N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, said references being incorporated herein by reference; and mixtures thereof. Other cyclodextrin derivatives are disclosed in U.S. Pat. No. : 3,426,011, Parmerter et al., issued Feb. 4, 1969; U.S. Pat. Nos. 3,453,257; 3,453,258; 3,453,259; and 3,453,260, all in the names of Parmerter et al., and all issued Jul. 1, 1969; U.S. Pat. No. 3,459,731, Gramera et al., issued Aug. 5, 1969; U.S. Pat. No. 3,553,191, Parmerter et al., issued Jan. 5, 1971; U.S. Pat. No. 3,565,887, Parmerter et al., issued Feb. 23, 1971; U.S. Pat. No. 4,535,152, Szejtli et al., issued Aug. 13, 1985; U.S. Pat. No. 4,616,008, Hirai et al., issued Oct. 7, 1986; U.S. Pat. No. 4,678,598, Ogino et al., issued Jul. 7, 1987; U.S. Pat. No. 4,638,058, Brandt et al., issued Jan. 20, 1987; and 4,746,734, Tsuchiyama et al., issued May 24, 1988; all of said patents being incorporated herein by reference.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odor control performance. Solubilized, water-soluble cyclodextrin can exhibit more efficient odor control performance than non-water-soluble cyclodextrin when deposited onto surfaces.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar USA, Inc. and Wacker Chemicals (USA), Inc.

It is also preferable to use a mixture of cyclodextrins. Such mixtures absorb odors more broadly by complexing with a wider range of odoriferous molecules having a wider range of molecular sizes. Preferably at least a portion of the cyclodextrin is alpha-cyclodextrin and/or its derivatives, gamma-cyclodextrin and/or its derivatives, and/or derivatised beta-cyclodextrin, more preferably a mixture of alpha-cyclodextrin, or an alpha-cyclodextrin derivative, and derivatised beta-cyclodextrin, even more preferably a mixture of derivatised alpha-cyclodextrin and derivatised beta-cyclodextrin, most preferably a mixture of hydroxypropyl alpha-cyclodextrin and hydroxypropyl beta-cyclodextrin, and/or a mixture of methylated alpha-cyclodextrin and methylated beta-cyclodextrin.

It is preferable that the usage compositions of the present invention contain low levels of cyclodextrin so that no visible residue appears at normal usage levels. Preferably, the solution used to treat the surface under usage conditions is virtually not discernible when dry. Typical levels of cyclodextrin in usage compositions for usage conditions are from about 0.01% to about 1%, preferably from about 0.05% to about 0.75%, more preferably from about 0.1% to about 0.5% by weight of the composition. Compositions with higher concentrations can leave unacceptable visible residues.

F. Optional Source of Peroxide

The compositions of the invention can contain peroxide such as hydrogen peroxide, or a source of hydrogen peroxide, for further disinfectancy, fungistatic and fungicidal benefits. The components of the present composition are substantially compatible with the use of peroxides. Preferred peroxides include benzoyl peroxide and hydrogen peroxide. These can optionally be present in the compositions herein in levels of from about 0.05% to about 5%, more preferably from about 0.1% to about 3%, most preferably from about 0.2% to about 1.5%.

When peroxide is present, it is desirable to provide a stabilizing system. Suitable stabilizing systems are known. A preferred stabilizing system consists of radical scavengers and/or metal chelants present at levels of from about 0.01% to about 0.5%, more preferably from about 0.01% to about 0.25%, most preferably from about 0.01% to about 0.1%, by weight of the composition. Examples of radical scavengers include anti-oxidants such as propyl gallate, butylated hydroxy toluene (BHT), butylated hydroxy anisole (BHA) and the like. Examples of suitable metal chelants include diethylene triamine penta-acetate, diethylene triamine penta-methylene phosphonate, hydroxyethyl diphosphonate and the like.

G. Optional Thickening Polymer

Low levels of polymer can also be used to thicken the preferred aqueous compositions of the present invention. In general, the level of thickening polymer is kept as low as possible so as not to hinder the product's end result properties. Xanthan gum is a particularly preferred thickening agent as it can also enhance end result properties, particularly when used in low concentrations. The thickening polymer agent is present in from about 0.001% to about 0.1%, more preferably from about 0.0025% to about 0.05%, most preferably from about 0.005% to about 0.025% by weight of the composition.

H. Aqueous Solvent System

The compositions which are aqueous, comprise at least about 80% aqueous solvent by weight of the composition, more preferably from about 80% to over 99% by weight of the composition. The aqueous compositions are typically in micellar form, and do not incorporate substantial levels of water insoluble components that induce significant micellar swelling.

The aqueous solvent system can also comprise low molecular weight, highly water soluble solvents typically found in detergent compositions, e.g., ethanol, isopropanol, etc. These solvents can be used to provide disinfectancy properties to compositions that are otherwise low in active. Additionally, they can be particularly useful in compositions wherein the total level of perfume is very low. In effect, highly volatile solvents can provide "lift", and enhance the character of the perfume. Highly volatile solvents, if present are typically present in from about 0.25% to about 5%, more preferably from about 0.5% to about 3%, most preferably from about 0.5% to about 2%, by weight of the composition. Examples of such solvents include methanol, ethanol, isopropanol, n-butanol, iso-butanol, 2-butanol, pentanol, 2-methyl-1-butanol, methoxymethanol, methoxyethanol, methoxy propanol, and mixtures thereof.

The aqueous solvent system preferably comprises water, more preferably soft water, and most preferably deionized water. The use of deionized or distilled water eliminates issues with poor filming and/or streaking end results due to the deposition of hard water minerals. This water also allows the use of anionic species in the formula (such as surfactants and polymers) without potential issues with calcium and/or magnesium precipitation of these actives.

The compositions of the present invention can also include other solvents, and in particular paraffins and isoparaffins, which can substantially reduce the suds created by the composition.

I. Optional Suds Suppressor

Suitable silicone suds suppressors for use herein include any silicone and silica-silicone mixtures. Silicones can be generally represented by alkylated polysiloxane materials while silica is normally used in finely divided forms exemplified by silica aerogels and xerogels and hydrophobic silicas of various types. In industrial practice, the term "silicone" has become a generic term which encompasses a variety of relatively high-molecular-weight polymers containing siloxane units and hydrocarbyl groups of various types. Indeed, silicone compounds have been extensively described in the art, see for instance United States Patents: U.S. Pat. No. 4,076,648; U.S. Pat. No. 4,021,365; U.S. Pat. No. 4,749,740; U.S. Pat. No. 4,983,316 and European Patents: EP 150,872; EP 217,501; and EP 499,364, all of said patents being incorporated herein by reference. Preferred are polydiorganosiloxanes such as polydimethylsiloxanes having trimethylsilyl end blocking units and having a viscosity at 25° C. of from $5\times10^{-5}$ $m^2/s$ to 0.1 $m^2/s$, i.e. a value of n in the range 40 to 1500. These are preferred because of their ready availability and their relatively low cost.

A preferred type of silicone compounds useful in the compositions herein comprises a mixture of an alkylated siloxane of the type hereinabove disclosed and solid silica. The solid silica can be a fumed silica, a precipitated silica or a silica made by the gel formation technique. The silica particles can be rendered hydrophobic by treating them with diakylsilyl groups and/or trialkylsilane groups either bonded directly onto the silica or by means of silicone resin. A preferred silicone compound comprises a hydrophobic silanated, most preferably trimethylsilanated silica having a particle size in the range from 10 mm to 20 mm and a specific surface area above 50 $m^2/g$. Silicone compounds employed in the compositions according to the present invention suitably have an amount of silica in the range of 1 to 30% (more preferably 2.0 to 15%) by weight of the total weight of the silicone compounds resulting in silicone compounds having an average viscosity in the range of from $2\times10^{-4}$ $m^2/s$ to 1 $m^2/s$. Preferred silicone compounds can have a viscosity in the range of from $5\times10^{-3}$ $m^2/s$ to 0.1 $m^2/s$. Particularly suitable are silicone compounds with a viscosity of $2\times10^2$ $m^2/s$ or $4.5\times10^2$ $m^2/s$.

Suitable silicone compounds for use herein are commercially available from various companies including Rhone Poulenc, Fueller and Dow Corning. Examples of silicone compounds for use herein are Silicone DB® 100 and Silicone Emulsion 2-3597® both commercially available from Dow Corning.

Fatty acids, typical of those used in laundry cleaning products, may also be used to suppress the suds of these solutions.

J. Optional Perfume

The present compositions optionally, but preferably, contain perfume to provide a positive scent signal to a consumer during use of the present compositions, cleaning pads, and/or cleaning implements. The preferred compositions herein typically comprise low levels of surfactant, in which case careful selection of perfume materials is typically required in order to create a perfume that is both soluble in the low-surfactant composition and still provides a positive scent signal. Perfume is normally incorporated in the present compositions at a level of from about 0.005% to about 0.20%, preferably from about 0.01% to about 0.15%, more preferably from about 0.01% to about 0.08%, and still more preferably from about 0.03% to about 0.06%, by weight of the hard surface cleaning composition.

The ratio of surfactant to perfume in the present compositions is typically from about 20:1 to about 1:50, and preferably from about 1:1 to about 1:4.

In the present invention, the optional perfume comprises perfume materials which are characterized by their boiling point (B.P.) and octanol/water partition coefficient (P). The octanol/water partition coefficient of a perfume ingredient is the ratio between its equilibrium concentrations in octanol and in water. The boiling points of the perfume ingredients herein are determined at the normal, standard pressure of about 760 mmHg. Since the partition coefficients of the preferred perfume ingredients of this invention have high values, they are more conveniently given in the form of their logarithm to the base 10, logP at 25° C.

Boiling points of many perfume ingredients can be found in the following sources:

Properties of Organic Compounds Database CD-ROM Ver. 5.0

CRC Press

Boca Raton, Fla.

Flavor and Fragrance—1995

Aldrich Chemical Co.

Milwaukee, Wis.

STN database/on-line

Design Institute of for Physical Property Data

American Institute of Chemical Engineers

STN database/on-line

Beilstein Handbook of Organic Chemistry

Beilstein Information Systems

Perfume and Flavor Chemicals

Steffen Arctander

Vol. I, II-1969

When unreported, the 760 mmHg boiling points of perfume ingredients can be estimated. The following computer programs are useful for estimating these boiling points:

MPBPVP Version 1.25© 1994–96 Meylan

Syracuse Research Corporation (SRC)

Syracuse, N.Y.

ZPARC

ChemLogic, Inc.

Cambridge, Mass.

The logP of many perfume ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the Pamona Med Chem/Daylight "CLOGP" program, Version 4.42 available from Biobyte Corporation, Claremont, Calif. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are preferably used instead of the experimental logP values in the selection of perfume ingredients which are useful in the present invention.

The present perfume materials are defined herein according to boiling point and ClogP as follows: volatile, hydrophilic perfume materials; volatile, hydrophobic perfume materials; residual, hydrophilic perfume materials; residual, hydrophobic perfume materials.

i. Volatile, Hydrophilic Perfume Materials

Volatile, hydrophilic perfume materials have a boiling point of less than about 250° C. and a ClogP of less than about 3. These materials tend to be rather soluble in the present hard surface cleaning compositions, even those with relatively high levels of water and low levels of surfactant. These materials impart some solution odor and some odor to the room containing the surfaces being treated. Volatile, hydrophilic perfume materials tend to evaporate with the water contained in the present compositions, which provides some odor to the room containing the treated surfaces. These materials also do not tend to leave visual filming and/or streaking on the treated surfaces. As a result, volatile, hydrophilic perfume materials typically comprise a relatively large portion of the present perfumes, typically at levels of from about 0.05% to about 90%, preferably from about 1% to about 70%, more preferably from about 5% to about 60%, and still more preferably from about 10% to about 50% by weight of the perfume.

Examples of volatile, hydrophilic perfume materials include those listed in Table 1 as follows:

TABLE 1

Examples of Volatile, Hydrophilic Perfume Materials

| Perfume Material | ClogP (Pred.) | Boiling Pt. (Meas.) | Boiling Pt. (Pred.) |
|---|---|---|---|
| Allyl caproate | 2.87 | 186 | |
| Amyl acetate (n-Pentyl acetate) | 2.30 | 147 | |
| Amyl Propionate | 2.83 | 169 | |
| p-Anisaldehyde | 1.78 | 249 | |
| Anisole | 2.06 | 154 | |
| Benzaldehyde (Benzenecarboxaldehyde) | 1.50 | 179 | |
| Benzyl acetate | 1.96 | 211 | |
| Benzylacetone | 1.74 | 234 | |
| Benzyl alcohol | 1.10 | 205 | |
| Benzyl formate | 1.50 | 203 | |
| Benzyl isovalerate | 3.42 | | 256 |
| Benzyl propionate | 2.49 | 221 | |
| beta-gamma-Hexenol (2-Hexen-1-ol) | 1.40 | | 164 |
| (+)-Camphor | 2.18 | 207 | |
| (+)-Carvone | 2.01 | 231 | |
| L-Carvone | 2.01 | | 230 |
| Cinnamic alcohol | 1.41 | | 258 |
| Cinnamyl formate | 1.91 | 252 | |
| cis-Jasmone | 2.64 | | 253 |
| cis-3-Hexenyl acetate | 2.34 | | 175 |
| Citral (Neral) | 2.95 | 208 | |
| Cumic alcohol | 2.53 | 249 | |
| Cuminaldehyde | 2.92 | 235 | |
| Cyclal (2,4-Dimethyl-3-cyclohexene-1-carboxaldehyde) | 2.36 | | 203 |
| Dimethyl benzyl carbinol | 1.89 | 215 | |
| Dimethyl benzyl carbinyl acetate | 2.84 | | 248 |
| Ethyl acetate | 0.71 | 77 | |
| Ethyl acetoacetate | 0.33 | 181 | |
| Ethyl amyl ketone | 2.44 | 167 | |
| Ethyl benzoate | 2.64 | 215 | |
| Ethyl butanoate | 1.77 | 121 | |
| 3-Nonanone (Ethyl hexyl ketone) | 2.97 | 187 | |
| Ethyl phenylacetate | 2.35 | 228 | |
| Eucalyptol | 2.76 | 176 | |
| Eugenol | 2.40 | 253 | |
| Fenchyl alcohol | 2.58 | 199 | |
| Flor Acetate (Tricyclodecenyl acetate) | 2.36 | | 233 |
| Frutene (Tricyclodecenyl propionate) | 2.89 | | 250 |
| gamma-Nonalactone | 2.77 | 243 | |
| trans-Geraniol | 2.77 | 230 | |
| cis-3-Hexen-1-ol/Leaf Alcohol | 1.40 | 156 | |
| Hexyl acetate | 2.83 | 171 | |
| Hexyl formate | 2.38 | 155 | |
| Hydratopic alcohol | 1.58 | | 233 |
| Hydroxycitronellal | 1.54 | 241 | |
| Indole (2,3-Benzopyrrole) | 2.13 | 254 | |
| Isoamyl alcohol | 1.22 | 131 | |
| Isopropyl phenylacetate | 2.66 | | 237 |
| Isopulegol | 2.75 | | 231 |
| Isoquinoline (Benzopyridine) | 1.82 | 243 | |
| Ligustral (2,4-Dimethyl-3-Cyclohexene-1-carboxaldehyde) | 2.36 | | 204 |
| Linalool | 2.55 | 193 | |
| Linalool oxide | 1.45 | | 223 |
| Linalyl formate | 3.05 | | 212 |
| Menthone | 2.83 | | 214 |
| 4-Methylacetophenone | 2.08 | 226 | |
| Methyl pentyl ketone | 1.91 | 151 | |
| Methyl anthranilate | 2.02 | 256 | |
| Methyl benzoate | 2.11 | 199 | |
| Methyl Phenyl Carbinyl Acetate (alpha-Methylbenzyl acetate) | 2.27 | | 216 |
| Methyl Eugenol (Eugenyl methyl ether) | 2.67 | 254 | |
| Methyl Heptenone (6-Methyl-5-hepten-2-one) | 1.82 | 173 | |
| Methyl Heptine Carbonate (Methyl 2-octynoate) | 2.57 | 218 | |
| Methyl Heptyl ketone | 2.97 | 195 | |
| Methyl Hexyl ketone | 2.44 | 173 | |
| Methyl salicylate | 2.45 | 223 | |
| Dimethyl anthranilate | 2.16 | 255 | |
| Nerol | 2.77 | 225 | |
| delta-Nonalactone | 2.80 | | 226 |

TABLE 1-continued

Examples of Volatile, Hydrophilic Perfume Materials

| Perfume Material | ClogP (Pred.) | Boiling Pt. (Meas.) | Boiling Pt. (Pred.) |
|---|---|---|---|
| gamma-Octalactone | 2.24 | 256 | |
| 2-Octanol | 2.72 | 180 | |
| Octyl Aldehyde (Caprylic aldehyde) | 2.95 | 167 | |
| p-Cresol | 1.97 | 202 | |
| p-Cresyl methyl ether | 2.56 | 175 | |
| Acetanisole | 1.80 | 258 | |
| 2-Phenoxyethanol | 1.19 | 245 | |
| Phenylacetaldehyde | 1.78 | 195 | |
| 2-Phenylethyl acetate | 2.13 | 235 | |
| Phenethyl alcohol | 1.18 | 218 | |
| Phenyl Ethyl dimethyl Carbinol (Benzyl-tert-butanol) | 2.42 | | 257 |
| Prenyl acetate | 1.68 | | 150 |
| Propyl butanoate | 2.30 | 143 | |
| (+)-Pulegone | 2.50 | 224 | |
| Rose oxide | 2.90 | | 197 |
| Safrole | 2.57 | 235 | |
| 4-Terpinenol | 2.75 | 211 | |
| Terpinolene (alpha-Terpineol) | 2.63 | 219 | |
| Veratrole (1,2-Dimethoxyhenzene) | 1.60 | 206 | |
| Viridine (Phenylacetaldehyde dimethyl acetal) | 1.29 | 220 | |

ii. Volatile, Hydrophobic Perfume Materials

Volatile, hydrophobic perfume materials have a boiling point of less than about 250° C. and a ClogP of greater than about 3. These materials tend to be rather insoluble in the present hard surface cleaning compositions, but are typically capable of providing a powerful positive scent signal, as they tend to be highly volatile and easily diffuse out of the hard surface cleaning composition. These perfume materials are highly desirable in the present composition since they tend to provide a strong scent signal, both in solution and in the room containing the surfaces being treated. Volatile, hydrophobic perfume materials are generally at relatively high levels in the present compositions of at least about 0.2%, preferably at least about 8%, more preferably at least about 14%, and still more preferably at least about 50% by weight of the perfume.

Examples of volatile, hydrophilic perfume materials include those listed in Table 2 as follows:

TABLE 2

Examples of Volatile, Hydrophilic Perfume Materials

| Perfume Material | ClogP (Pred.) | Boiling Pt. (Meas.) | Boiling Pt. (Pred.) |
|---|---|---|---|
| Allo-ocimene | 4.36 | | 195 |
| Allyl cyclohexanepropionate | 3.94 | | 252 |
| Allyl heptanoate | 3.40 | | 209 |
| trans-Anethole | 3.31 | 232 | |
| Benzyl butyrate | 3.02 | 240 | |
| Camphene | 4.18 | 160 | |
| Cadinene | 7.27 | | 252 |
| Carvacrol | 3.40 | 238 | |
| cis-3-Hexenyl tiglate | 3.80 | | 225 |
| Citronellol | 3.25 | 223 | |
| Citronellyl acetate | 4.20 | 234 | |

TABLE 2-continued

Examples of Volatile, Hydrophilic Perfume Materials

| Perfume Material | ClogP (Pred.) | Boiling Pt. (Meas.) | Boiling Pt. (Pred.) |
|---|---|---|---|
| Citronellyl nitrile | 3.09 | 226 | |
| Citronellyl propionate | 4.73 | | 257 |
| Cyclohexylethyl acetate | 3.36 | 222 | |
| Decyl Aldehyde (Capraldehyde) | 4.01 | 208 | |
| Dihydromyrcenol | 3.03 | 192 | |
| Dihydromyrcenyl acetate | 3.98 | | 221 |
| 3,7-Dimethyl-1-octanol | 3.74 | 205 | |
| Diphenyloxide | 4.24 | 259 | |
| Fenchyl Acetate (1,3,3-Trimethyl-2-norbornanyl acetate) | 3.53 | | 234 |
| Geranyl acetate | 3.72 | 233 | |
| Geranyl formate | 3.27 | | 231 |
| Geranyl nitrile | 3.25 | 228 | |
| cis-3-Hexenyl isobutyrate | 3.27 | | 204 |
| Hexyl Neopentanoate | 4.06 | | 213 |
| Hexyl tiglate | 4.28 | | 221 |
| alpha-Ionone | 3.71 | 237 | |
| Isobornyl acetate | 3.53 | 238 | |
| Isobutyl benzoate | 3.57 | 242 | |
| Isononyl acetate | 4.28 | | 220 |
| Isononyl alcohol (3,5,5-Trimethyl-1-hexanol) | 3.08 | 194 | |
| Isopulegyl acetate | 3.70 | | 243 |
| Lauraldehyde | 5.07 | 250 | |
| d-Limonene | 4.35 | 177 | |
| Linalyl acetate | 3.50 | | 230 |
| (−)-L-Menthyl acetate | 4.18 | 227 | |
| Methyl Chavicol (Estragole) | 3.13 | 216 | |
| Methyl n-nonyl acetaldehyde | 4.85 | 247 | |
| Methyl octyl acetaldehyde | 4.32 | | 224 |
| beta-Myrcene | 4.33 | | 165 |
| Neryl acetate | 3.72 | 236 | |
| Nonyl acetate | 4.41 | 229 | |
| Nonaldehyde | 3.48 | 191 | |
| p-Cymene | 4.07 | 173 | |
| alpha-Pinene | 4.18 | 156 | |
| beta-Pinene | 4.18 | 166 | |
| alpha-Terpinene | 4.41 | 175 | |
| gamma-Terpinene | 4.35 | 183 | |
| alpha-Terpinyl acetate | 3.58 | 220 | |
| Tetrahydrolinalool | 3.52 | 202 | |
| Tetrahydromyrcenol | 3.52 | 195 | |
| 2-Undecenal | 4.22 | | 235 |
| Verdox (o-t-Butylcyclohexyl acetate) | 4.06 | | 239 |
| Vertenex (4-tert.Butylcyclohexyl acetate) | 4.06 | | 237 |

iii. Residual, Hydrophilic Perfume Materials

Residual, hydrophilic perfume materials have a boiling point of greater than about 250° C. and a ClogP of less than about 3. These perfume materials tend to be rather soluble in compositions containing relatively high levels of water and low levels of surfactant. These materials do not provide a significant scent signal from solution. In addition, these materials tend to leave visual filming and/or streaking of the treated surfaces, especially when used in no-rinse cleaning methods, which can be unacceptable to consumers. As a result, these residual, hydrophilic perfume materials are typically incorporated in the present compositions at relatively low levels. Residual, hydrophilic perfume materials are typically incorporated in the present compositions at a level of less than about 10%, preferably less than about 3%, more preferably less than about 0.7%, and still more preferably less than about 0.01% by weight of the perfume.

Examples of residual, hydrophilic perfume materials include those listed in Table 3 as follows:

TABLE 3

Examples of Residual, Hydrophilic Perfume Materials

| Perfume Material | ClogP (Pred.) | Boiling Pt. (Meas.) | Boiling Pt. (Pred.) |
|---|---|---|---|
| Coumarin | 1.41 | 302 | |
| Ethyl methylphenylglycidate | 2.71 | 274 | |
| Ethyl Vanillin | 1.80 | 2.85 | |
| Isoeugenol | 2.58 | 266 | |
| Methyl cinnamate | 2.47 | 262 | |
| Methyl dihydrojasmonate | 2.42 | | 314 |
| Methyl beta-naphthyl ketone | 2.76 | 302 | |
| Phenoxy ethyl isobutyrate | 2.92 | | 277 |
| Vanillin | 1.28 | 285 | |

iv. Residual, Hydrophobic Perfume Materials

Residual, hydrophobic perfume materials have a boiling point of greater than about 250° C. and a ClogP of greater than about 3. These materials tend to be rather insoluble in compositions having relatively high levels of water. The level of residual, hydrophobic perfume materials should be kept to a small amount, as such materials typically result in leaving visual filming and/or streaking on treated surfaces that is unacceptable to consumers, especially in a no-rinse cleaning method. These perfume materials also do not provide much in the way of a positive scent signal from the solution. Residual, hydrophobic perfume materials do provide a minimal scent signal while treating the surfaces with the present compositions, but this benefit is negated by the visual filming and/or streaking left behind by these materials.

Residual, hydrophobic perfume materials are typically incorporated in the present perfume at a level of less than about 10%, preferably less than about 5%, more preferably less than about 1%, and still more preferably less than about 0.01% by weight of the perfume.

Examples of residual, hydrophobic perfume materials include those listed in Table 4 as follows:

TABLE 4

Examples of Residual, Hydrophobic Perfume Materials

| Perfume Material | ClogP (Pred.) | Boiling Pt. (Meas.) | Boiling Pt. (Pred.) |
|---|---|---|---|
| (Ambrettolide) Oxacycloheptadec-10-en-2-one | 6.36 | | 352 |
| (Amyl benzoate) n-Pentyl benzoate | 4.23 | | 263 |
| Isoamyl cinnamate | 4.45 | | 300 |
| alpha-Amylcinnamaldehyde | 4.32 | 289 | |
| alpha-Amylcinnamaldehyde dimethyl acetal | 4.03 | | 320 |
| (iso-Amyl Salicylate) isopentyl salicylate | 4.43 | 277 | |
| (Aurantiol) Methyl anthranilate/hydroxycitronellal Schiff base | 4.22 | | 413 |
| Benzophenone | 3.18 | 305 | |
| Benzyl salicylate | 4.21 | 320 | |
| beta-Caryophyllene | 6.45 | | 263 |
| Cedrol | 4.53 | | 274 |
| Cedryl acetate | 5.48 | | 289 |
| Cinnamyl cinnamate | 4.64 | | 387 |
| Citronellyl isobutyrate | 5.04 | | 266 |
| Cyclohexyl salicylate | 4.48 | | 327 |
| Cyclamen aldehyde | 3.46 | | 271 |
| delta-Dodecalactone | 4.39 | | 279 |
| (Dihydro Isojasmonate) Methyl 2-hexyl-3-oxo-cyclopentanecarboxylate | 3.09 | | 314 |
| Diphenylmethane | 4.06 | 265 | |

TABLE 4-continued

Examples of Residual, Hydrophobic Perfume Materials

| Perfume Material | ClogP (Pred.) | Boiling Pt. (Meas.) | Boiling Pt. (Pred.) |
|---|---|---|---|
| Ethylene brassylate | 4.62 | | 390 |
| Ethyl undecylenate | 4.99 | 261 | |
| Iso E Super | 4.85 | | 307 |
| (Exaltolide) Pentadecanolide | 6.29 | | 338 |
| (Galaxolide) 4,6,6,7,8,8-Hexamethyl-1,3,4,6,7,8-hexahydro-cyclopenta(G)-2-benzopyran | 6.06 | | 335 |
| gamma-Methyl Ionone (alpha-Isomethylionone) | 4.02 | | 278 |
| Geranyl isobutyrate | 5.00 | | 295 |
| Hexadecanolide | 6.85 | | 352 |
| cis-3-Hexenyl salicylate | 4.61 | | 323 |
| alpha-Hexylcinnamaldehyde | 4.85 | | 334 |
| n-Hexyl salicylate | 5.09 | | 318 |
| alpha---Irone | 4.23 | | 279 |
| 6-Isobutylquinoline | 3.99 | | 294 |
| Lilial (p-tert.Butyl-alpha-methyldihydrocinnamic aldehyde, PT Bucinol) | 3.86 | | 282 |
| Linalyl benzoate | 5.42 | | 325 |
| (2-Methoxy Naphthalene) beta-Naphthyl methyl ether | 3.24 | 274 | |
| 10-Oxahexadecanolide | 4.38 | | 355 |
| Patchouli alcohol | 4.53 | | 317 |
| (Phantolide) 5-Acetyl-1,1,2,3,3,6-hexamethylindan | 5.69 | | 333 |
| Phenethyl benzoate | 4.06 | | 335 |
| Phenethyl phenylacetate | 3.77 | | 350 |
| Phenyl Hexanol (3-Methyl-5-phenyl-1-pentanol) | 3.17 | | 296 |
| Tonalid (7-Acetyl-1,1,3,4,4,6-hexamethyltetralin) | 6.25 | | 344 |
| delta-Undecalactone | 3.86 | | 262 |
| gamma-Undecalactone | 3.83 | 286 | |
| Vertinert Acetate | 5.47 | | 332 |

v. Low Odor Detection Threshold Perfume Materials

The present compositions can also contain low to moderate levels of low odor detection threshold materials, either dissolved in the aqueous phase to the extent of their water solubility or incorporated into an emulsion or dispersion with the other hydrophobic perfume ingredients. The odor detection threshold is the lowest vapor concentration of that material which can be olfactorily detected. The odor detection threshold and some odor detection threshold values are discussed in, e.g., "Standardized Human Olfactory Thresholds", M. Devos et al, IRL Press at Oxford University Press, 1990, and "Compilation of Odor and Taste Threshold Values Data", F. A. Fazzalari, editor, ASTM Data Series DS 48A, American Society for Testing and Materials, 1978, both of said publications being incorporated herein by reference. The use of small amounts of perfume ingredients that have low odor detection threshold values can improve perfume odor character. Perfume ingredients that have a significantly low detection threshold, useful in the composition of the present invention, are selected from the group consisting of ambrox, bacdanol, benzyl salicylate, butyl anthranilate, cetalox, damascenone, alpha-damascone, gamma-dodecalactone, ebanol, herbavert, cis-3-hexenyl salicylate, alpha-ionone, beta-ionone, alpha-isomethylionone, lilial, methyl nonyl ketone, gamma-undecalactone, undecylenic aldehyde, and mixtures thereof. These materials are preferably present at low levels, typically less than about 30%, preferably less than about 20%, more preferably less than about 15%, by weight of the total perfume compositions of the present invention. However, only low levels are required to provide an effect.

There are also hydrophilic ingredients that have a significantly low detection threshold, and are especially useful in the composition of the present invention. Examples of these ingredients are allyl amyl glycolate, anethole, benzyl acetone, calone, cinnamic alcohol, coumarin, cyclogalbanate, Cyclal C, cymal, 4-decenal, dihydro isojasmonate, ethyl anthranilate, ethyl-2-methyl butyrate, ethyl methylphenyl glycidate, ethyl vanillin, eugenol, flor acetate, florhydral, fructone, frutene, heliotropin, keone, indole, iso cyclo citral, isoeugenol, lyral, methyl heptine carbonate, linalool, methyl anthranilate, methyl dihydrojasmonate, methyl isobutenyl tetrahydropyran, methyl beta naphthyl ketone, beta naphthol methyl ether, nerol, para-anisic aldehyde, para hydroxy phenyl butanone, phenyl acetaldehyde, vanillin, and mixtures thereof. Use of low odor detection threshold perfume ingredients minimizes the level of organic material that is released into the atmosphere.

K. Optional Detergent Adiuvants

Optional components, including detergent adjuvants such as detergency builders, buffers, preservatives and antimicrobial agents, can also be present.

i. Detergency Builders

Detergent builders that are efficient for hard surface cleaners and have reduced filming/streaking characteristics at the critical levels are another optional ingredient. Preferred detergent builders are the carboxylic acid detergent builders described hereinbefore as part of the polycarboxylic acid disclosure, including citric and tartaric acids. Tartaric acid improves cleaning and can minimize the problem of filming/streaking that usually occurs when detergent builders are added to hard surface cleaners.

The detergent builder is present at levels that provide detergent building, and, those that are not part of the acid pH adjustment described hereinbefore, are typically present at a level of from about 0.01% to about 0.3%, more preferably from about 0.005% to about 0.2%, and most preferably from about 0.05% to about 0.1%.

ii. Buffers

The compositions herein can also contain other various adjuncts which are known to the art for detergent compositions. Preferably they are not used at levels that cause unacceptable filming/streaking. Buffers are an important class of adjuncts in this application. This occurs mainly as a result of the low levels of active employed. An ideal buffer system will maintain pH over a desired narrow range, while not leading to streaking/filming issues. Preferred buffers in the context of the invention are those which are highly volatile, yet can provide cleaning benefits in use. As such, they are advantageous in that they can be used at higher levels than corresponding buffers that are less volatile. Such buffers tend to have low molecular weight, i.e., less than about 150 g/mole and generally contain no more than one hydroxy group. Examples of preferred buffers include ammonia, methanol amine, ethanol amine, 2-amino-2-methyl-1-propanol, 2-dimethylamino-2-methyl-1-propanol, acetic acid, glycolic acid and the like. Most preferred among these are ammonia, 2-dimethylamino-2-methyl-1-propanol and acetic acid. When used, these buffers are present in from about 0.005% to about 0.5%, with the higher levels being more preferred for the more volatile chemicals.

Non-volatile buffers can also be used in this invention. Such buffers must be used at generally lower levels than the preferred levels because of increased streaking/filming tendencies. Examples of such buffers include, but are not limited to, sodium carbonate, potassium carbonate and bicarbonate, 1,3-bis(aminomethyl) cyclohexane, sodium citrate, citric acid, maleic acid, tartaric acid, and the like. Maleic acid is particularly preferred as a buffer because of its tendency not to induce surface damage. Citric acid is also desirable since it provides anti-microbial benefits as a registered EPA active. Additionally, in compositions comprising the hydrophilic polymers of the present invention for daily shower applications, acidity has been found to promote better wetting and provide longer lasting "sheeting" effects. When used, non-volatile buffers are present in from about 0.001% to about 0.05% by weight of the composition.

In some instances, it could be advantageous to combine a volatile buffer with a non-volatile buffer to maintain the best pH control. As an example, the volatile buffer could be used to give an appropriate intial pH, while the non-volatile buffer could be used to deliver residual alkalinity. As such, the total level of non-volatiles in the formula is kept to a minimum.

iii. Preservatives and Antibacterial Agents

Preservatives can also be used, and may be required in many of the compositions of the present invention, since these contain high levels of water. Examples of preservatives include bronopol, hexitidine sold by Angus chemical (211 Sanders Road, Northbrook, Ill., USA). Other preservatives include Kathon, 2-((hydroxymethyl) (amino) ethanol, propylene glycol, sodium hydroxymethyl amino acetate, formaldehyde and glutaraldehyde, dichloro-s-triazinetrione, trichloro-s-triazinetrione, and quaternary ammonium salts including dioctyl dimethyl ammonium chloride, didecyl dimethyl ammonium chloride, $C_{12}$, $C_{14}$ and $C_{16}$ dimethyl benzyl. Preferred preservatives include 1,2-benzisothiazolin-3-one and polyhexamethylene biguanide sold by Avicia Chemicals (Wilmington, Del. 19897) and chlorhexidine diacetate sold by Aldrich-Sigma (1001 West Saint Paul Avenue, Milwaukee, Wis. 53233), sodium pyrithione sold by Arch Chemicals (501 Merritt Seven, P.O. Box 5204, Norwalk Conn. 06856) sold by Arch Chemicals. When used, preservatives are preferentially present at concentrations of from about 0.0001% to about 0.01%. These same preservatives can function to provide antibacterial control on the surfaces, but typically will require use at higher levels from about 0.005 to about 0.1%. Other antibacterial agents, including quaternary ammonium salts, can be present, but are not preferred in the context of the present invention at high levels, i.e., at levels greater than about 0.05%. Such compounds have been found to often interfere with the benefits of the preferred polymers. In particular, quaternary ammonium surfactants tend to hydrophobically modify hard surfaces. Thus, the preferred polymers are found to be ineffective in compositions comprising significant concentrations of quaternary ammonium surfactants. Similar results have been found using amphoteric surfactants, including lauryl betaines and coco amido betaines. When present, the level of cationic or amphoteric surfactant should be at levels below about 0.1%, preferably below about 0.05%. More hydrophobic antibacterial/germicidal agents, like orthobenzyl-para-chlorophenol, are avoided. If present, such materials should be kept at levels below about 0.05%.

Non-limiting examples of other optional detergent adjuvants are: enzymes such as proteases; hydrotropes such as sodium toluene sulfonate, sodium cumene sulfonate and potassium xylene sulfonate; thickeners other than the hydrophilic polymers at a level of from about 0.01% to about 0.5%, preferably from about 0.01% to about 0.1%; corrosion inhibitors such as sodium metasilicate; and aesthetic-enhancing ingredients such as colorants, providing they do not adversely impact on filming/streaking. Other suitable corrosion inhibitors are described in co-pending U.S. Provisional Application Ser. No. 60/129,949 filed Apr. 14, 1999.

L. Other Embodiments of Cleaning Composition

In order to achieve visually acceptable cleaning results on traditional household surfaces such as ceramic tile, linoleum, vinyl flooring, wood, and laminates (such as Pergo® manufactured by Formica), especially in the no-rinse surface cleaning methods described herein, the preferred hard surface cleaning compositions herein contain relatively low levels of slowly volatile materials and/or non-volatile materials, not including the optional perfume materials described herein. Compositions with relatively high levels of slowly volatile materials tend leave visually unacceptable filming and/or streaking on the treated surface, especially in no-rinse surface cleaning methods. As used herein, the phrase "slowly volatile material" refers to a material that has a boiling point of greater than about 160° C. and is not a perfume material as described hereinbefore. Preferably, the present compositions comprise no greater than a total of about 0.5%, more preferably no greater than a total of about 0.425%, and still more preferably no greater than a total of about 0.35%, by weight of the composition, of slowly volatile plus non-volatile materials. Examples of non-volatile or slowly volatile materials, the amount of which is preferably limited in the present compositions, include, but are not limited to, non-volatile surfatants (such as alkyl ethoxylates), amine buffers with boiling points in excess of 160° C. (such as 2-amino-1-butanol), organic solvents with boiling points in excess of 160° C. (such as butoxypropanol), or mixtures thereof.

Other suitable hard surface cleaning compositions include those which are described in detail in copending U.S. patent applications by R. Masters et al., Ser. No. 60/045,858 (Case 6555P2), filed May 8, 1997; N. Policicchio et al., Ser. No. 60/086,447 (Case 6873P2), filed May 22, 1998; K. Willman et al., Ser. No. 60/085,837 (Case 7159P), filed May 18, 1998; K. Willman et al., Ser. No. 60/110,356 (Case 7367P), filed Dec. 1, 1998; all of which are hereby incorporated by reference herein.

M. Process for Making Hard Surface Cleaning Compositions

The hard surface cleaning compositions herein can be made by mixing together all ingredients. It has been found that for maximum perfume solubilization in compositions where the actives, such as surfactant, are present at low levels, a preferred order of addition is evident. This preferred process involves the making of a premix like the perfume compositions disclosed hereinbefore, that is then added to the "base" product. The premix comprises raw materials added in the following order: optional surfactant(s), if any, at about 25% activity or higher, then perfume, then optional polymer, then optional suds suppressor. In certain cases, it is advantageous to add optional solvent(s) and/or optional buffer, to the premix after the optional suds suppressor. Thorough mixing of the premix provides the best results. The premix is then added to the base, which contains water and the other components. The combined mixture (i.e., premix in the base) is then mixed to obtain a homogeneous solution.

If an organic solvent, such as ethanol, is being used in the solution, another preferred method is to first dissolve the perfume in the organic solvent then add this perfume/solvent premix directly to an aqueous solution already containing the surfactant and buffer.

Another preferred method to incorporate maximum perfume into the present compositions with limited surfactant, is to create a premix in which perfume is added to a cyclodextrin mixture in aqueous media. Alternatively, the perfume-cyclodextrin mixture can be pre-formed prior to the premix. This approach ensures maximum perfume incorporation into the composition, and can incorporate perfume in compositions with little or no surfactant.

In certain cases, perfume solubilization at a relatively high level cannot be achieved, even with the preferred processing methods. However, in applications such as, but not limited to, counter and floor cleaners, the entire heterogeneous composition can be added directly to the article of use. Examples wherein this method of use is desirable include pre-moistened wipes, dry absorbent substrates used in conjunction with solution.

In cases where the surfactant active level does not limit perfume solubility in the compositions, a single step making process can be followed. For example, an acceptable order of addition is to first incorporate water, any optional detergent surfactant and/or organic acid, followed by any optional hydrophobic cleaning solvent. Once the solvent is added, pH is adjusted to optimum as desired by the formulator. The optional polymer can then be added followed by any optional peroxide, perfume and/or dye.

III. Cleaning Pad and/or Sheets

In one aspect, the present invention relates to a cleaning pad, preferably disposable, for cleaning a hard surface, the cleaning pad comprising:

(a) at least one absorbent layer;

(b) optionally, a liquid pervious scrubbing layer; wherein the liquid pervious scrubbing layer is preferably an apertured formed film, more preferably a macroscopically expanded three-dimensional plastic web, having tapered or funnel-shaped apertures and/or surface aberrations and preferably comprising a hydrophobic material;

(c) optionally, an attachment layer, wherein the attachment layer preferably comprises a clear or translucent material, more preferably a clear or translucent polyethylene film, and wherein the attachment layer preferably comprises loop and/or hook material for attachment to a support head of a handle of a cleaning implement;

(d) optionally, multiple planar surfaces;

(e) optionally, at least one functional cuff, preferably at least one free-floating, looped functional cuff;

(f) optionally, a density gradient throughout at least one absorbent layer; wherein the density gradient preferably comprises a first absorbent layer having a density of from about 0.01 g/cm$^3$ to about 0.15 g/cm$^3$, preferably from about 0.03 g/cm$^3$ to about 0.1 g/cm$^3$, and more preferably from about 0.04 g/cm$^3$ to about 0.06 g/cm$^3$, and a second absorbent layer having a density of from about 0.04 g/cm$^3$ to about 0.2 g/cm$^3$, preferably from about 0.1 g/cm$^3$ to about 0.2 g/cm$^3$, and more preferably from about 0.12 g/cm$^3$ to about 0.17 g/cm$^3$; wherein the density of the first absorbent layer is about 0.04 g/cm$^3$, preferably about 0.07 g/cm$^3$, and more preferably about 0.1 g/cm$^3$, less than the density of the second absorbent layer;

(g) optionally, at least one adhesive scrubbing strip, preferably comprising a material selected from the group consisting of nylon, polyester, polypropylene, abrasive material, and mixtures thereof; and (h) optionally, perfume carrier complex, preferably selected from the group consisting of cyclodextrin inclusion complex, matrix perfume microcapsules, and mixtures thereof; wherein the perfume carrier complex is preferably located in an absorbent layer. Preferably, the cleaning pad comprises at least two absorbent layers, wherein the absorbent layers have multiple widths in the z-dimension. Preferably, the cleaning pad has a $t_{1200}$ absorbent capacity of at least about 5 grams/gram.

In another aspect, the present invention relates to a cleaning sheet, preferably disposable, for cleaning hard surfaces, the cleaning sheet comprising functional cuffs, preferably free-floating, double-layer loop functional cuffs.

During the effort to develop the present cleaning pads and sheets, Applicants discovered that, surprisingly, an important aspect of cleaning performance is related to the ability to provide a cleaning pad having apertured formed films, a liquid impervious attachment layer, and/or density gradients, and/or functional cuffs and a cleaning sheet having functional cuffs. In the context of a typical cleaning operation (i.e., where the cleaning pad and/or sheet is moved back and forth in a direction substantially parallel to the pad's or sheet's y-dimension or width), each of these structural elements provide the cleaning pads and/or sheets improved cleaning performance, both separately and in combination with one or more additional elements. Apertured formed films, preferably utilized in the scrubbing layer, are pervious to liquids and provide efficient transfer of liquid from the surface being cleaned to other layers of the cleaning pad, preferably one or more absorbent layers, while reducing the tendency for such liquid to be squeezed back onto the surface being cleaned. Functional cuffs are preferably free-floating so as to "flip" back and forth in the y-dimension during a typical cleaning operation, thus trapping particulate matter and reducing the tendency for such particulate matter to be redeposited on the surface being cleaned. Density gradients are preferably incorporated in the absorbent layer (s) of the cleaning pad to "pump" or "wick" liquid away from the surface being cleaned to areas in the cleaning pad furthest away from the surface being cleaned. The liquid impervious attachment layer provides a barrier which helps to better distribute the liquid in the x-y direction after liquid reaches the back of the pad which is firtheset away from cleaning surface. These aspects of the present invention, and the benefits provided, are discussed in detail with reference to the drawings.

The skilled artisan will recognize that various materials can be utilized to carry out the claimed invention. Thus, while preferred materials are described below for the various cleaning implement, pad, and sheet components, it is recognized that the scope of the invention is not limited to such descriptions.

A. Absorbent Layer

The absorbent layer serves to retain any fluid and soil absorbed by the cleaning pad during use. While the scrubbing layer has some affect on the pad's ability to absorb fluid, the absorbent layer plays the major role in achieving desired overall absorbency. Furthermore, the absorbent layer preferably comprises multiple layers which are designed to provide the cleaning pad with multiple planar surfaces and/or density gradients.

From a fluid absorbency perspective, the absorbent layer will be capable of removing fluid and soil from the scrubbing layer so that the scrubbing layer will have capacity to continually remove soil from the surface. The absorbent layer also should be capable of retaining absorbed material under typical in-use pressures to avoid "squeeze-out" of absorbed soil, cleaning solution, etc.

The absorbent layer will comprise any material(s) capable of absorbing and retaining fluid during use. To achieve desired total fluid capacities, it will be preferred to include in the absorbent layer a material having a relatively high capacity (in terms of grams of fluid per gram of absorbent material). As used herein, the term "superabsorbent material" means any absorbent material having a g/g capacity for water of at least about 15 g/g, when measured under a confining pressure of 0.3 psi. Because a majority of the cleaning fluids useful with the present invention are aqueous based, it is preferred that the superabsorbent materials have a relatively high g/g capacity for water or water-based fluids.

Representative superabsorbent materials include water insoluble, water-swellable superabsorbent gelling polymers (referred to herein as "superabsorbent gelling polymers") which are well known in the literature. These materials demonstrate very high absorbent capacities for water. The superabsorbent gelling polymers useful in the present invention can have a size, shape and/or morphology varying over a wide range. These polymers can be in the form of particles that do not have a large ratio of greatest dimension to smallest dimension (e.g., granules, flakes, pulverulents, interparticle aggregates, interparticle crosslinked aggregates, and the like) or they can be in the form of fibers, sheets, films, foams, laminates, and the like. The use of superabsorbent gelling polymers in fibrous form provides the benefit of enhanced retention, relative to particles, during the cleaning process. While their capacity is generally lower for aqueous-based mixtures than it is for water, these materials still demonstrate significant absorbent capacity for such mixtures. The patent literature is replete with disclosures of water-swellable materials. See, for example, U.S. Pat. No. 3,699,103 (Harper et al.), issued Jun. 13, 1972; U.S. Pat. No. 3,770,731 (Harmon), issued Jun. 20, 1972; U.S. Reissue Pat. No. 32,649 (Brandt et al.), reissued Apr. 19, 1989; U.S. Pat. No. 4,834,735 (Alemany et al.), issued May 30, 1989.

Superabsorbent gelling polymers useful in the present invention include a variety of water-insoluble, but water-swellable polymers capable of absorbing large quantities of fluids. Such polymeric materials are also commonly referred to as "hydrocolloids", and can include polysaccharides such as carboxymethyl starch, carboxymethyl cellulose, and hydroxypropyl cellulose; nonionic types such as polyvinyl alcohol, and polyvinyl ethers; cationic types such as polyvinyl pyridine, polyvinyl morpholinione, and N,N-dimethylaminoethyl or N,N-diethylaminopropyl acrylates and methacrylates, and the respective quaternary salts thereof. Typically, superabsorbent gelling polymers useful in the present invention have a multiplicity of anionic functional groups, such as sulfonic acid, and more typically carboxy, groups. Examples of polymers suitable for use herein include those which are prepared from polymerizable, unsaturated, acid-containing monomers. Thus, such monomers include the olefinically unsaturated acids and anhydrides that contain at least one carbon to carbon olefinic double bond. More specifically, these monomers can be selected from olefinically unsaturated carboxylic acids and acid anhydrides, olefinically unsaturated sulfonic acids, and mixtures thereof.

Some non-acid monomers can also be included, usually in minor amounts, in preparing the superabsorbent gelling polymers useful herein. Such non-acid monomers can include, for example, the water-soluble or water-dispersible esters of the acid-containing monomers, as well as monomers that contain no carboxylic or sulfonic acid groups at all. Optional non-acid monomers can thus include monomers containing the following types of functional groups: carboxylic acid or sulfonic acid esters, hydroxyl groups, amide-groups, amino groups, nitrile groups, quaternary ammonium salt groups, aryl groups (e.g., phenyl groups, such as those derived from styrene monomer). These non-acid monomers are well-known materials and are described in greater detail, for example, in U.S. Pat. No. 4,076,663 (Masuda et al), issued Feb. 28, 1978, and in U.S. Pat. No. 4,062,817 (Westerman), issued Dec. 13, 1977, both of which are incorporated by reference.

Olefinically unsaturated carboxylic acid and carboxylic acid anhydride monomers include the acrylic acids typified by acrylic acid itself, methacrylic acid, ethacrylic acid, α-chloroacrylic acid, a-cyanoacrylic acid, β-methylacrylic acid (crotonic acid), α-phenylacrylic acid, β-acryloxypropionic acid, sorbic acid, α-chlorosorbic acid, angelic acid, cinnamic acid, β-chlorocinnamic acid, β-sterylacrylic acid, itaconic acid, citroconic acid, mesaconic acid, glutaconic acid, aconitic acid, maleic acid, fumaric acid, tricarboxyethylene and maleic acid anhydride.

Olefinically unsaturated sulfonic acid monomers include aliphatic or aromatic vinyl sulfonic acids such as vinylsulfonic acid, allyl sulfonic acid, vinyl toluene sulfonic acid and styrene sulfonic acid; acrylic and methacrylic sulfonic acid such as sulfoethyl acrylate, sulfoethyl methacrylate, sulfopropyl acrylate, sulfopropyl methacrylate, 2-hydroxy-3-methacryloxypropyl sulfonic acid and 2-acrylamide-2-methylpropane sulfonic acid.

Preferred superabsorbent gelling polymers for use in the present invention contain carboxy groups. These polymers include hydrolyzed starch-acrylonitrile graft copolymers, partially neutralized hydrolyzed starch-acrylonitrile graft copolymers, starch-acrylic acid graft copolymers, partially neutralized starch-acrylic acid graft copolymers, saponified vinyl acetate-acrylic ester copolymers, hydrolyzed acrylonitrile or acrylamide copolymers, slightly network crosslinked polymers of any of the foregoing copolymers, partially neutralized polyacrylic acid, and slightly network crosslinked polymers of partially neutralized polyacrylic acid. These polymers can be used either solely or in the form of a mixture of two or more different polymers. Examples of these polymer materials are disclosed in U.S. Pat. No. 3,661,875, U.S. Pat. No. 4,076,663, U.S. Pat. No. 4,093,776, U.S. Pat. No. 4,666,983, and U.S. Pat. No. 4,734,478.

Most preferred polymer materials for use in making the superabsorbent gelling polymers are slightly network crosslinked polymers of partially neutralized polyacrylic acids and starch derivatives thereof. Most preferably, the hydrogel-forming absorbent polymers comprise from about 50 to about 95%, preferably about 75%, neutralized, slightly network crosslinked, polyacrylic acid (i.e. poly (sodium acrylate/acrylic acid)). Network crosslinking renders the polymer substantially water-insoluble and, in part, determines the absorptive capacity and extractable polymer content characteristics of the superabsorbent gelling polymers. Processes for network crosslinking these polymers and typical network crosslinking agents are described in greater detail in U.S. Pat. No. 4,076,663.

While the superabsorbent gelling polymers is preferably of one type (i.e., homogeneous), mixtures of polymers can also be used in the implements of the present invention. For example, mixtures of starch-acrylic acid graft copolymers and slightly network crosslinked polymers of partially neutralized polyacrylic acid can be used in the present invention.

While any of the superabsorbent gelling polymers described in the prior art can be useful in the present invention, it has recently been recognized that where significant levels (e.g., more than about 50% by weight of the absorbent structure) of superabsorbent gelling polymers are to be included in an absorbent structure, and in particular where one or more regions of the absorbent layer will comprise more than about 50%, by weight of the region, the problem of gel blocking by the swollen particles can impede fluid flow and thereby adversely affect the ability of the gelling polymers to absorb to their full capacity in the desired period of time. U.S. Pat. No. 5,147,343 (Kellenberger et al.), issued Sep. 15, 1992 and U.S. Pat. No. 5,149,335 (Kellenberger et al.), issued Sep. 22, 1992, describe superabsorbent gelling polymers in terms of their Absorbency Under Load (AUL), where gelling polymers absorb fluid (0.9% saline) under a confining pressure of 0.3 psi. (The disclosure of each of these patents is incorporated herein.) The methods for determining AUL are described in these patents. Polymers described therein can be particularly useful in embodiments of the present invention that contain regions of relatively high levels of superabsorbent gelling polymers. In particular, where high concentrations of superabsorbent gelling polymer are incorporated in the cleaning pad, those polymers will preferably have an AUL, measured according to the methods described in U.S. Pat. No. 5,147,343, of at least about 24 ml/g, more preferably at least about 27 ml/g after 1 hour; or an AUL, measured according to the methods described in U.S. Pat. No. 5,149,335, of at least about 15 ml/g, more preferably at least about 18 ml/g after 15 minutes.

U.S. Pat. No. 5,599,335 (Goldman et al.), issued Feb. 11, 1997, and U.S. Pat. No. 5,562,646 (Goldman et al.), issued Oct. 8, 1996 (both of which are incorporated by reference herein), also address the problem of gel blocking and describe superabsorbent gelling polymers useful in overcoming this phenomena. These applications specifically describe superabsorbent gelling polymers which avoid gel blocking at even higher confining pressures, specifically 0.7 psi. In the embodiments of the present invention where the absorbent layer will contain regions comprising high levels (e.g., more than about 50% by weight of the region) of superabsorbent gelling polymer, it can be preferred that the superabsorbent gelling polymer be as described in the aforementioned patents to Goldman et al.

Other superbsorbent materials useful herein include hydrophilic polymeric foams, such as those described in commonly assigned U.S. Pat. No. 5,650,222 (DesMarais et al.), issued Jul. 22, 1997; U.S. Pat. No. 5,387,207 (Dyer et al.), issued Feb. 7, 1995; U.S. Pat. No. No. 5,563,179 (DesMarais et al.), issued Oct. 8, 1996; U.S. Pat. No. 5,550,167 (DesMarais), issued Aug. 27, 1996; and U.S. Pat. No. 5,260,345 (DesMarais et al.), issued Nov. 9, 1993; each of which is incorporated by reference herein. These references describe polymeric, hydrophilic absorbent foams that are obtained by polymerizing a high internal phase water-in-oil emulsion (commonly referred to as HIPEs). These foams are readily tailored to provide varying physical properties (pore size, capillary suction, density, etc.) that affect fluid handling ability. As such, these materials are particularly useful, either alone or in combination with other such foams or with fibrous structures, in providing the overall capacity required by the present invention.

Where superabsorbent material is included in the absorbent layer, the absorbent layer will preferably comprise at least about 15%, by weight of the absorbent layer, more preferably at least about 20%, still more preferably at least about 25%, of the superabsorbent material.

The absorbent layer can also consist of, or comprise, fibrous material. Fibers useful in the present invention include those that are naturally occurring (modified or unmodified), as well as synthetically made fibers. Examples of suitable unmodified/modified naturally occurring fibers include cotton, Esparto grass, bagasse, kemp, flax, silk, wool, wood pulp, chemically modified wood pulp, jute, ethyl cellulose, and cellulose acetate. Suitable synthetic fibers can be made from polyvinyl chloride, polyvinyl fluoride, polytetrafluoroethylene, polyvinylidene chloride, polyacrylics such as ORLON®, polyvinyl acetate, Rayon®, polyethylvinyl acetate, non-soluble or soluble polyvinyl alcohol, polyolefins such as polyethylene (e.g., PULPEX®) and polypropylene, polyamides such as nylon, polyesters such as DACRON® or KODEL®, polyurethanes, polystyrenes, and the like. The absorbent layer can comprise solely naturally occurring fibers, solely synthetic fibers, or any compatible combination of naturally occurring and synthetic fibers.

The fibers useful herein can be hydrophilic, hydrophobic or can be a combination of both hydrophilic and hydrophobic fibers. As indicated above, the particular selection of hydrophilic or hydrophobic fibers will depend upon the other materials included in the absorbent (and to some degree the scrubbing) layer. That is, the nature of the fibers will be such that the cleaning pad exhibits the necessary fluid delay and overall fluid absorbency. Suitable hydrophilic fibers for use in the present invention include cellulosic fibers, modified cellulosic fibers, rayon, polyester fibers such as hydrophilic nylon (HYDROFIL®). Suitable hydrophilic fibers can also be obtained by hydrophilizing hydrophobic fibers, such as surfactant-treated or silica-treated thermoplastic fibers derived from, for example, polyolefins such as polyethylene or polypropylene, polyacrylics, polyamides, polystyrenes, polyurethanes and the like.

Suitable wood pulp fibers can be obtained from well-known chemical processes such as the Kraft and sulfite processes. It is especially preferred to derive these wood pulp fibers from southern soft woods due to their premium absorbency characteristics. These wood pulp fibers can also be obtained from mechanical processes, such as ground wood, refiner mechanical, thermomechanical, chemimechanical, and chemi-thermomechanical pulp processes. Recycled or secondary wood pulp fibers, as well as bleached and unbleached wood pulp fibers, can be used.

Another type of hydrophilic fiber for use in the present invention is chemically stiffened cellulosic fibers. As used herein, the term "chemically stiffened cellulosic fibers" means cellulosic fibers that have been stiffened by chemical means to increase the stiffness of the fibers under both dry and aqueous conditions. Such means can include the addition of a chemical stiffening agent that, for example, coats and/or impregnates the fibers. Such means can also include the stiffening of the fibers by altering the chemical structure, e.g., by crosslinking polymer chains.

Where fibers are used as the absorbent layer (or a constituent component thereof), the fibers can optionally be combined with a thermoplastic material. Upon melting, at least a portion of this thermoplastic material migrates to the intersections of the fibers, typically due to interfiber capillary gradients. These intersections become bond sites for the thermoplastic material. When cooled, the thermoplastic materials at these intersections solidify to form the bond sites that hold the matrix or web of fibers together in each of the respective layers. This can be beneficial in providing additional overall integrity to the cleaning pad.

Amongst its various effects, bonding at the fiber intersections increases the overall compressive modulus and strength of the resulting thermally bonded member. In the case of the chemically stiffened cellulosic fibers, the melting and migration of the thermoplastic material also has the effect of increasing the average pore size of the resultant web, while maintaining the density and basis weight of the web as originally formed. This can improve the fluid acquisition properties of the thermally bonded web upon initial exposure to fluid, due to improved fluid permeability, and upon subsequent exposure, due to the combined ability of the stiffened fibers to retain their stiffness upon wetting and the ability of the thermoplastic material to remain bonded at the fiber intersections upon wetting and upon wet compression. In net, thermally bonded webs of stiffened fibers retain their original overall volume, but with the volumetric regions previously occupied by the thermoplastic material becoming open to thus increase the average interfiber capillary pore size.

Thermoplastic materials useful in the present invention can be in any of a variety of forms including particulates, fibers, or combinations of particulates and fibers. Thermoplastic fibers are a particularly preferred form because of their ability to form numerous interfiber bond sites. Suitable thermoplastic materials can be made from any thermoplastic polymer that can be melted at temperatures that will not extensively damage the fibers that comprise the primary web or matrix of each layer. Preferably, the melting point of this thermoplastic material will be less than about 190° C., and preferably between about 75° C. and about 175° C. In any event, the melting point of this thermoplastic material should be no lower than the temperature at which the thermally bonded absorbent structures, when used in the cleaning pads, are likely to be stored. The melting point of the thermoplastic material is typically no lower than about 50° C.

The thermoplastic materials, and in particular the thermoplastic fibers, can be made from a variety of thermoplastic polymers, including polyolefins such as polyethylene (e.g., PULPEX®) and polypropylene, polyesters, copolyesters, polyvinyl acetate, polyethylvinyl acetate, polyvinyl chloride, polyvinylidene chloride, polyacrylics, polyamides, copolyamides, polystyrenes, polyurethanes and copolymers of any of the foregoing such as vinyl chloride/vinyl acetate, and the like. Depending upon the desired characteristics for the resulting thermally bonded absorbent member, suitable thermoplastic materials include hydrophobic fibers that have been made hydrophilic, such as surfactant-treated or silica-treated thermoplastic fibers derived from, for example, polyolefins such as polyethylene or polypropylene, polyacrylics, polyamides, polystyrenes, polyurethanes and the like. The surface of the hydrophobic thermoplastic fiber can be rendered hydrophilic by treatment with a surfactant, such as a nonionic or anionic surfactant, e.g., by spraying the fiber with a surfactant, by dipping the fiber into a surfactant or by including the surfactant as part of the polymer melt in producing the thermoplastic fiber. Upon melting and resolidification, the surfactant will tend to remain at the surfaces of the thermoplastic fiber. Suitable surfactants include nonionic surfactants such as Brij® 76 manufactured by ICI Americas, Inc. of Wilmington, Del., and various surfactants sold under the Pegosperse® trademark by Glyco Chemical, Inc. of Greenwich, Conn. Besides nonionic surfactants, anionic surfactants can also be used. These surfactants can be applied to the thermoplastic fibers at levels of, for example, from about 0.2 to about 1 g. per sq. of centimeter of thermoplastic fiber.

Suitable thermoplastic fibers can be made from a single polymer (monocomponent fibers), or can be made from more than one polymer (e.g., bicomponent fibers). As used herein, "bicomponent fibers" refers to thermoplastic fibers that comprise a core fiber made from one polymer that is encased within a thermoplastic sheath made from a different polymer. The polymer comprising the sheath often melts at a different, typically lower, temperature than the polymer comprising the core. As a result, these bicomponent fibers provide thermal bonding due to melting of the sheath polymer, while retaining the desirable strength characteristics of the core polymer.

Suitable bicomponent fibers for use in the present invention can include sheath/core fibers having the following polymer combinations: polyethylene/polypropylene, polyethylvinyl acetate/polypropylene, polyethylene/polyester, polypropylene/polyester, copolyester/polyester, and the like. Particularly suitable bicomponent thermoplastic fibers for use herein are those having a polypropylene or polyester core, and a lower melting copolyester, polyethylvinyl acetate or polyethylene sheath (e.g., those available from Danaklon a/s and Chisso Corp.). These bicomponent fibers can be concentric or eccentric. As used herein, the terms "concentric" and "eccentric" refer to whether the sheath has a thickness that is even, or uneven, through the cross-sectional area of the bicomponent fiber. Eccentric bicomponent fibers can be desirable in providing more compressive strength at lower fiber thicknesses. Preferred bicomponent fibers comprise a copolyolefin bicomponent fiber comprising a less than about 81% polyethylene terphthalate core and a less than about 51% copolyolefin sheath. Such a preferred bicomponent fiber is commercially available from the Hoechst Celanese Corporation, in New Jersey, under the tradename CELBOND® T-255. As discussed below, the amount of bicomponent fibers will preferably vary according to the density of the material in which it is used.

Methods for preparing thermally bonded fibrous materials are described in U.S. Pat. No. 5,607,414 (Richards et al.), issued Mar. 4, 1997; and U.S. Pat. No. 5,549,589 (Homey et al.), issued Aug. 27, 1996 (see especially Columns 9 to 10). The disclosure of both of these references are incorporated by reference herein.

The absorbent layer can also comprise a HIPE-derived hydrophilic, polymeric foam that does not have the high absorbency of those described above as "superabsorbent materials". Such foams and methods for their preparation are described in U.S. Pat. No. 5,550,167 (DesMarais), issued Aug. 27, 1996; and U.S. Pat. No. 5,563,179 (Stone et al.), issued Oct. 8, 1996 (both of which are incorporated by reference herein).

The absorbent layer of the cleaning pad can be comprised of a homogeneous material, such as a blend of cellulosic fibers (optionally thermally bonded) and swellable superabsorbent gelling polymer. Alternatively, the absorbent layer can be comprised of discrete layers of material, such as a layer of thermally bonded airlaid material and a discrete layer of a superabsorbent material. For example, a thermally bonded layer of cellulosic fibers can be located lower than (i.e., beneath) the superabsorbent material (i.e., between the superabsorbent material and the scrubbing layer). In order to achieve high absorptive capacity and retention of fluids under pressure, while at the same time providing initial delay in fluid uptake, it can be preferable to utilize such discrete layers when forming the absorbent layer. In this regard, the superabsorbent material can be located remote from the scrubbing layer by including a less absorbent layer as the lower-most aspect of the absorbent layer. For example, a layer of cellulosic fibers can be located lower (i.e., beneath) than the superabsorbent material (i.e., between the superabsorbent material and the scrubbing layer).

In a preferred embodiment, the absorbent layer will comprise a thermally bonded airlaid web of cellulose fibers (Flint River, available from Weyerhaeuser, Wash.) and AL Thermal C (thermoplastic available from Danaklon a/s, Varde, Denmark), and a swellable hydrogel-forming superabsorbent polymer. The superabsorbent polymer is preferably incorporated such that a discrete layer is located near the surface of the absorbent layer which is remote from the scrubbing layer. Preferably, a thin layer of, e.g., cellulose fibers (optionally thermally bonded) are positioned above the superabsorbent gelling polymer to enhance containment.

B. Optional Liquid Pervious Scrubbing Layer

The scrubbing layer is the portion of the cleaning pad that contacts the soiled surface during cleaning. As such, materials useful as the scrubbing layer must be sufficiently durable that the layer will retain its integrity during the cleaning process. In addition, when the cleaning pad is used in combination with a solution, the scrubbing layer must be liquid pervious, at least in part, to be capable of transitioning liquids and soils to the absorbent layer. Whether the implement is used with a cleaning solution (i.e., in the wet state) or without cleaning solution (i.e., in the dry state), the scrubbing layer will, in addition to removing particulate matter, facilitate other functions, such as polishing, dusting, and buffing the surface being cleaned.

The scrubbing layer can be a monolayer, or a multi-layer structure one or more of whose layers can be slitted to facilitate the scrubbing of the soiled surface and the uptake of particulate matter. This scrubbing layer, as it passes over the soiled surface, interacts with the soil (and cleaning solution when used), loosening and emulsifying tough soils and permitting them to pass freely into the absorbent layer of the pad. The scrubbing layer preferably contains openings (e.g., slits, tapered capillaries or apertures) that provide an easy avenue for larger particulate matter to move freely in and become entrapped within the absorbent layer of the pad. Low density structures are preferred for use as the scrubbing layer, to further facilitate transport of particulate matter to the pad's absorbent layer.

In order to provide desired integrity, materials particularly suitable for the scrubbing layer include a wide range of materials such as woven and nonwoven materials; polymeric materials such as apertured formed thermoplastic films, apertured plastic films, and hydroformed thermoplastic films; porous foams; reticulated foams; reticulated thermoplastic films; and thermoplastic scrims. Suitable woven and nonwoven materials can comprise natural fibers (e.g., wood or cotton fibers), synthetic fibers such as polyolefins (e.g., polyethylene and polypropylene), polyesters, polyamides, and synthetic cellulosics (e.g., RAYON®), or from a combination of natural and synthetic fibers. Such synthetic fibers can be manufactured using known processes such as carded, spunbond, meltblown, airlaid, needle punched and the like. In a preferred aspect of the present invention, the cleaning pad comprises a liquid pervious scrubbing layer which comprises, at least in part, an apertured formed film. Apertured formed films are preferred for the liquid pervious scrubbing layer because they are pervious to aqueous cleaning liquids containing soils, including dissolved and undissolved particulate matter, yet are non-absorbent and have a reduced tendency to allow liquids to pass back through and rewet the surface being cleaned. Thus, the surface of the formed film which is in contact with the surface being cleaned remains dry, thereby reducing filming and streaking of the surface being cleaned and permitting the surface to be wiped substantially dry. Applicants have surprisingly found that an apertured formed film having tapered or funnel-shaped apertures, meaning that the diameter at the lower end of the aperture is greater than the diameter at the upper end of the aperature, actually exhibits a suctioning effect as the cleaning pad is moved across the surface being cleaned. This aids in moving liquid from the surface being cleaned to other layers of the cleaning pad, such as the absorbent layer(s). In addition, tapered or funnel-shaped apertures have an even greater tendency to prevent liquids from passing back through the scrubbing layer to the surface being cleaned once they have been transferred to other layers, such as the absorbent layer(s). Apertured formed films having tapered or funnel-shaped apertures are thus preferred. Suitable apertured formed films are described in U.S. Pat. No. 3,929,135, entitled "Absorptive Structures Having Tapered Capillaries", which issued to Thompson on Dec. 30, 1975; U.S. Pat. No. 4,324,246 entitled "Disposable Absorbent Article Having A Stain Resistant Topsheet", which issued to Mullane et al. on Apr. 13, 1982; U.S. Pat. No. 4,342,314 entitled "Resilient Plastic Web Exhibiting Fiber-Like Properties", which issued to Radel et al. on Aug. 3, 1982; U.S. Pat. No. 4,463,045 entitled "Macroscopically Expanded Three-Dimensional Plastic Web Exhibiting Non-Glossy Visible Surface and Cloth-Like Tactile Impression", which issued to Ahr et al. on Jul. 31, 1984; and U.S. Pat. No. 5,006,394 entitled "Multilayer Polymeric Film" issued to Baird on Apr. 9, 1991. Each of these patents are incorporated herein by reference. The preferred liquid pervious scrubbing layer for the present invention is the apertured formed film described in one or more of the above patents and marketed on sanitary napkins by The Procter & Gamble Company of Cincinnati, Ohio as DRI-WEAVE®.

Although a hydrophillic apertured formed film can be used as a liquid pervious scrubbing layer of a cleaning pad, in the context of hard surface cleaning, a hydrophobic apertured formed film is preferred since it will have a reduced tendency to allow liquids to pass back through the scrubbing layer and onto the surface being cleaned. This results in improved cleaning performance in terms of filming and streaking, lower soil residue, and faster drying time of the surface being cleaned, all of which are very important aspects of hard surface cleaning. The liquid pervious scrubbing layer of the present cleaning pad is thus preferably a hydrophobic apertured formed film, at least in part. It is also recognized that the scrubbing layer can be comprised of more than one type of material.

In a preferred embodiment, the liquid pervious scrubbing layer is a macroscopically expanded three-dimensional plastic web, preferably having protuberances, or surface aberrations, on the lower surface of the scrubbing layer which contact the hard surface being cleaned. Surface aberrations are created on such a web by photoetching techniques well known in the art. A detailed description of such a web and a process for making it is disclosed by Ahr et al., U.S. Pat. No. 4,463,045, issued Jul. 31, 1984 and assigned to The Procter & Gamble Company, which is hereby incorporated by reference. Ahr et al. disclose a macroscopically expanded three-dimensional web having surface aberrations for use as a topsheet in diapers, sanitary napkins, incontinence devices, and the like. Ahr et al. prefer a web having surface aberrations because it imparts a non-glossy appearance to the web and improves the tactile impression of the web by making it feel more cloth-like to the wearer of the diaper, sanitary napkin, etc. However, in the context of hard surface cleaning, appearance and tactile impression of a cleaning pad are of lesser importance. Applicants have found that a liquid pervious scrubbing layer comprising a macroscopically expanded three-dimensional web having surface aberrations results in improved performance of the scrubbing layer. The surface aberrations provide a more abrasive surface which correlates to better cleaning performance. The surface aberrations, in combination with tapered or funnel-shaped apertures, provide enhanced cleaning, absorbency, and rewet characteristics of the cleaning pad. The liquid pervious scrubbing layer thus preferably comprises an apertured formed film comprising a macroscopically expanded three-dimensional plastic web having tapered or funnel-shaped apertures and/or surface aberrations. A three-dimensional scrubbing layer is especially preferable for improving a cleaning pad's ability to pick-up particulate matter.

Figure 4A:
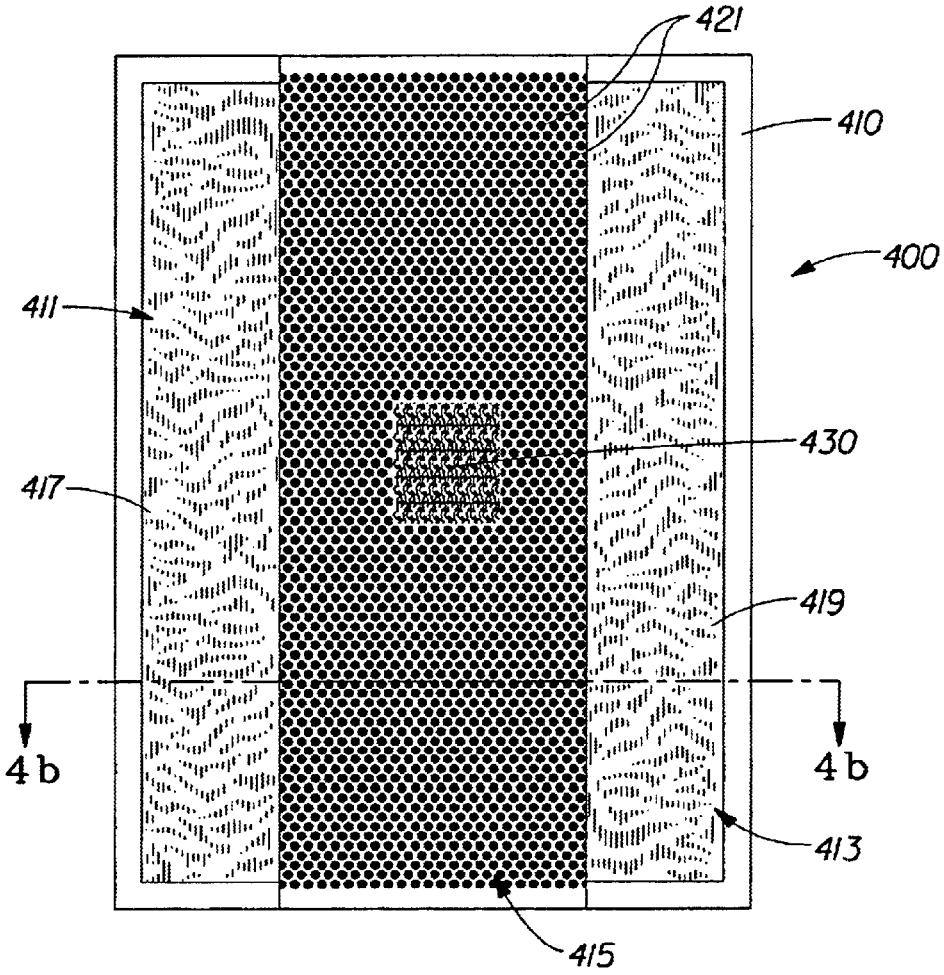
FIG. 4*a* is a plan view of a preferred cleaning pad of the present invention.

FIG. 4*a* depicts a cleaning pad 400 comprising a liquid pervious scrubbing layer 415 which comprises an apertured formed film having apertures 421 that are preferably tapered or funnel-shaped. The apertured formed film can comprise the entire scrubbing layer, or can be used in combination with other materials according to the present invention.

The scrubbing layer can also comprise, at least on a portion of the pad's lower surface, a material that provides significant texture to the pad. For example, a preferred means for providing such texture is to form a multilayer composite comprising a scrim material (e.g., polypropylene) and a spunlaced material (e.g., polyester). The composite is heat pressed to partially melt the scrim material, which results in bonding of the discrete layers. Exposure to heat also causes the scrim material to shrink, thereby providing a multilayer composite having wrinkles or puckers.

As discussed in detail below, the cleaning pad can comprise a distinct layer that serves as an attachment layer to the cleaning implement. However, in certain embodiments, the cleaning pad can be designed such that the scrubbing layer also functions to attach the pad to the implement. For example, the scrubbing layer can be larger than the absorbent layer in length, width or both, such that it can be directly attached to the implement. This can eliminate the need for a separate attachment layer.

C. Optional Attachment Layer

The cleaning pads and/or sheets of the present invention will optionally, but preferably, have an attachment layer that allows the pad and/or sheet to be connected to the implement's handle or the support head in preferred implements. The attachment layer can be necessary in those embodiments where the absorbent layer is not suitable for attaching the pad to the support head of the handle. The attachment layer can also function as a means to prevent fluid flow through the top surface (i.e., the handle-contacting surface) of the cleaning pad, and can further provide enhanced integrity of the pad. As with the scrubbing and absorbent layers, the attachment layer can consist of a mono-layer or a multi-layer structure, so long as it meets the above requirements.

In a preferred embodiment of the present invention, the attachment layer will comprise a surface which is capable of being mechanically attached to the handle's support head by use of known hook and loop technology. In such an embodiment, the attachment layer will comprise at least one surface which is mechanically attachable to hooks that are permanently affixed to the bottom surface of the handle's support head.

Preferably, the attachment layer comprises a clear or translucent material, especially in cleaning pads comprising a scrubbing layer and density gradient, wherein the scrubbing layer comprises an apertured formed film. A cleaning pad comprising an apertured formed film scrubbing layer and a density gradient effectively transports soil away from the surface being cleaned to areas in the cleaning pad further away from the surface being cleaned. As a result, the lower layers of the cleaning pad actually appear relatively clean and thus consumers might be unaware that a cleaning pad requires changing or disposal, or consumers might assume that the cleaning pad is not working properly. The attachment layer preferably comprises a clear or translucent film, such as polyethylene, polypropylene, polyester, and similar films, more preferably a polyethylene film, to allow the visualization of soil being absorbed in the absorbent layer (s), especially in the upper-most absorbent layer. A consumer, by observing the amount of soil present in the absorbent layer, will be signaled to dispose of the cleaning pad or, in terms of a cleaning implement, remove and dispose of the currently soiled cleaning pad from the handle and apply a new cleaning pad to the handle. A clear or translucent polyethylene film is also preferred because it is typically impervious to liquid so as to reduce the possibility that liquid will bleed through the attachment layer and to improve the lateral (x-y plane) distribution of the liquid throughout the upper-most absorbent layer, as well as helping to keep the implement head clean and dry.

Since a clear or translucent polyethylene film is typically not compatible with traditional hook and loop technology, loop and/or hook material will preferably be attached to the clear or translucent polyethylene film. The loop and/or hook material can be applied to the clear or translucent polyethylene film in a variety of ways, such as in narrow strips or other types of patterns. The loop and/or hook material should be applied to the polyethylene sheet in a manner as to permit the observation of soil in the absorbent layer through the clear polyethylene sheet. Alternatively, or in addition to the loop or hook material, the attachment layer can comprise an adhesive tape, preferably two-sided (e.g., 1524 Transfer Adhesive Two-Sided Tape available from 3M Corp.), or a high tack adhesive (e.g., HL1620BZP available from Fuller Co.) that has sufficient wet strength in order to secure the cleaning pad to a handle. The attachment layer can also comprise hook or loop material laminated onto a clear or translucent backing material (e.g., XML-1657 available from 3M Corp.).

Another way to achieve the desired fluid imperviousness and attachability, a laminated structure comprising, e.g., a meltblown film and fibrous, nonwoven structure can be utilized. In another embodiment of the present invention, the attachment layer is a tri-layered material having a layer of meltblown polypropylene film located between two layers of spun-bonded polypropylene.

In an alternative embodiment, the attachment layer can have a y-dimension (width) that is greater than the y-dimension of the other cleaning pad elements such that the attachment layer can then engage attachment structures located on a mop head of a handle of a cleaning implement, such as that described hereinafter in Section V.A., and shown in FIG. 8A. This way the cleaning pad can be secured to a mop head for cleaning hard surfaces.

D. Optional Multiple Planar Surfaces

While the ability of the cleaning pad to absorb and retain fluids has been determined to be important to hard surface cleaning performance (see, e.g., copending U.S. patent application Ser. No. 08/756,507 (Holt et al.), copending U.S. patent application Ser. No. 08/756,864 (Sherry et al.), and copending U.S. patent application Ser. No. 08/756,999 (Holt et al.), all filed Nov. 26, 1996 and incorporated by reference herein), the overall structure of the cleaning pad is important to cleaning performance, as discussed in copending U.S. patent application Ser. No. 09/037,379, filed by N. J. Policicchio et al. on Mar. 10, 1998, which is hereby incorporated by reference. In particular, pads having an essentially flat floor contacting surface (i.e., essentially one planar surface for contacting the soiled surface during cleaning), cleaning performance is not maximized because removed soil tends to accumulate around the periphery of the pad, particularly at the pad's front and rear edges. Thus, there is significant pad surface area that does not come in intimate contact with the floor during cleaning. An important aspect of cleaning performance is related to the ability to provide a cleaning pad having multiple cleaning surfaces or edges, each of which contact the soiled surface during the cleaning operation. In the context of a cleaning implement such as a mop, these surfaces or edges are provided such that during the typical cleaning operation (i.e., where the implement is moved back and forth in a direction substantially parallel to the pad's y-dimension or width), each of the surfaces or edges contact the surface being cleaned as a result of "rocking" of the cleaning pad. The effect of multiple edges is achieved by constructing the pad such that it has multiple widths through its z-dimension. That is, these multiple widths form a plurality of surfaces or edges along the front and back of the pad. This preferred aspect of the invention, and the benefits provided, are discussed in detail with reference to the drawings.

The present pads, which provide multiple surfaces or edges during cleaning address this issue, and provide enhanced performance. Referring to FIG. 1 in the drawings, cleaning pad 100 is depicted as having an upper surface 103 that allows the pad to be releasably attached to a handle. Cleaning pad 100 also has a lower surface depicted generally as 110 which contacts the floor or other hard surface during cleaning. In this embodiment, lower surface 110 actually consists of 3 substantially planar surfaces 112, 114 and 116. These distinct surfaces are created by decreasing the width of cleaning pad 100 in the pad's z-dimension. As depicted, the planes corresponding to surfaces 112 and 116 intersect the plane corresponding to surface 114. Thus, when an implement to which pad 100 is attached is moved from rest in the direction indicated by $Y_f$, friction causes pad 100 to "rock" such that lower surface 112 contacts the surface being cleaned. As the movement in the $Y_f$ direction diminishes, lower surface 114 will then contact the surface being cleaned. As the implement and pad are moved from rest in the direction indicated by $Y_b$, friction causes pad 100 to rock such that lower surface 116 then contacts the surface being cleaned. As this cleaning motion is repeated, the portion of the pad contacting the soiled surface is constantly changing. Thus, relative to an essentially flat cleaning pad, more surface area of the pad contacts the floor or other hard surface during use.

Figure 4B:
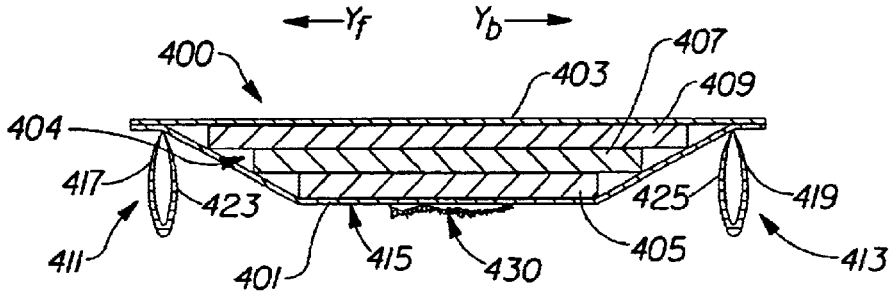
FIG. 4*b* is a cross sectional view of the cleaning pad shown in FIG. 4*a*.

While the pad depicted in FIG. 1 is shown to have a continuous decrease in width moving from the top to the bottom of the pad, it can be preferred to provide layer widths that change discontinuously. For example, as is depicted in FIG. 4*b*, the absorbent layer is comprised of three distinct layers, which become smaller in width moving in the direction of the scrubbing layer. (That is, the layers of the absorbent layer become narrower, discontinuously, when moving down in the direction of the scrubbing layer.) Furthermore, the discontinuity of these decreasing widths provide multiple edges in the form of the front and rear aspects of layers 405, 407 and 409. This multiplicity of edges is believed to provide still better particulate pick up. Of course, the effect of multiple discrete edges can be accomplished using more or fewer discrete layers in the absorbent layer. The effect can alternatively be accomplished by, e.g., using a moldable material as the absorbent layer (i.e., only one absorbent layer would be a monolayer), by using an implement whose topography is transferred to the pad, etc.

It will be recognized that while the discussion above relates primarily to cleaning pads having two or three layers that decrease in width to provide the desired decrease in overall pad width in the z-dimension, it can be preferred to use more than three discrete layers, particularly when the individual layers are relatively thin. Of course, as discussed above, in certain embodiments there will be only one discrete layer, such as where a material is molded to provide the desired decreasing width.

It will be also be recognized that while the above discussion relates to the absorbent layer or the. implement as providing the requisite decrease in width in the z-dimension, the desired effect can be accomplished by using an absorbent layer of uniform width, but using a scrubbing layer or other material having a narrower width than the absorbent layer.

E. Optional Functional Cuffs

An important feature of the preferred cleaning pads and/or sheets of the present invention is the inclusion of one or more "free-floating" functional cuffs. Applicants have surprisingly discovered that functional cuff(s) improve the cleaning performance of traditional cleaning pads and sheets, as well as the cleaning pads and sheets of the present invention. Functional cuffs provide improved particulate pick-up for traditional cleaning pads and sheets, as well as the cleaning pads and sheets of the present invention. As a cleaning pad and/or sheet comprising functional cuff(s) is wiped back and forth across a hard surface, the functional cuff(s) "flip" from side to side, thus picking-up and trapping particulate matter. Cleaning pads and sheets having functional cuff(s) exhibit improved pick-up and entrapment of particulate matter, which are typically found on a hard surfaces, and have a reduced tendency to redeposit such particulate matter on the surface being cleaned.

Functional cuffs can comprise a variety of materials, including, but not limited to, carded polypropylene, rayon or polyester, hydroentangled polyester, spun-bonded polypropylene, polyester, polyethlene, or cotton, polypropylene, or blends thereof. Where free-floating functional cuffs are utilized, the material used for the functional cuffs should be sufficiently rigid to allow the cuffs to "flip" from side to side, without collapsing or rolling-over on itself. Rigidity of the functional cuffs can be improved by using high basis weight materials (e.g., materials having a basis weight of greater than about 30 $g/m^2$) or by adding other materials to enhance rigidity such as scrim, adhesives, elastomers, elastics, foams, sponges, scrubbing layers, and the like, or by laminating materials together. Preferably, the functional cuffs comprise a hydroentangled substrate including, but not limited to, polyester, cotton, polypropylene, and mixtures thereof, having a basis weight of at least about 20 $g/m^2$ and a scrim material for stiffening.

Figure 2:
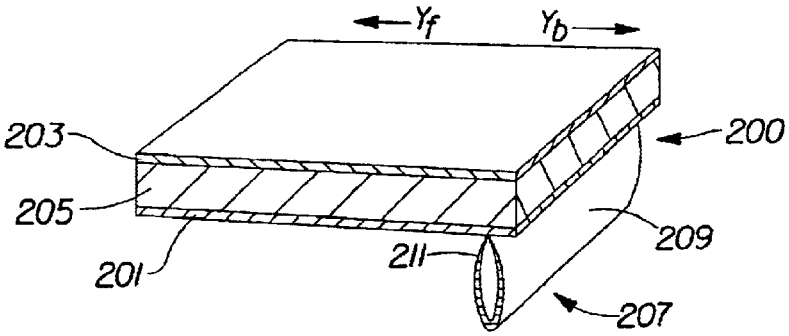
FIG. 2 is a perspective view of a cleaning pad of the present invention.

The functional cuffs can be in the form of a mono-layer or a multiple-layer laminate structure, and in the form of a loop or a non-loop structure. Preferably, the functional cuffs comprise a loop, as shown in FIGS. 2, 4*a*, and 4*b* of the drawings. A looped functional cuff can be constructed by folding a strip of cuff material in half to form a loop and attaching it to the substrate. Non-loop functional cuffs can also be used, particularly if the material used has sufficient rigidity. The cleaning pads and sheets of the present invention can also comprise a combination of loop and/or non-loop, mono-layer and/or multiple-layer functional cuffs. In addition, the functional cuffs can comprise an absorbent layer, as described below.

Functional cuffs can be formed as an integral part of the lower layer of the present cleaning pad or the substrate of the present cleaning sheet, or separately adhered to the cleaning pad and/or sheet. If the functional cuffs are an integral part of the lower layer of the cleaning pad and/or sheet, the functional cuffs are preferably a looped functional cuff formed by crimping the cleaning pad lower layer or cleaning sheet substrate, for example, in a Z-fold and/or C-fold. Alternatively, the functional cuffs can be separately adhered to the lower layer of a cleaning pad and/or cleaning sheet via a variety of methods known in the art including, but not limited to, double-sided adhesive tape, heat bonding, gluing, ultrasonic welding, stitching, high-pressure mechanical welding, and the like.

Functional cuff(s) can be incorporated in traditional cleaning pads and sheets that are well-known in the art which comprise a variety of cellulosic and nonwoven material, such as sponges, foam, paper towels, polishing cloths, dusting cloths, cotton towels, and the like, both in a dry and pre-moistened form. In a preferred embodiment, functional cuffs are particularly effective when incorporated in the cleaning pads of the present invention, as well as those described in co-pending U.S. patent application Ser. No. 08/756,507 (Holt et al.), copending U.S. patent application Ser. No. 08/756,864 (Sherry et al.), and copending U.S. patent application Ser. No. 08/756,999 (Holt et al.), all filed Nov. 26, 1996; and copending U.S. patent application Ser. No. 09/037,379 (Policicchio et al.), filed Mar. 10, 1998; all of which are hereby incorporated by reference.

In another preferred embodiment, a cleaning sheet comprises one or more functional cuffs and a substrate, preferably a nonwoven substrate comprising a hydroentangled material, including, but not limited to, the substrates described in copending applications by Fereshtehkhou et al., U.S. Ser. No. 09/082,349, filed May 20, 1998 (Case 6664M); Fereshtehkhou et al., U.S. Ser. No. 09/082,396, filed May 20, 1998 (Case 6798M); the disclosure of which is hereby incorporated by reference; and U.S. Pat. No. 5,525,397, issued Jun. 11, 1996 to Shizuno et al. In this preferred embodiment, the substrate of the cleaning sheet has at least two regions, where the regions are distinguished by basis weight. The substrate can have one or more high basis weight regions having a basis weight of from about 30 to about 120 g/m$^2$, preferably from about 40 to about 100 g/m$^2$, more preferably from about 50 to about 90 g/m$^2$, and still more preferably from about 60 to about 80 g/m$^2$, and one or more low basis weight regions, wherein the low basis weight region(s) have a basis weight that is not more than about 80%, preferably not more than about 60%, more preferably not more than about 40%, and still more preferably not more than about 20%, of the basis weight of the high basis weight region(s). The substrate of the cleaning sheet will preferably have an aggregate basis weight of from about 20 to about 110 g/m$^2$, more preferably from about 40 to about 100 g/m$^2$, and still more preferably from about 60 to about 90 g/m$^2$.

One or more functional cuff(s) can be applied to, or formed as an integral part of, cleaning pads and sheets in a variety of locations on the pads and sheets. For example, the functional cuff(s) can be situated along the mid-line of the cleaning pad or sheet (in the x-y plane) along either the x-dimension or the y-dimension. Preferably, the cleaning pad or sheet comprises two functional cuffs situated at or near opposite edges (e.g., the leading and trailing edges of the pad and/or sheet, in terms of the y-dimension) of the cleaning pad or sheet. Preferably, the functional cuff(s) are placed in a location such that their length is perpendicular to the back and forth mopping or wiping direction used by the consumer.

Cleaning pads comprising functional cuff(s) are exemplified in FIGS. 2, 4*a*, and 4*b* of the drawings. FIG. 2 is a perspective view of a cleaning pad 200 comprising a free-floating, looped functional cuff 207. The looped functional cuff 207 has two surfaces 209 and 211. During a typical cleaning method, such as mopping or wiping, the cleaning pad 200 is moved forward in the $Y_f$ direction, then backward in the $Y_b$ direction across the surface being cleaned. As the cleaning pad 200 is moved in the $Y_f$ direction, the functional cuff 207 will flip such that its surface 211 is in contact with the surface being cleaned. Particulate matter on the surface being cleaned is picked-up by the surface 211 of the functional cuff 207. When the cleaning pad 200 is then moved in the $Y_b$ direction, the functional cuff 207 will then flip over such that its other surface 209 is in contact with the surface being cleaned. The particulate matter initially picked-up by surface 211 will be trapped between surface 211 of the functional cuff 207 and layer 201 of the cleaning pad 200. Surface 209 of the functional cuff 207 is then capable of picking-up additional particulate matter.

FIGS. 4*a* and 4*b* illustrate a cleaning pad 400 comprising two free-floating, looped functional cuffs 411 and 413, similar to the functional cuff 207 in FIG. 2. Referring to FIG. 4*b*, during a typical cleaning method, the cleaning pad 400 is moved in the $Y_f$ direction across a hard surface and functional cuffs 411 and 413 are flipped such that surfaces 417 and 425 are in contact with the surface being cleaned and are capable of picking-up particulate matter. The cleaning pad 400 is then moved across the hard surface in the $Y_b$ direction, causing the functional cuffs 411 and 413 to flip over such that surfaces 419 and 423 are in contact with the surface being cleaned. The particulate matter picked-up by surface 425 is trapped between surface 425 and scrubbing layer 401. Surfaces 419 and 423 are then able to pick-up additional particulate matter from the surface being cleaned. When the cleaning pad 400 is moved back across the hard surface in the $Y_f$ direction, the additional particulate matter picked-up is trapped between surface 423 and scrubbing layer 401. Where functional cuff(s) are incorporated in cleaning pads having layers with multiple widths in the z-dimension, as in FIG. 4*b*, the height (meaning the z-dimension of a fully-extended functional cuff) of the functional cuff is large enough so that when the functional cuff flips toward the mid-line of the cleaning pad, it overlaps the layer having the narrowest width. FIG. 4*a* shows a cleaning pad 400 comprising two functional cuffs 411 and 413, wherein the functional cuffs 411 and 413 are both flipped toward the mid-line of the cleaning pad, which is preferable for packaging the cleaning pad 400 for resale.

F. Optional Density Gradient

Applicants have found that incorporating a density gradient throughout the absorbent layer(s) of the cleaning pad of the present invention has an important effect on cleaning performance and ability of the cleaning pad to quickly absorb liquids, especially liquid containing particulate matter. Although density gradients have been used in absorbent articles such as diapers, sanitary napkins, incontinence devices, and the like, Applicants have surprisingly discovered specific density gradients uniquely useful for the absorbent layer in cleaning pads. Density gradients in cleaning pads are unique for at least two identifiable reasons. First, the absorbent layer in a cleaning pad needs to handle liquid with both dissolved components and undissolved, suspended components, such as insoluble particulate matter. In the case of diapers, sanitary napkins, incontinence devices, and the like, the absorbent layer typically needs to handle only liquids with dissolved components, such as bodily fluids. Second, the absorbent layer of a cleaning pad needs to absorb liquid against the force of gravity. In terms of diapers, sanitary napkins, incontinence devices, and the like, the absorbent layer typically has the force of gravity to pull liquid into, and distribute it throughout, the absorbent layer. Having sufficient resiliency in the cleaning pad is important, as described below, in maintaining good cleaning performance, especially in cleaning pads comprising a density gradient. The preferred cleaning pads comprising the specific density gradients described herein exhibit improvements in at least three important characteristics affecting hard surface cleaning performance: acquisition (the time required to transfer liquid from the surface being cleaned to the absorbent layer(s) of the cleaning pad), distribution (the liquid wicking ability of the absorbent layer(s) so as to utilize as much of the pad as possible), and rewet (the amount of dirty liquid retained within the absorbent layer(s) and not squeezed out during a cleaning process).

The absorbent layer can comprise a single absorbent layer with a continuous density gradient in the cleaning pad's z-dimension, or multiple absorbent layers having different densities resulting in a density gradient. A continuous density gradient is one in which the material comprising the cleaning pad is homogeneous, but has differing densities throughout the material. A process for creating a continuous density gradient is disclosed in U.S. Pat. No. 4,818,315, issued Apr. 4, 1989 to Hellgren et al., which is hereby incorporated by reference. Preferably, the cleaning pad of the present invention comprises a density gradient resulting from multiple absorbent layers, preferably three, each having a different density. A density gradient is typically "strong" when the density of the absorbent layers increase from a lower absorbent layer to an upper absorbent layer. Preferably, the present cleaning pads comprise a "strong" density gradient, which provides fast acquisition, better core utilization by effectively wicking liquid in the z- and x-y directions, and a reduced tendency for allowing absorbed liquids, especially those containing undissolved particulate, to be squeezed out. A strong density gradient preferably comprises at least two absorbent layers, with a first absorbent layer having a density of from about 0.01 g/cm$^3$ to about 0.15 g/cm$^3$, preferably from about 0.03 g/cm$^3$ to about 0.1 g/cm$^3$, and more preferably from about 0.04 g/cm$^3$ to about 0.06 g/cm$^3$, and a second absorbent layer having a density of from about 0.04 g/cm$^3$ to about 0.2 g/cm$^3$, preferably from about 0.1 g/cm$^3$ to about 0.2 g/cm$^3$, and more preferably from about 0.12 g/cm$^3$ to about 0.17 g/cm$^3$; wherein the density of the first absorbent layer is about 0.04 g/cm$^3$, preferably about 0.07 g/cm$^3$, and more preferably about 0.1 g/cm$^3$, less than the density of the second absorbent layer.

In a preferred embodiment, the present cleaning pad comprises a density gradient resulting from three absorbent layers, wherein a first absorbent layer has a density of from about 0.01 g/cm$^3$ to about 0.08 g/cm$^3$, preferably from about 0.03 g/cm$^3$ to about 0.06 g/cm$^3$, and a second absorbent layer has a density of from about 0.03 g/cm$^3$ to about 0.12 g/cm$^3$, preferably from about 0.07 g/cm$^3$ to about 0.1 g/cm$^3$, and a third absorbent layer has a density of from about 0.05 g/cm$^3$ to about 0.2 g/cm$^3$, preferably from about 0.08 g/cm$^3$ to about 0.15 g/cm$^3$; wherein the difference in density between the first absorbent layer and the second absorbent layer, and between the second absorbent layer and the third absorbent layer, is at least about 0.02 g,/cm$^3$, preferably at least about 0.04 g/cm$^3$.

In another preferred embodiment, referring to FIG. 4*b* of the drawings, a cleaning pad 400 comprises a first absorbent layer 405 having a density of about 0.05 g/cm$^3$, a second absorbent layer 407 having a density of about 0.1 g/cm$^3$, and a third absorbent layer 409 having a density of about 0.15 g/cm$^3$. It is recognized that a such a density gradient can be present in a cleaning pad with or without layers having multiple widths in the z-dimension, as shown in FIG. 4*b*.

As a result of the density gradient, the porosity, meaning the ratio of the volume of interstices of a material to the volume of its mass, of the absorbent layer will typically decrease as the density increases. The porosity is important, particularly in the context of a cleaning pad for cleaning hard surfaces, because the liquid to be absorbed by the cleaning pad typically contains moderate amounts of relatively large particulate matter. As the soiled liquid enters the cleaning pad through the scrubbing layer, the larger particulate matter becomes entrapped in the interstices of the lower absorbent layers. As the porosity of the absorbent layers decreases, and the density increases, the larger particulate matter becomes trapped in the larger interstices of the lower absorbent layers and the remaining liquid is then transferred to the upper absorbent layers. This allows the liquid to be more easily transferred towards the higher-density layers and allows the particulate matter to remain trapped in the interstices of the lower absorbent layers. As a result, the cleaning pad retains both liquid and particulate matter much more effectively than cleaning pads without a strong density gradient.

Where an absorbent layer has a density of less than about 0.1 g/cm$^3$, the layer tends to be less resilient, which is another important property of the present cleaning pad as discussed below. In order to increase the resiliency of an absorbent layer having a relatively low density, a thermoplastic material, preferably a bicomponent fiber, is combined with the fibers of the absorbent layer. Upon melting, at least a portion of this thermoplastic material migrates to the intersections of the fibers, typically due to interfiber capillary gradients. These intersections become bond sites for the thermoplastic material. When cooled, the thermoplastic materials at these intersections solidify to form the bond sites that hold the matrix or web of fibers together in each of the respective layers. This can be beneficial in providing additional overall integrity to the cleaning pad. While bicomponent fibers are known in the art, they are typically used at levels of less than about 15%. Applicants have found that in order to provide desired resiliency, an absorbent layer having a density of less than about 0.05 g/cm$^3$ preferably comprises at least about 20%, preferably at least about 30%, more preferably at least about 40%, of a thermoplastic material such as a bicomponent fiber. A preferable bicomponent fiber comprises a copolyolefin bicomponent fiber comprising a less than about 81% polyethylene terphthalate core and a less than about 51% copolyolefin sheath and is commercially available from the Hoechst Celanese Corporation under the tradename CELBOND® T-255.

G. Optional Adhesive Scrubbing Strips

The cleaning pads of the present invention can optionally comprise adhesive scrubbing strips to enhance the tough-soil removal ability of the present cleaning pads. Adhesive scrubbing strips typically used herein are composed of materials often used for making scouring pads. Such materials are typically composed of polymer blends with or without specific abrasives. Typical polymers used include nylon, polyester and polypropylene or blends thereof. Nylon is the most preferred material since it provides greater stiffness and durability versus polyester and polypropylene. To increase mechanical scrubbing ability, abrasive materials can be combined with the polymers. For example, 3M Scotch Brite® scouring pads are composed of nylon fibers combined with silicon carbide and/or aluminum oxide and/or calcium carbonate as abrasives. Depending on the degree of scrubbing desired, the abrasive level and type can be adjusted accordingly. Alternatively, for more surface-safe scrubbing, the adhesive scrubbing strips can be composed of only polymer or polymer blends combined with binders or curing adhesives without any abrasives.

An alternative to using materials found in typical scouring pads is to use brushes containing bristles to achieve scrubbing. Such bristles are typically composed of polymer or polymer blends, with or without abrasives. In the context of brushes, bristles made of nylon again are preferred because of rigidity, stiffness, and/or durability. A preferred nylon bristle is that commercially available from 3M Corp. under the trade name Tynex®612 nylon. These bristles have shown less water absorption versus commercial Nylon 66. Reducing the ability of the present adhesive scrubbing strips to absorb water is important since water absorption decreases bristle stiffness and recovery while impacting scrubbing ability.

A third approach for creating a scrubbing strip is to use netting or scrim materials to form the scrubbing strip. Again, the netting or scrim is typically composed of a polymer or polymer blend, either with or without abrasives. The netting or scrim is typically wrapped around a secondary structure to provide some bulk. The shape of the holes in the netting can include, but is not limited to, a variety of shapes such as squares, rectangles, diamonds, hexagons or mixtures thereof. Typically, the smaller the area composed by the holes in the netting the greater the scrubbing ability. This is primarily due to the fact that there are more points where scrim material intersects. These intersection points are typically areas contacting the floor. An alternative to wrapping netting or scrim is to apply molten extruded polymers directly onto the secondary structure such as a non-woven. Upon curing the polymer would create high points of stiffer material as compared to the secondary non-woven which in turn provides scrubbing ability.

The dimension of the scrubbing strip can have a significant impact on the ability structure to remove tough stains and soils. Along with dimension, the force applied can also significantly impact scrubbing ability. The force applied is often determined by location where scrubbing strip is applied on mop or on pad.

The present adhesive scrubbing strip is preferably rectangular in shape. The x-dimension of the adhesive scrubbing strip is typically from about 10 mm to about 300 mm, preferably from about 30 mm to about 190 mm, and more preferably from about 50 mm to about 75 mm. The y-dimension of the adhesive scrubbing strip is typically from about 5 mm to about 50 mm, preferably from about 10 mm to about 40 mm, and more preferably from about 15 mm to about 30 mm. The z-dimension (thickness) of the adhesive scrubbing strip is typically from about 1 mm to about 20 mm, preferably from about 2 mm to about 15 mm, and more preferably from about 3 mm to about 10 mm.

The x- and y-dimensions of the adhesive scrubbing strip typically have an impact upon tough stain removal from hard surfaces. In general, smaller x- and y-dimensions of the scrubbing strip result in a more effective tough stain removal ability of the cleaning pad and/or implement. A reduction in the dimensions of the scrubbing strip typically results in a proportionate reduction in the number of strokes needed to remove the tough stain from the hard surface being cleaned. Also, increasing the z-dimension (thickness) of the scrubbing strip tyically results in better tough stain removal. The improvement in tough stain removal by varying the dimensions of the scrubbing strip generally applies to scrubbing strips comprising a variety of materials. In addition, increasing the z-dimension (thickness) of the scrubbing strip, allows one to utilize softer materials, such as nylon without abrasive material, in the scrubbing strip while achieving a similar level of tough stain removal as compared to scrubbing strips comprising harder materials, such as polypropylene. Also, tough stain removal can be enhanced by incorporating a mixture of materials in the scrubbing strip, such as nylon and abrasive materials, such as silicon carbide, aluminum oxide, calcium carbonate, and the like, or a combination of a polyester wadding wrapped in a nylon netting.

The ratio of an area of a surface of the cleaning pad to an area of a surface of the adhesive scrubbing strip is typically from about 840:1 to about 3:1, preferably from about 140:1 to about 6:1, and more preferably from about 56:1 to about 15:1.

Examples of scrubbing strips of the present inventions have dimensions that include, but are not limited to, the following (expressed as (y-dimension)×(x-dimension)×(z-dimension)): 32 mm×267 mm×8 mm; 32 mm×64 mm×8 mm; 32 mm×64 mm×5 mm; and 32 mm×64 mm×10 mm.

i. Placement of Adhesive Scrubbing Strip on Cleaning Pad

In one embodiment, the adhesive scrubbing strip is attached directly to a cleaning pad of the present invention. This achieves scrubbing yet encourages more frequent disposal of the adhesive scrubbing strip. This can be achieved by attaching the scrubbing strip onto the pad during actual processing or by designing a separate scrubbing strip that can be attached to the pad by a consumer via a peel-and-stick adhesive or a velcro loop and hook design (hooks on pad). In this context, a consumer can choose whether to incorporate a scrubbing strip into the cleaning pad or not. If a consumer requires a scrubbing strip, he or she can simply attach it onto the pad or use a pad with a scrubbing strip already attached.

With a design where the scrubbing strip is attached directly to the pad, having optimum dimensions of the scrubbing strip, especially in relative to the dimensions of the cleaning pad, is important. The scrubbing strip has to be made reasonably small and thin so that fluid absorption into the cleaning pad and/or wiping is not negatively affected. Typically, the most preferred position for the scrubbing strip is in the centre of the cleaning pad since this is where the most pressure can be applied. FIGS. 4*a* and 4*b* show a cleaning pad 400 of the present invention having an adhesive scrubbing strip 430 attached to a liquid pervious scrubbing layer 401, wherein the scrubbing strip 430 is located generally in the center of the lower surface of the cleaning pad 400. Alternatively, the scrubbing strip can be placed on the outer extremities of the pad, but this is typically less effective and, if function cuffs are incorporated into the cleaning pad, can interfere with the cuffs functioning properly in a cleaning pad design which utilizes functional cuffs which move back and forth. A preferred approach for achieving scrubbing via functional cuffs is to add a netting or scrim material around the cuffs to increase their stiffness and rigidity.

ii. Effective Scrubbing Versus Surface Safety

While achieving effective scrubbing is important for being able to more easily remove tough spots and stains, it is important that this be done without causing damage to the surface being scrubbed.

An adhesive scrubbing strip that is composed of a polymer (preferably nylon) and without abrasive material provides the best balance between tough stain removal and surface safety. Adhesive scrubbing strips containing higher levels of abrasive material are particularly prone to damaging the surfaces being cleaned. Additionally, a scrubbing strip composed of a brush made of nylon bristles also tends to cause less surface damage.

The other important data to note is a comparison of a scrubbing strip attached to a mop head versus attached to a cleaning pad. A scrubbing strip attached to a cleaning pad typically shows more surface damage than a scrubbing strip attached to the leading edge of a mop head. Again while not wishing to be limited by theory, it is believed that this higher surface damage is the result of a smaller dimension for the scrubbing strip and the ability to apply higher pressures when the scrubbing strip is attached to a cleaning pad such that the mop head is in flat position. When a scrubbing strip is on the leading edge of a mop head, the mop head needs to be tilted and the mop turned 90 degrees resulting in the ability to apply less pressure.

In net, the most preferred option for providing surface safe effective scrubbing uses a scrubbing strip composed primarily of polymer nylon being the most preferred, with little to no abrasives.

iii. Methods of Using a Cleaning Pad Comprising Adhesive Scrubbing Strips

Effective tough stain removal can be made easier by combining specific product designs with specific instructions for use.

Effective tough stain removal would be defined as means by which a tough stain can be eliminated from the surface without creating negatives from the standpoint of: (1) Damage to surface, (2) End Result appearance of floor, (3) Amount of effort required to scrub, and (4) Convenience and Ease of Use.

To balance these 4 factors it is preferred that tough stain removal be attacked systemically. Rather than trying to achieve tough stain removal all through mechanical abrasion, it is preferred that tough stain removal be achieved through a combination of mechanical abrasion and chemical action. To help achieve this requires specific instructions. For example through pictures and/or words we would instruct consumers for best results to: First saturate tough spots and stains with cleaning solution and let soak for several minutes, then applying gentle but firm pressure scrub tough stain or spot until removed. Optionally, an additional instruction can be added that can state that a scrubbing strip may scratch some plastic or painted surfaces and should be tested in an inconspicuous area first before using.

H. Optional Perfume Carrier Complex

The cleaning pads of the present invention can contain an effective amount of various moisture-activated encapsulated perfume particles, as an optional ingredient. The encapsulated particles act as protective carriers and reduce the loss of perfume prior to use. Such materials include, for example, cyclodextrin/perfume inclusion complexes, polysaccharide cellular matrix perfume microcapsules, and the like. Encapsulation of perfume minimizes the diffusion and loss of the volatile blooming perfume ingredients. Perfume is released when the materials are wetted, such as when wiping a damp hard surface with a cleaning pad having a perfume carrier complex, to provide a pleasant odor signal in use. Especially preferred are cyclodextrin inclusion complexes.

The optional water-activated protective perfume carriers are very useful in the present cleaning pads. They allow the use of lower level of perfume in the cleaning pads because of the reduced loss of the perfume during manufacturing and use. Furthermore, since the protected perfume is used in the form of a dry powder, instead of a liquid, the perfume carrier complex can be easily incorporated into the present cleaning pads. Preferably, the perfume carrier complex is incorporated into the absorbent layer of the present cleaning pads, so that when liquid is absorbed into the absorbent layer, the volatile blooming perfume materials will be release, providing an appealing scent signal to the consumer of the cleaning pad.

Also, after the cleaning pad is disposed, the less volatile perfume materials will remain to mask any malodors that can develop in the cleaning pad due to the dirty detergent solution stored in the absorbent layer of the cleaning pad. If the preferred cyclodextrin inclusion complexes are utilized, the cyclodextrin can function to absorb any malodors that develop after the cleaning pad is disposed and begins to dry out.

Due to the minimal loss of the volatile ingredients of the blooming perfume compositions provided by the water activated protective perfume carrier, the perfume compositions that incorporate them can contain less blooming perfume ingredients than those used in the free, unencapsulated form. The encapsulated and/or complexed perfume compositions typically contain at least about 20%, preferably at least about 30%, and more preferably at least about 40% blooming perfume ingredients. Optionally, but preferably, compositions that contain encapsulated and/or complexed perfume also comprise free perfume in order to provide consumers with a positive scent signal before the cleaning pad is used.

i. Cyclodextrin

As used herein, the term "cyclodextrin" includes any of the known cyclodextrins such as unsubstituted cyclodextrins containing from six to twelve glucose units, especially, alpha-, beta-, and gamma-cyclodextrins, and/or their derivatives, and/or mixtures thereof. The alpha-cyclodextrin consists of 6, the beta-cyclodextrin 7, and the gamma-cyclodextrin 8, glucose units arranged in a donut-shaped ring. The specific coupling and conformation of the glucose units give the cyclodextrins a rigid, conical molecular structure with a hollow interior of a specific volume. The "lining" of the internal cavity is formed by hydrogen atoms and glycosidic bridging oxygen atoms, therefore this surface is fairly hydrophobic. These cavities can be filled with all or a portion of an organic molecule with suitable size to form an "inclusion complex." Alpha-, beta-, and gamma-cyclodextrins can be obtained from, among others, American Maize-Products Company (Amaizo), Hammond, Ind.

Cyclodextrin derivatives are disclosed in U.S. Pat. No. : 3,426,011, Parmerter et al., issued Feb. 4, 1969; U.S. Pat. Nos. 3,453,257, 3,453,258, 3,453,259, and 3,453,260, all in the names of Parmerter et al., and all also issued Jul. 1, 1969; U.S. Pat. No. 3,459,731, Gramera et al., issued Aug. 5, 1969; U.S. Pat. No. 3,553,191, Parmerter et al., issued Jan. 5, 1971; U.S. Pat. No. 3,565,887, Parmerter et al., issued Feb. 23, 1971; U.S. Pat. No. 4,535,152, Szejtli et al., issued Aug. 13, 1985; U.S. Pat. No. 4,616,008, Hirai et al., issued Oct. 7, 1986; U.S. Pat. No. 4,638,058, Brandt et al., issued Jan. 20, 1987; U.S. Pat. No. 4,746,734, Tsuchiyama et al., issued May 24, 1988; and U.S. Pat. No. 4,678,598, Ogino et al., issued Jul. 7, 1987, all of said patents being incorporated herein by reference. Examples of cyclodextrin derivatives suitable for use herein are methyl-beta-cyclodextrin, hydroxyethyl-beta-cyclodextrin, and hydroxypropyl-beta-cyclodextrin of different degrees of substitution (D.S.), available from Amaizo; Wacker Chemicals (USA), Inc.; and Aldrich Chemical Company. Water-soluble derivatives are also highly desirable.

The individual cyclodextrins can also be linked together, e.g., using multifunctional agents to form oligomers, polymers, etc. Examples of such materials are available commercially from Amaizo and from Aldrich Chemical Company (beta-cyclodextrin/epichlorohydrin copolymers).

The preferred cyclodextrin is beta-cyclodextrin. It is also desirable to use mixtures of cyclodextrins. Preferably at least a major portion of the cyclodextrins are alpha-, beta- and/or gamma-cyclodextrins, more preferably alpha- and beta-cyclodextrins. Some cyclodextrin mixtures are commercially available from, e.g., Ensuiko Sugar Refining Company, Yokohama, Japan.

ii. Formation of Cyclodextrin/Perfume Inclusion Complexes

The perfume/cyclodextrin inclusion complexes of this invention are formed in any of the ways known in the art. Typically, the complexes are formed either by bringing the perfume and the cyclodextrin together in a suitable solvent, e.g., water, or, preferably, by kneading/slurrying the ingredients together in the presence of a suitable, preferably minimal, amount of solvent, preferably water. The kneading/slurrying method is particularly desirable because it produces smaller complex particles and requires the use of less solvent, eliminating or reducing the need to further reduce particle size and separate excess solvent. Disclosures of complex formation can be found in Atwood, J. L., J. E. D. Davies & D. D. MacNichol, (Ed.): *Inclusion Compounds*, Vol. III, Academic Press (1984), especially Chapter 11, Atwood, J. L. and J. E. D. Davies (Ed.): *Proceedings of the Second International Symposium of Cyclodextrins 7* Tokyo, Japan, (July, 1984), and J. Szejtli, *Cyclodextrin Technology*, Kluwer Academic Publishers (1988), said publications incorporated herein by reference.

In general, perfume/cyclodextrin complexes have a molar ratio of perfume compound to cyclodextrin of about 1:1. However, the molar ratio can be either higher or lower, depending on the size of the perfume compound and the identity of the cyclodextrin compound. The molar ratio can be determined by forming a saturated solution of the cyclodextrin and adding the perfume to form the complex. In general the complex will precipitate readily. If not, the complex can usually be precipitated by the addition of electrolyte, change of pH, cooling, etc. The complex can then be analyzed to determine the ratio of perfume to cyclodextrin.

As stated hereinbefore, the actual complexes are determined by the size of the cavity in the cyclodextrin and the size of the perfume molecule. Desirable complexes can be formed using mixtures of cyclodextrins since perfumes are normally mixtures of materials that vary widely in size. It is usually desirable that at least a majority of the material be alpha-, beta-, and/or gamma-cyclodextrin, more preferably beta-cyclodextrin. The content of the perfume in the beta-cyclodextrin complex is typically from about 5% to about 15%, more normally from about 7% to about 12%.

Continuous complexation operation usually involves the use of supersaturated solutions, kneading/slurrying method, and/or temperature manipulation, e.g., heating and then either cooling, freeze-drying, etc. The complexes are dried to a dry powder to make the desired composition. In general, the fewest possible process steps are preferred to avoid loss of perfume.

iii. Matrix Perfume Microcapsules

Water-soluble cellular matrix perfume microcapsules are solid particles containing perfume stably held in the cells. The water-soluble matrix material comprises mainly polysaccharide and polyhydroxy compounds. The polysaccharides are preferably higher polysaccharides of the non-sweet, colloidally-soluble types, such as natural gums, e.g., gum arabic, starch derivatives, dextrinized and hydrolyzed starches, and the like. The polyhydroxy compounds are preferably alcohols, plant-type sugars, lactones, monoethers, and acetals. The cellular matrix microcapsules useful in the present invention are prepared by, e.g., (1) forming an aqueous phase of the polysaccharide and polyhydroxy compound in proper proportions, with added emulsifier if necessary or desirable; (2) emulsifying the perfumes in the aqueous phase; and (3) removing moisture while the mass is plastic or flowable, e.g., by spray drying droplets of the emulsion. The matrix materials and process details are disclosed in, e.g., U.S. Pat. No. 3,971,852, Brenner et al., issued Jul. 27, 1976, which is incorporated herein by reference.

The present invention preferably has minimal non-encapsulated surface perfume, preferably less than about 1%.

Moisture-activated perfume microcapsules can be obtained commercially, e.g., as IN-CAP® from Polak's Frutal Works, Inc., Middletown, N.Y.; and as Optilok System® encapsulated perfumes from Encapsulated Technology, Inc., Nyack, N.Y.

Water-soluble matrix perfume microcapsules preferably have size of from about 0.5 micron to about 300 microns, more preferably from about 1 micron to about 200 microns, most preferably from about 2 microns to about 100 microns.

I. Other Embodiments of Cleaning Pad and/or Sheets

To enhance the cleaning pad's and/or sheet's ability to remove tough soil residues and increase the amount of cleaning fluid in contact with the cleaning surface, it can be desirable to incorporate a scrim material into the cleaning pad and/or sheet. The scrim will be comprised of a durable, tough material that will provide texture to the pad's and/or sheet's scrubbing layer, particularly when in-use pressures are applied to the pad and/or sheet. Preferably, the scrim will be located such that it is in close proximity to the surface being cleaned. Thus, the scrim can be incorporated as part of the scrubbing layer or the absorbent layer; or it can be included as a distinct layer, preferably positioned between the scrubbing and absorbent layers. In one preferred embodiment, where the scrim material is of the same x-y dimension as the overall cleaning pad and/or sheet, it is preferred that the scrim material be incorporated such that it does not directly contact, to a significant degree, the surface being cleaned. This will maintain the ability of the pad to move readily across the hard surface and will aid in preventing non-uniform removal of the cleaning solution employed. As such, if the scrim is part of the scrubbing layer, it will be an upper layer of this component. Of course, the scrim must at the same time be positioned sufficiently low in the pad and/or sheet to provide its scrubbing function. Thus, if the scrim is incorporated as part of the absorbent layer, it will be a lower layer thereof. In a separate embodiment, it can be desirable to place the scrim such that it will be in direct contact with the surface to be cleaned.

In addition to the importance of properly positioning the scrim is that the scrim not significantly impede fluid flow through the pad. The scrim therefore is a relatively open web.

The scrim material will be any material that can be processed to provide a tough, open-textured web. Such materials include polyolefins (e.g., polyethylene, polypropylene), polyesters, polyamides, and the like. The skilled artisan will recognize that these different materials exhibit a different degree of hardness. Thus, the hardness of the scrim material can be controlled, depending on the end-use of the pad/implement. Where the scrim is incorporated as a discrete layer, many commercial sources of such materials are available (e.g., design number VO1230, available from Conwed Plastics, Minneapolis, Minn.). Alternatively, the scrim can be incorporated by printing a resin or other synthetic material (e.g. latex) onto a substrate, such as is disclosed in U.S. Pat. No. 4,745,021, issued May 17, 1988 to Ping, III et al., and U.S. Pat. No. 4,733,774, issued Mar. 29, 1988 to Ping, III et al., both of which are incorporated by reference herein.

The various layers that comprise the cleaning pad and/or sheet can be bonded together utilizing any means that provides the pad with sufficient integrity during the cleaning process. The scrubbing and attachment layers can be bonded to the absorbent layer or to each other by any of a variety of bonding processes, including the use of a uniform continuous layer of adhesive, a patterned layer of adhesive or any array of separate lines, spirals or spots of adhesive. Alternatively, bonding processes can comprise heat bonds, pressure bonds, ultrasonic bonds, dynamic mechanical bonds or any other suitable bonding processes or combinations of these bonding processes as are known in the art. Bonding can be around the perimeter of the cleaning pad (e.g., heat sealing the scrubbing layer and optional attachment layer and/or scrim material), and/or across the area (i.e., the x-y plane) of the cleaning pad so as to form a pattern on the surface of the cleaning pad. Bonding the layers of the cleaning pad with ultrasonic bonds across the area of the pad will provide integrity to avoid shearing of the discrete pad layers during use. Functional cuffs can be attached to the scrubbing layer and/or absorbent layer via similar bonding processes, including stitching processes known in the art.

"Resiliency" is an important property of the cleaning pads of the present invention. A highly resilient cleaning pad is able to more effectively absorb and retain liquid compared to less resilient cleaning pads. Also, where the cleaning pad comprises layers having multiple widths in the z-dimension, the resiliency of the cleaning pad allows it to maintain its "inverse pyramid" structure, even under pressures encountered during a typical cleaning operation, such as wet mopping. "Resiliency," in terms of cleaning pads as used herein, refers to the ability of a cleaning pad to "spring back" to its original thickness (measured in the z-dimension) after being subject to compression by a downward force parallel to its z-dimension. The resiliency of a cleaning pad is measured in terms of a percentage of its original thickness, as described in the Test Methods section below. Briefly, a cleaning pad is saturated with an aqueous nonionic buffered solution. The original thickness of the cleaning pad (the z-dimension) is then measured. A downward pressure (equivalent to about 0.25 psi) is then exerted on the cleaning pad, parallel to its z-dimension. The pressure is released, and the thickness of the cleaning pad is measured after a period of 30 seconds. The resiliency is calculated as a percentage, representing the ratio of its thickness after being compressed under pressure to its original thickness before any pressure is applied. Preferably, the cleaning pads of the present invention exhibit a resiliency of at least about 95%, more preferably at least about 98%, and still more preferably at least about 100%, and yet still more preferably at least about 105%. A cleaning pad is capable of exhibiting a resiliency of greater than 100%, especially if the cleaning pad comprises superabsorbent material as described herein.

The cleaning pads will preferably have an absorbent capacity when measured under a confining pressure of 0.09 psi after 20 minutes (1200 seconds) (hereafter referred to as "$t_{1200}$ absorbent capacity") of at least about 5 g deionized water per g of the cleaning pad. The absorbent capacity of the pad is measured at 20 minutes (1200 seconds) after exposure to deionized water, as this represents a typical time for the consumer to clean a hard surface such as a floor. The confining pressure represents typical pressures exerted on the pad during the cleaning process. As such, the cleaning pad should be capable of absorbing significant amounts of the cleaning solution within this 1200 second period under 0.09 psi. The cleaning pad will more preferably have a $t_{1200}$ absorbent capacity of at least about 10 g/g, still more preferably at least about 15 g/g, still more preferably at least about 20 g/g and most preferably at least about 30 g/g. The cleaning pad will preferably have a $t_{900}$ absorbent capacity of at least about 5 g/g, more preferably a $t_{900}$ absorbent capacity of at least about 15 g/g.

Values for $t_{1200}$ and $t_{900}$ absorbent capacity are measured by the performance under pressure (referred to herein as "PUP") method, which is described in detail in the Test Methods section below.

Preferably, but not necessarily, the cleaning pads also have a total fluid capacity (of deionized water) of at least about 100 grams, more preferably at least about 200 grams, still more preferably at least about 300 grams and most preferably at least about 400 grams. While pads having a total fluid capacity less than 100 grams are within the scope of the invention, they are not as well suited for cleaning large areas, such as seen in a typical household, as are higher capacity pads.

The cleaning pad of the present invention should also be capable of retaining absorbed fluid, even under the pressures exerted during the cleaning process. This is referred to herein as the cleaning pad's ability to avoid "squeeze-out" of absorbed fluid, or conversely its ability to retain absorbed fluid under pressure. The method for measuring squeeze-out is described in the Test Methods section. Briefly, the test measures the ability of a saturated cleaning pad to retain fluid when subjected to a pressure of 0.25 psi. Preferably, the cleaning pads of the present invention will have a squeeze-out value of not more than about 40%, more preferably not more than about 25%, still more preferably not more than about 15%, and most preferably not more than about 10%.

The cleaning implement and/or pad of the present invention is preferably used in combination with a hard surface cleaning composition as described hereinbefore.

The present invention also encompasses methods of using the cleaning implement, pad, and/or sheet of the present invention. The methods involve the cleaning of a hard surface, preferably inanimate surfaces. A preferred method of use comprises the step of contacting or wiping a hard surface, preferably inanimate, with a cleaning implement, a cleaning pad, and/or a cleaning sheet, all of which are described hereinbefore. The method preferably comprises a typical surface cleaning process, including, but not limited to, wiping, mopping, or scrubbing.

The present invention further encompasses articles of manufacture comprising a cleaning implement, cleaning pad and/or cleaning sheet according to the present invention in association with a set of instructions. As used herein, the phrase "in association with" means the set of instructions are either directly printed on the cleaning implement, cleaning pad, and/or cleaning sheet itself or presented in a separate manner including, but not limited to, a brochure, print advertisement, electronic advertisement, and/or verbal communication, so as to communicate the set of instructions to a consumer of the article of manufacture. The set of instructions preferably comprise the instruction to clean a hard surface, preferably inanimate, by contacting or wiping the surface with the cleaning implement, cleaning pad and/or cleaning sheet. Where the cleaning pad and/or sheet is of a type designed to be used in conjunction with a handle to provide a cleaning implement, such as a cleaning pad comprising an attachment layer, the article of manufacture preferably comprises a cleaning pad or cleaning sheet in association with a set of instructions comprising the instruction to clean a hard surface, preferably inanimate, by attaching the cleaning pad or cleaning sheet to a handle to provide a cleaning implement and then contacting or wiping the hard surface with the cleaning implement.

Referring to the figures which depict the cleaning pad and/or sheet of the present invention, FIG. 2 is a perspective view of a cleaning pad 200 comprising a free-floating, looped functional cuff 207. The looped functional cuff 207 has two surfaces 209 and 211. During a typical cleaning method, such as mopping or wiping, the cleaning pad 200 is moved forward in the $Y_f$ direction, then backward in the $Y_b$ direction across the surface being cleaned. As the cleaning pad 200 is moved in the $Y_f$ direction, the functional cuff 207 will flip such that its surface 211 is in contact with the surface being cleaned. Particulate matter on the surface being cleaned is picked-up by the surface 211 of the functional cuff 207. When the cleaning pad 200 is then moved in the $Y_b$ direction, the functional cuff 207 will then flip over such that its other surface 209 is in contact with the surface being cleaned. The particulate matter initially picked-up by surface 211 will be trapped between surface 211 of the functional cuff 207 and layer 201 of the cleaning pad 200. Surface 209 of the functional cuff 207 is capable of picking-up additional particulate matter. The cleaning pad also comprises a scrubbing layer 201, an attachment layer 203 and an absorbent layer 205 positioned between the scrubbing layer and the attachment layer. Alternatively, layers 201, 203, and 205 can represent a single absorbent layer. For simplicity, cleaning pad 200 is not depicted as having multiple widths in the z-dimension. As indicated above, while FIG. 2 depicts each of layers 201, 203 and 205 as a single separate layers of material, one or more of these layers can consist of a laminate of two or more plies. In a preferred embodiment, scrubbing layer 201 is an apertured formed film, preferably a macroscopically expanded three-dimensional plastic web. Also, although not depicted in FIG. 2, materials that do not inhibit fluid flow can be positioned between scrubbing layer 201 and absorbent layer 203 and/or between absorbent layer 203 and attachment layer 205. However, it is important that the scrubbing and absorbent layers be in substantial fluid communication, to provide the requisite absorbency of the cleaning pad. While FIG. 2 depicts pad 200 as having all of the pad's layers of equal size in the x and y dimensions, it is preferred that the scrubbing layer 201 and attachment layer 205 be larger than the absorbent layer, such that layers 201 and 205 can be bonded together around the periphery of the pad to provide integrity. The scrubbing and attachment layers can be bonded to the absorbent layer or to each other by any of a variety of bonding means, including the use of a uniform continuous layer of adhesive, a patterned layer of adhesive or any array of separate lines, spirals or spots of adhesive. Alternatively, the bonding means can comprise heat bonds, pressure bonds, ultrasonic bonds, dynamic mechanical bonds or any other suitable bonding means or combinations of these bonding means as are known in the art. Bonding can be around the perimeter of the cleaning pad, and/or across the surface of the cleaning pad so as to form a pattern on the surface of the scrubbing layer 201.

Figure 3:
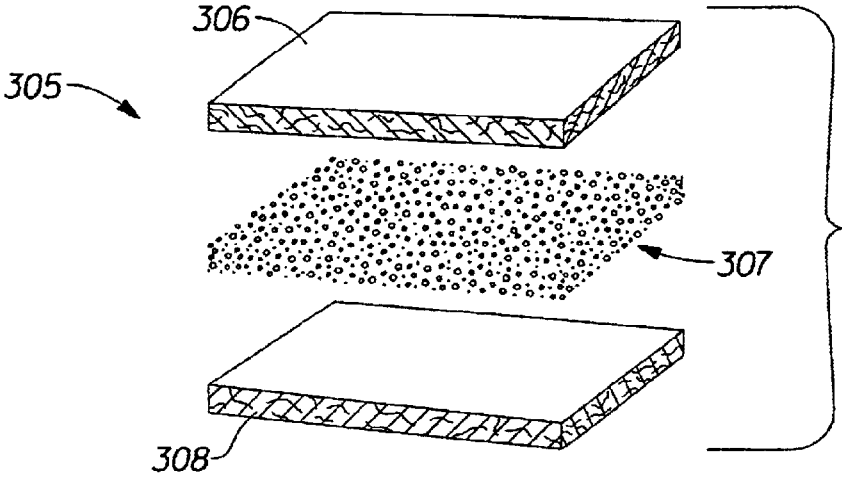
FIG. 3 is a blown perspective view of the absorbent layer of a cleaning pad of the present invention.

FIG. 3 is a blown perspective view of the absorbent layer 305 of an embodiment of a cleaning pad of the present invention. The cleaning pad's scrubbing layer and optional attachment layer are not shown in FIG. 3. Absorbent layer 305 is depicted in this embodiment as consisting of a tri-laminate structure. Specifically absorbent layer 305 is shown to consist of a discrete layer of particulate superabsorbent gelling material, shown as 307, positioned between two discrete layers 306 and 308 of fibrous material. In this embodiment, because of the region 307 of high concentration of superabsorbent gelling material, it is preferred that the superabsorbent material not exhibit gel blocking discussed above. In a particularly preferred embodiment, fibrous layers 306 and 308 will each be a thermally bonded fibrous substrate of cellulosic fibers, and lower fibrous layer 308 will be in direct fluid communication with the scrubbing layer (not shown). (Layer 307 can alternatively be a mixture of fibrous material and superabsorbent material, where the superabsorbent material is preferably present in a relatively high percentage by weight of the layer.) Also, while depicted as having equal widths, in a preferred embodiment layer 306 will be wider than layer 307 and layer 307 will be wider than layer 308. When a scrubbing and attachment layer are included, such a combination will provide a pad having multiple widths in the z-dimension.

FIG. 4*a* is a plan view of a preferred cleaning pad 400, with the liquid pervious scrubbing layer facing the viewer. FIG. 4*b* is a cross-sectional view (taken along the y-z plane) of cleaning pad 400. Referring to FIGS. 4*a* and 4*b*, cleaning pad 400 has two free-floating, looped functional cuffs 411 and 413.

Referring specifically to FIG. 4*b*, cleaning pad 400 has a scrubbing layer 401, an attachment layer 403, an absorbent layer indicated generally as 404 positioned between the scrubbing and attachment layers, two free-floating, looped functional cuffs 411 and 413, and an adhesive scrubbing strip 430. Absorbent layer 404 consists of three discrete layers 405, 407 and 409. Layer 409 is wider than layer 407 which is wider than layer 405. This decreasing width results in the functional cuffs 411 and 413 having improved functionality. During a typical cleaning operation, the cleaning pad 400 is moved in the $Y_f$ direction across a hard surface and functional cuffs 411 and 413 are flipped such that surfaces 417 and 425 are in contact with the surface being cleaned and are capable of picking-up particulate matter. The cleaning pad 400 is then moved across the hard surface in the $Y_b$ direction, causing the functional cuffs 411 and 413 to flip over such that surfaces 419 and 423 are in contact with the surface being cleaned. The particulate matter picked-up by surface 425 is trapped between surface 425 and scrubbing layer 401. Surfaces 419 and 423 are then able to pick-up additional particulate matter from the surface being cleaned. When the cleaning pad 400 is moved back across the hard surface in the $Y_f$ direction, the additional particulate matter picked-up is trapped between surface 423 and scrubbing layer 401.

FIG. 4*a* illustrates the general textured pattern provided by materials 417 and 419 comprising the functional cuffs 411 and 413, and adhesive scrubbing strip 430. The functional cuffs 411 and 413 are both flipped towards the mid-line of the cleaning pad, which is preferable for packaging the cleaning pad 400 for resale. Also depicted in FIG. 4*a* is a scrubbing layer 401 comprising an apertured formed film containing apertures 421 that are preferably tapered or funnel-shaped. Also depicted in FIG. 4*a* is region 410 corresponding to the periphery of pad 400 where scrubbing layer 401 and attachment layer 403 are bonded by any acceptable method. In a preferred embodiment, bonding is accomplished by heat sealing.

In a preferred embodiment, layers 405 and 407 of absorbent layer 404 comprise a high concentration of superabsorbent material, while layer 409 contains little or no superabsorbent material. In such embodiments, one or both of layers 405 and 407 can comprise a homogenous blend of superabsorbent material and fibrous material. Alternatively, one or both layers can be comprised of discrete layers, e.g., two fibrous layers surrounding an essentially continuous layer of superabsorbent particles.

Although not a requirement, Applicants have found that where superabsorbent particles are incorporated in the pad, it can be desirable to reduce the level of or eliminate superabsorbent particles at the extreme front and rear edges of the pad. This accomplished in pad 400 by constructing absorbent layer 409 without superabsorbent material.

A preferred cleaning pad is represented in FIG. 4*b*, which comprises two functional cuffs, an adhesive scrubbing strip, a liquid pervious scrubbing layer comprising an apertured formed film, three absorbent layers, and an attachment layer.

J. Process for Making Cleaning Pads and/or Sheets

The various layers and/or elements of the present cleaning pad are bonded together to form a unitary structure. The various layers and/or elements can be bonded in a variety of ways including, but not limited to, adhesive bonding, thermal bonding, ultra sonic bonding, and the like. The various layers and/or elements can be assembled to form a cleaning pad either by hand or by a conventional line converting process known in the art.

When the layers and/or elements are adhesively bonded together, the adhesive is typically selected so that the bond formed by the adhesive is able to maintain its strength in wet environments, especially when the cleaning pad is saturated with fluid and/or soil. The selection of the adhesive is particularly important when bonding two absorbent layers together, bonding an absorbent layer and an attachment layer together, or bonding an absorbent layer and a liquid pervious scrubbing layer together. In this context, the adhesive is typically selected such that the adhesive provides a bond with high water resistence, e.g. with a bond retention of at least about 30%, preferably at least about 50%, and more preferably at least about 70% of the dry bond strength value. Bond strength values can be measured according to a partially modified ASTM D 1876-95 (1995) (T-Peel Test) standard method, which is described in detail in U.S. Pat. No. 5,969,025 issued Oct. 19, 1999 to Corzani, which is hereby incorporated herein by reference.

Adhesives that can be used in the present invention include vinylic emulsions, including those based on vinyl acetate or other vinyl esters and ranging from homopolymers to copolymers with ethylene and/or acrylic monomers (vinyl acrylics); acrylic emulsions which can be either homopolymers or copolymers; a cross-linked adhesive including those created by including a reactive co-monomer (e.g., a monomer containing carboxyl, hydroxyl, epoxy, amide, isocyanate, or the like, functionality) which are capable of cross-linking the polymer themselves (e.g. carboxyl groups reacting with hydroxyl, epoxy or isocyanate groups) or by reaction with an external cross-linker (e.g. urea-formaldehyde resin, isocyanates, polyols, epoxides, amines and metal salts, especially zinc). The adhesives herein can also include limited quantities of tackifying resins to improve adhesion, such as the addition of hydrogenated rosin ester tackifier to a vinyl acetate/ethylene copolymer latex. Other suitable water-based adhesive compositions include those disclosed in U.S. Pat. No. 5,969,025 issued Oct. 19, 1999 to Corzani, which is hereby incorporated herein by reference.

IV. Pre-Moistened Cleaning Wipe

The hard surface cleaning compositions described herein can be used in a pre-moistened wipe, which can be used to wipe surfaces either alone or in combination with a handle to form a cleaning implement as described hereinafter. The wipe substrate can be composed of suitable unmodified and/or modified naturally occurring fibers including cotton, Esparto grass, bagasse, hemp, flax, silk, wool, wood pulp, chemically modified wood pulp, jute, ethyl cellulose, and/or cellulose acetate. Suitable synthetic fibers can comprise fibers of one, or more, of polyvinyl chloride, polyvinyl fluoride, polytetrafluoroethylene, polyvinylidene chloride, polyacrylics such as ORLON®, polyvinyl acetate, Rayon®, polyethylvinyl acetate, non-soluble or soluble polyvinyl alcohol, polyolefins such as polyethylene (e.g., PULPEX®) and polypropylene, polyamides such as nylon, polyesters such as DACRON® or KODEL®, polyurethanes, polystyrenes, and the like, including fibers comprising polymers containing more than one monomer. The absorbent layer can comprise solely naturally occurring fibers, solely synthetic fibers, or any compatible combination of naturally occurring and synthetic fibers.

The fibers useful herein can be hydrophilic, hydrophobic or can be a combination of both hydrophilic and hydrophobic fibers. As indicated above, the particular selection of hydrophilic or hydrophobic fibers depends upon the other materials included in the absorbent (and to some degree) the scrubbing layer described hereinafter. Suitable hydrophilic fibers for use in the present invention include cellulosic fibers, modified cellulosic fibers, rayon, cotton, polyester fibers such as hydrophilic nylon (HYDROFIL®). Suitable hydrophilic fibers can also be obtained by hydrophilizing hydrophobic fibers, such as surfactant-treated or silica-treated thermoplastic fibers derived from, for example, polyolefins such as polyethylene or polypropylene, polyacrylics, polyamides, polystyrenes, polyurethanes and the like.

Suitable wood pulp fibers can be obtained from well-known chemical processes such as the Kraft and sulfite processes. It is especially preferred to derive these wood pulp fibers from southern soft woods due to their premium absorbency characteristics. These wood pulp fibers can also be obtained from mechanical processes, such as ground wood, refiner mechanical, thermomechanical, chemimechanical, and chemi-thermomechanical pulp processes. Recycled or secondary wood pulp fibers, as well as bleached and unbleached wood pulp fibers, can be used.

Another type of hydrophilic fiber for use in the present invention is chemically stiffened cellulosic fibers. As used herein, the term "chemically stiffened cellulosic fibers" means cellulosic fibers that have been stiffened by chemical means to increase the stiffness of the fibers under both dry and aqueous conditions. Such means can include the addition of a chemical stiffening agent that, for example, coats and/or impregnates the fibers. Such means can also include the stiffening of the fibers by altering the chemical structure, e.g., by crosslinking polymer chains.

Where fibers are used as the absorbent layer (or a constituent component thereof), the fibers can optionally be combined with a thermoplastic material. Upon melting, at least a portion of this thermoplastic material migrates to the intersections of the fibers, typically due to interfiber capillary gradients. These intersections become bond sites for the thermoplastic material. When cooled, the thermoplastic materials at these intersections solidify to form the bond sites that hold the matrix or web of fibers together in each of the respective layers. This can be beneficial in providing additional overall integrity to the cleaning wipe.

Amongst its various effects, bonding at the fiber intersections increases the overall compressive modulus and strength of the resulting thermally bonded member. In the case of the chemically stiffened cellulosic fibers, the melting and migration of the thermoplastic material also has the effect of increasing the average pore size of the resultant web, while maintaining the density and basis weight of the web as originally formed. This can improve the fluid acquisition properties of the thermally bonded web upon initial exposure to fluid, due to improved fluid permeability, and upon subsequent exposure, due to the combined ability of the stiffened fibers to retain their stiffness upon wetting and the ability of the thermoplastic material to remain bonded at the fiber intersections upon wetting and upon wet compression. In net, thermally bonded webs of stiffened fibers retain their original overall volume, but with the volumetric regions previously occupied by the thermoplastic material becoming open to thus increase the average interfiber capillary pore size.

Thermoplastic materials useful in the present invention can be in any of a variety of forms including particulates, fibers, or combinations of particulates and fibers. Thermoplastic fibers are a particularly preferred form because of their ability to form numerous interfiber bond sites. Suitable thermoplastic materials can be made from any thermoplastic polymer that can be melted at temperatures that will not extensively damage the fibers that comprise the primary web or matrix of each layer. Preferably, the melting point of this thermoplastic material will be less than about 190° C., and preferably between about 75° C. and about 175° C. In any event, the melting point of this thermoplastic material should be no lower than the temperature at which the thermally bonded absorbent structures, when used in the cleaning pads, are likely to be stored. The melting point of the thermoplastic material is typically no lower than about 50° C.

The thermoplastic materials, and in particular the thermoplastic fibers, can be made from a variety of thermoplastic polymers, including polyolefins such as polyethylene (e.g., PULPEX®) and polypropylene, polyesters, copolyesters, polyvinyl acetate, polyethylvinyl acetate, polyvinyl chloride, polyvinylidene chloride, polyacrylics, polyamides, copolyamides, polystyrenes, polyurethanes and copolymers of any of the foregoing such as vinyl chloride/vinyl acetate, and the like. Depending upon the desired characteristics for the resulting thermally bonded absorbent member, suitable thermoplastic materials include hydrophobic fibers that have been made hydrophilic, such as surfactant-treated or silica-treated thermoplastic fibers derived from, for example, polyolefins such as polyethylene or polypropylene, polyacrylics, polyamides, polystyrenes, polyurethanes and the like. The surface of the hydrophobic thermoplastic fiber can be rendered hydrophilic by treatment with a surfactant, such as a nonionic or anionic surfactant, e.g., by spraying the fiber with a surfactant, by dipping the fiber into a surfactant or by including the surfactant as part of the polymer melt in producing the thermoplastic fiber. Upon melting and resolidification, the surfactant will tend to remain at the surfaces of the thermoplastic fiber. Suitable surfactants include nonionic surfactants such as Brij® 76 manufactured by ICI Americas, Inc. of Wilmington, Del., and various surfactants sold under the Pegosperse® trademark by Glyco Chemical, Inc. of Greenwich, Conn. Besides nonionic surfactants, anionic surfactants can also be used. These surfactants can be applied to the thermoplastic fibers at levels of, for example, from about 0.2 to about 1 g. per square centimeter of thermoplastic fiber.

Suitable thermoplastic fibers can be made from a single polymer (monocomponent fibers), or can be made from more than one polymer (e.g., bicomponent fibers). As used herein, "bicomponent fibers" refers to thermoplastic fibers that comprise a core fiber made from one polymer that is encased within a thermoplastic sheath made from a different polymer. The polymer comprising the sheath often melts at a different, typically lower, temperature than the polymer comprising the core. As a result, these bicomponent fibers provide thermal bonding due to melting of the sheath polymer, while retaining the desirable strength characteristics of the core polymer.

Suitable bicomponent fibers for use in the present invention can include sheath/core fibers having the following polymer combinations: polyethylene/polypropylene, polyethylvinyl acetate/polypropylene, polyethylene/polyester, polypropylene/polyester, copolyester/polyester, and the like. Particularly suitable bicomponent thermoplastic fibers for use herein are those having a polypropylene or polyester core, and a lower melting copolyester, polyethylvinyl acetate or polyethylene sheath (e.g., those available from Danaklon a/s, Chisso Corp., and CELBOND®, available from Hercules). These bicomponent fibers can be concentric or eccentric. As used herein, the terms "concentric" and "eccentric" refer to whether the sheath has a thickness that is even, or uneven, through the cross-sectional area of the bicomponent fiber. Eccentric bicomponent fibers can be desirable in providing more compressive strength at lower fiber thicknesses.

Methods for preparing thermally bonded fibrous materials are described in U.S. application Ser. No. 08/479,096 (Richards et al.), filed Jul. 3, 1995 (see especially pages 16–20) and U.S. Pat. No. 5,549,589 (Homey et al.), issued Aug. 27, 1996 (see especially Columns 9 to 10). The disclosures of both of these references are incorporated by reference herein.

The absorbent layer can also comprise a HIPE-derived hydrophilic, polymeric foam. Such foams and methods for their preparation are described in U.S. Pat. No. 5,550,167 (DesMarais), issued Aug. 27, 1996; and commonly assigned U.S. patent application Ser. No. 08/370,695 (Stone et al.), filed Jan. 10, 1995 (both of which are incorporated by reference herein).

The wipe can consist of one or more layers optionally including a scrub layer for maximum cleaning efficiency. For pre-moistened wipes that use a single substrate, the substrate preferably consists of fibers comprising of some combination of hydrophilic and hydrophobic fibers, and more preferably a composition consisting of at least about 30% hydrophobic fibers and even more preferably at least about 50% of hydrophobic fibers in a hydroentangled web. By hydrophobic fibers, it is meant polyester as well as those derived from polyolefins such as polyethylene, polypropylene and the like. The combination of a hydrophobic and absorbent hydrophilic fibers represents a particularly preferred embodiment for the single sheet pre-moistened wipe since the absorbent component, typically cellulose, aids in the sequestering and removal of dust and other soils present on the surface. The hydrophobic fibers are particularly useful in cleaning greasy soils, in improving the pre-moistened wipe and in lowering the friction between substrate and hard surface (glide). In terms of rank ordering of fiber chemical composition for improved glide, the inventors have found polyester, particularly polyester, along with polypropylene to be most effective in providing excellent glide, followed by polyethylene. Cellulose (or rayon) based pre-moistened wipes, though highly absorbent lead to significant friction between substrate and surface to be cleaned. Fiber blends are more difficult to rank order from a glide perspective, though the inventors have found that even low levels of polyester or polypropylene content can significantly improve the glide performance in virtually all cases. Fiber compositions that typically have a coefficient of friction with glass can be improved, as needed, by impregnating or chemically bonding the wipe with low levels of silicone or other chemicals that are known to reduce friction. Silicones are preferred since they also reduce composition sudsing, leading to improved result.

Various forming methods can be used to form a suitable fibrous web. For instance, the web can be made by non-woven dry forming techniques, such as air-laying, or alternatively by wet laying, such as on a paper making machine. Other non-woven manufacturing techniques, including but not limited to techniques such as melt blown, spunbonded, needle punched, and hydroentanglement methods can also be used.

In one embodiment, the dry fibrous web can be an airlaid nonwoven web comprising a combination of natural fibers, staple length synthetic fibers and a latex binder. The dry fibrous web can be about 20–80 percent by weight wood pulp fibers, 10–60 percent by weight staple length polyester fibers, and about 10–25 percent by weight binder.

The dry, fibrous web can have a basis weight of between about 30 and about 100 grams per square meter. The density of the dry web can be measured after evaporating the liquid from the premoistened wipe, and the density can be less than about 0.15 grams per cubic centimeter. The density is the basis weight of the dry web divided by the thickness of the dry web, measured in consistent units, and the thickness of the dry web is measured using a circular load foot having an area of about 2 square inches and which provides a confining pressure of about 95 grams per square inch. In one embodiment, the dry web can have a basis weight of about 64 grams per square meter, a thickness of about 0.06 cm, and a density of about 0.11 grams per cubic centimeter.

In one embodiment, the dry fibrous web can comprise at least 50 percent by weight wood pulp fibers, and more preferably at least about 70 percent by weight wood pulp fibers. One particular airlaid nonwoven web which is suitable for use in the present invention comprises about 73.5 percent by weight cellulosic fibers (Southern softwood Kraft having an average fiber length of about 2.6 mm); about 10.5 percent by weight polyester fibers having a denier of about 1.35 gram/9000 meter of fiber length and a staple length of about 0.85 inch; and about 16 percent by weight of a binder composition comprising a styrene butadiene copolymer. The binder composition can be made using a latex adhesive commercially available as Rovene 5550 (49 percent solids styrene butadiene) available from Mallard Creek Polymers of Charlotte, N.C.

One suitable airlaid non-woven web for use in the present invention is the airlaid nonwoven web employed in PAMPERS BABY FRESH brand baby wipes marketed by The Procter & Gamble Co. of Cincinnati, Ohio.

The following patents are incorporated herein by reference for their disclosure related to webs: U.S. Pat. No. 3,862,472 issued Jan 28, 1975; U.S. Pat. No. 3,982,302 issued Sep. 28, 1976; U.S. Pat. No. 4,004,323 issued Jan. 25, 1977; U.S. Pat. No. 4,057,669 issued Nov. 8, 1977; U.S. Pat. No. 4,097,965 issued Jul. 4, 1978; U.S. Pat. No. 4,176,427 issued Dec. 4, 1979; U.S. Pat. No. 4,130,915 issued Dec. 26, 1978; U.S. Pat. No. 4,135,024 issued Jan. 16, 1979; U.S. Pat. No. 4,189,896 issued Feb. 26, 1980; U.S. Pat. No. 4,207,367 issued Jun. 10, 1980; U.S. Pat. No. 4,296,161 issued Oct. 20, 1981; U.S. Pat. No. 4,309,469 issued Jan 25, 1982; U.S. Pat. No. 4,682,942 issued Jul. 28, 1987.—and U.S. Pat. Nos. 4,637,859; 5,223,096; 5,240,562; 5,556,509; and 5,580,423.

The art recognizes the use of dusting sheets such as those in U.S. Pat. No. 3,629,047, U.S. Pat. No. 3,494,421, U.S. Pat. No. 4,144,370, U.S. Pat. No. 4,808,467, U.S. Pat. No. 5,144,729, and U.S. Pat. No. 5,525,397, all of which are incorporated herein by reference, as effective for picking up and retaining particulate dirt. These sheets require a structure that provides reinforcement yet free fibers in order to be effective. The applicants herein have found that similar structures used dry for dusting can also be advantageously used when pre-moistened with liquid at levels from about 0.5 gram of chemical solution per gram dry substrate or greater. These levels are significantly higher than the levels used for chemical additives such as mineral oils, waxes etc. often applied to conventional dusting sheets to enhance performance. In particular, the wipes of this invention are specifically intended to be used pre-moistened with aqueous compositions.

In one preferred embodiment, the cleaning sheet has at least two regions where the regions are distinguished by basis weight. The measure for basis weight is described in U.S. Provisional Applications 60/055,330 and 60/047,619. Briefly, the measurement is achieved photographically, by differentiating dark (low basis weight) and light (high basis) network regions. In particular, the cleaning sheet comprises one or more low basis weight regions, wherein the low basis region(s) have a basis weight that is not more than about 80% of the basis weight of the high basis weight regions. In one preferred aspect, the first region is relatively high basis weight and comprises an essentially continuous network. The second region comprises a plurality of mutually discrete regions of relatively low basis weight and which are circumscribed by the high basis weight first region. In particular, a preferred cleaning sheet comprises a continuous region having a basis weight of from about 30 to about 120 grams per square meter and a plurality of discontinuous regions circumscribed by the high basis weight region, wherein the discontinuous regions are disposed in a random, repeating pattern and having a basis weight of not more than about 80% of the basis weight of the continuous region.

In one embodiment, the cleaning sheet will have, in addition to regions which differ with regard to basis weight, substantial macroscopic three-dimensionality. The term "macroscopic three-dimensionality", when used to describe three dimensional cleaning sheets means a three dimensional pattern is readily visible to the naked eye when the perpendicular distance between the viewer's eye and the plane of the sheet is about 12 inches. In other words, the three dimensional structures of the pre-moistened sheets of the present invention are cleaning sheets that are non-planar, in that one or both surfaces of the sheets exist in multiple planes. By way of contrast, the term "planar", refers to sheets having fine-scale surface aberrations on one or both sides, the surface aberrations not being readily visible to the naked eye when the perpendicular distance between the viewer's eye and the plane of the sheet is about 12 inches. In other words, on a macro scale the observer will not observe that one or both surfaces of the sheet will exist in multiple planes so as to be three-dimensional.

The measure for three-dimensionality is described in Fereshtehkhou et al., U.S. Ser. No. 09/082,349, filed May 20, 1998 (Case 6664M); Fereshtehkhou et al., U.S. Ser. No. 09/082,396, filed May 20, 1998 (Case 6798M), which are hereby incorporated by reference. Briefly, macroscopic three-dimensionality is described in terms of average height differential, which is defined; as the average distance between adjacent peaks and valleys of a given surface of a sheet, as well as the average peak to peak distance, which is the average distance between adjacent peaks of a given surface. Macroscopic three dimensionality is also described in terms of surface topography index of the outward surface of a cleaning sheet; surface topography index is the ratio obtained by dividing the average height differential of a surface by the average peak to peak distance of that surface. In a preferred embodiment, a macroscopically three-dimensional cleaning sheet has a first outward surface and a second outward surface wherein at least one of the outward surfaces has a peak to peak distance of at least about 1 mm and a surface topography index from about 0.01 mm to about 10 mm. The macroscopically three-dimensional structures of the pre-moistened wipes of the present invention optionally comprise a scrim, which when heated and the cooled, contract so as to provide further macroscopic three-dimensional structure.

In another alternative embodiment, the substrate can comprise a laminate of two outer hydroentangled webs, such as nonwoven webs of polyester, rayon fibers or blends thereof having a basis weight of about 10 to about 60 grams per square meter, joined to an inner constraining layer, which can be in the form of net like scrim material which contracts upon heating to provide surface texture in the outer layers.

The pre-moistened wipe is made by wetting the dry substrate with at least about 1.0 gram of liquid composition per gram of dry fibrous web. Preferably, the dry substrate is wetted with at least about 1.5, and more preferably at least about 2.0 grams of liquid composition per gram of the dry fibrous web. The exact amount of solution impregnated on the wipe will depend on the product's intended use. For pre-moistened wipes intended to be used for cleaning counter tops, stove tops, glass etc., optimum wetness is from about 1 gram of solution to about 5 grams of solution per gram of wipe. In the context of a floor cleaning wipe, the pre-moistened substrate can preferably include an absorbent core reservoir with a large capacity to absorb and retain fluid. Preferably, the absorbent reservoir has a fluid capacity of from about 5 grams to about 15 grams per gram of absorptive material. Pre-moistened wipes intended to be used for the cleaning of walls, exterior surfaces, etc. will have a capacity of from about 2 grams to about 10 grams of dry fibrous web.

A. Pre-Moistened Cleaning Wipe for Floors, Counters, and/or Walls

The hard surface cleaning compositions described hereinbefore can be used in a pre-moistened wipe for general purpose, counter, wall and floor cleaning. The material descriptions and processes described herein are also applicable to floor, counter and wall applications, and are incorporated by reference. It is particularly advantageous in the context of floor wipes to have structures with three-dimensionality. The three-dimension structure of the substrates described above have been found to provide improved hair pick-up relative to planar sheets, which in a wet surface environment is surprising. In a preferred embodiment, the user advantageously uses slight weaving motions in an up-and-down wiping pattern to maximize hair pick-up. Three-dimensional cleaning sheets particularly useful in the present invention are described in detail in Fereshtehkhou et al., U.S. Ser. No. 09/082,396, filed May 20, 1998 (Case 6798M), which is hereby incorporated herein by reference.

Optimum wetness is from about 1 gram of solution to about 5 grams of solution per gram of wipe. In the context of a floor cleaning wipe, the pre-moistened substrate can optionally include an absorbent core reservoir with a large capacity to absorb and retain fluid. Preferably, the absorbent reservoir has a fluid capacity of from about 5 grams to about 15 grams per gram of absorptive material. Pre-moistened wipes intended to be used for the cleaning of walls, exterior surfaces, etc. will have a capacity of from about 2 grams to about 10 grams of dry fibrous web.

Since there is no rinsing step in the context of a general purpose pre-moistened wipe, it is essential that the non-volatile content be kept to a minimum to avoid film/streak residue from product. Thus, the actives described herein, such as surfactants, for incorporation in hard surface cleaning compositions are preferably used at even lower levels for best end result. Also, it has been found that compositions consisting of primarily organic hydrophobic cleaning solvents can deliver an excellent end result along with good cleaning in the context of a general purpose pre-moistened wipe for reasons similar to those described in pre-moistened glass wipes. Buffers with molecular weights of less than about 150 g/mole can be used advantageously to improve cleaning without harming end result performance. Examples of preferred buffers include ammonia, methanol amine, ethanol amine, 2-amino-2-methyl-1-propanol, 2-dimethylamino-2-methyl-1-propanol, acetic acid, glycolic acid and the like. Most preferred among these are ammonia, 2-dimethylamino-2-methyl-1-propanol and acetic acid. When used, these buffers are present in from about 0.005% to about 0.5%, with the higher levels being more preferred for the more volatile chemicals. As in the case of glass wipes, the inventors have found that simple compositions using low levels of non-volatile surfactant with preferably high levels of the preferred organic cleaning solvent are sufficient to provide excellent cleaning and wetting performance even in the absence of the hydrophilic polymer. However, the addition of polymer can advantageously be used to provide other benefits such as anti-spotting, antifogging and easier next-time-cleaning.

To provide added convenience general purpose pre-moistened wipes can be attached to a mop head with a handle, an example of which is shown in FIGS. 5, 7, 7*a* and 8, which are described hereinafter. In such an execution the pre-moistened wipe is ideal for light cleaning and disinfecting. Since the amount of solution released from the wipe is much more limited than that delivered through conventional cleaning, very effective anti-microbial systems need to be used. In one such composition the general purpose and floor pre-moistened wipe can contain a solution comprising an effective level of detergent surfactant and citric acid at about 0.5% to about 5%. To boost the efficacy of such solution hydrogen peroxide or a source of hydrogen peroxide can be added at about 0.5% to about 3%. An alternative composition could use quaternary ammonium salts such as dioctyl dimethyl ammonium chloride, didecyl dimethyl ammonium chloride, $C_{12}$, $C_{14}$ and $C_{16}$ dimethyl benzyl ammonium chlorides, at levels greater than about 0.05%. Such compounds have been found to often interfere with the benefits of the preferred polymers. While these solutions (e.g., those comprising sources of hydrogen peroxide, quaternary ammonium compounds and citric acid) deliver a high degree of anti-microbial efficacy they can leave a filmy surface because they are solids and need to be used at high levels.

Better end result performance is delivered by compositions containing primarily the organic cleaning solvents described above at from about 0.25% to about 10%, more preferably about 0.5% to about 5% to provide cleaning and wetting, in combination with non-volatile buffers described above. Low levels of non-volatiles including hydrophilic polymer can advantageously be incorporated such that the total level of non-volatiles excluding perfume and antimicrobials, is from about 0% to about 0.08%, more preferably from about 0% to about 0.055%, most preferably from about 0% to about 0.025%. In a preferred embodiment, the combination of surfactants, wetting polymers, buffers and hydrophobic organic cleaning solvents are chosen so as a provide a surface tension reduction from water (72 dynes/cm) of more than about 25 dynes/cm, more preferably more than 30 dynes/cm, most preferably more than 35 dynes/cm. Optionally, low levels of more effective anti-microbial ingredients such as bronopol, hexitidine sold by Angus chemical (211 Sanders Road, Northbrook, Ill., USA), Kathon®), 2-((hydroxymethyl) (amino)ethanol, propylene glycol, sodium hydroxymethyl amino acetate, formaldehyde, and glutaraldehyde, quaternary ammonium salts such as dioctyl dimethyl ammonium chloride, didecyl dimethyl ammonium chloride, C12, C14 and C16 dimethyl benzyl (Bardac® 2280 and Barquat® MB-80 sold by Lonza), dichloro-s-triazinetrione, trichloro-s-triazinetrione, and more preferably 1,2-benzisothiazolin-3-one sold by Avicia Chemicals, chlorhexidine diacetate sold by Aldrich-Sigma, sodium pyrithione and polyhexamethylene biguanide at about 0.001% to about 0.1%, more preferably from about 0.005% to about 0.05% are added for preserving and/or providing antimicrobial benefits.

An important benefit of the wet wipes of the present invention is the fact that judicious selection of the antimicrobial actives combined with the lack of a rinsing step required by the invention, and lack of a buffing step (consumers are in the habit of cleaning floors and countertops to a wet end result), allow for residual disinfectancy benefits. By residual disinfectancy, it is meant that the residual antimicrobial actives delivered by the wet wipe onto the hard surface at least about 99.9% cidal against bacteria and other microorganisms for a period of from about 8 to about 72 hours, more preferably from about 12 to about 48 hours, most preferably at least about 24 hours. While residual disinfectancy can be achieved using conventional approaches (i.e., spray product with a paper towel, sponge, rag, etc.), the premoistened wipe has the added convenience of delivering the cleaning and disinfectancy benefits in one package. The residual properties result from a combination of low vapor pressure and high cidal efficacy of the antimicrobial actives associated with the compositions of the present invention. Those skilled in the art will recognize that residual disinfectancy benefits, if present in the context of compositions comprising a very low level of surfactant, are even more easily achieved in compositions wherein the level of surfactants is raised. Residual disinfectancy, in addition to excellent end result, can provide consumers with reassurance as to the effectiveness of the wet wipe. Such reassurance is most important for tasks such as cleaning of surfaces that are particularly susceptible to harboring germs, most particularly counter tops, stove tops, appliances, sinks, furniture, showers, glass and other fixtures that are near or inside the kitchen or bathroom(s).

Preferred antimicrobial actives for residual benefits as delivered from a wet wipe or a dry wipe that becomes wet as a result of contact with a wet composition during the cleaning process, include Kathon®, 2-((hydroxymethyl) (amino)ethanol, propylene glycol, sodium hydroxymethyl amino acetate, formaldehyde, and glutaraldehyde, quaternary ammonium salts such as dioctyl dimethyl ammonium chloride, octyl decyl dimethyl ammonium chloride, didecyl dimethyl ammonium chloride, C12, C14 and C16 dimethyl benzyl (Bardac® 2280 and Barquat® MB-80 sold by Lonza), dichloro-s-triazinetrione, trichloro-s-triazinetrione, and more preferably tetrakis(hydroxymethyl) phosphonium sulphate (THPS), 1,2-benzisothiazolin-3-one sold by Avicia Chemicals, chlorhexidine diacetate sold by Aldrich-Sigma, sodium pyrithione and polyhexamethylene biguanide at about 0.001% to about 0.1%, more preferably from about 0.005% to about 0.05%. The specific antimirobial actives and combinations thereof are chosen so as to be effective against specific bacteria, as desired by the formulator. Preferably, the antimicrobial actives are chosen to be effective against gram-positive and gram-negative bacteria, enveloped and non-enveloped viruses, and molds that are commonly present in consumer homes, hotels, restaurants, commercial establishments and hospitals. Most preferably, the antimicrobials provide residual disinfectancy against Salmonella choleraesuis, Pseudomonas aeruginosa, Staphylococcus aureus and Escherichia coli, and combinations thereof. Wherever possible, the antimicrobial actives are chosen to have residual disinfectancy benefits against more than one bacterial organism, and more preferably against at least one gram-negative organism and at least one gram-positive organism.

The inventors have found that residual disinfectancy can also be achieved or enhanced using pH. Additionally, use of low levels of surfactants to reduce surface tension by more than about 25 dynes/cm, preferably more than about 30 dynes/cm, can advantageously be used in combination with pH effects in the context of a pre-moistened wipe. Thus, compositions at a pH 10.5 or greater or a pH of 3 or lower are found to deliver the desired residual efficacy. The preferred hydrophilic, substantive polymer can be used to improve residuality, particularly for voltaile actives such as acetic acid. The use of pH can also help lower the level of the above actives needed to achieve residual. Preferred actives that are effective as a result of pH include lactic acid, glycolic acid, $C_8$, $C_9$, $C_{10}$ fatty acids, sodium hydroxide, potassium hydroxide.

Other suitable pre-moistened cleaning wipes that exhibit antimicrobial effectiveness and residual antimicrobial effectiveness include those disclosed in This approach, i.e., using a combination of hydrophobic organic solvent plus volatile buffer plus optionally low levels of non-volatile raw materials to deliver a superior end result, in combination with effective and low streaking antimicrobials, can be used in a variety of practical applications herein disclosed, including general purpose cleaners, glass cleaners, glass cleaner wipes, solutions used with disposable pads (either with or without a handle to form a cleaning implement as described hereinafter).

Use of low levels of non-volatiles in the compositions of the invention presents a challenge for perfume incorporation. Some methods to improve solubility of perfume are disclosed below. However, in certain instances, particularly when hydrophobic perfumes are desired, perfume incorporation can be problematic. To circumvent this issue, the inventors have advantageously found that perfume delivery can be achieved by directly applying concentrated perfume to either the wipe (or pad). In this manner, virtually any perfume can be used. In order to minimize any residue negatives that can be caused by the concentrated perfume, the perfume is preferentially applied to the perimeter of the wipe or pad, or to areas that do not directly contact the surface to be treated. In another embodiment, perfume can also be added into the package containing the wipes. In similar fashion, use of low levels of non-volatile actives makes incorporation of effective suds suppressors into the aqueous composition more difficult. It has been found that suds suppressors can more easily, and more effectively be applied directly to the wipe to prevent suds control. It is found that this not only addresses a consumer perception of too much sudsing, but surprisingly also has shown an improved end result upon surface drying. Furthermore, it has been found that applying suds suppressor directly onto the wipes makes process a lot easier through better control of suds during manufacturing and packaging. Preferred suds suppressors are those that are effective at levels of no more than about 0.1 grams of suds suppressor per gram of substrate, more preferably at levels less than about 0.01 grams suds suppressor per gram of substrate, most preferably, less than about 0.005 grams suds suppressor per gram of substrate. The most preferred suds suppressor in this context is DC AF, manufactured by the Dow Corning company. The use of suds suppressors to improve surface appearance is particularly significant since these materials are effective at very low levels.

B. Pre-Moistened Cleaning Wipe for Glass

Pre-moistened wipes for use on glass can either be mono-layer or multi-laminate. In the context of mono-laminates, since the surface is not wiped to dryness in the context of a pre-moistened wipe, it is essential that the non-volatile content be kept to a minimum. Thus, the actives described above are preferably used at even lower levels for best end result. Also, it has been found that compositions consisting solely of organic hydrophobic cleaning solvents can deliver an excellent end result along with good cleaning in a pre-moistened wipe. These solvents, as opposed to the aqueous hydrophilic solvents such as ethanol, isopropanol and the like, have been found to provide better and more even surface wetting. This is important as it leads to a more uniform drying, which provides reassurance to consumers that streaks are not going to form. Additionally, while not wishing to be limited by theory, it is believed that in a soiled environment, the hydrophobic organic cleaning solvents will dry with less streaking. For example, in the context of glass wipes current mono-layer glass wipes, e.g., Glassmates manufactured by Reckitt & Colman, which use hydrophilic solvents only (i.e., they lack hydrophobic organic cleaning solvent) dry in spots. In the context of a pre-moistened wipe, the cleaning solvents are employed in a level of from about 0.5% to about 10%, more preferably from about 1% to about 5%. Preferred hydrophobic organic cleaning solvents include mono-propylene glycol propyl ether, mono-propylene glycol butyl ether, mono-ethylene glycol butyl ether and mixtures thereof. Other aqueous hydrophilic solvents such as ethanol, isopropanol, isobutanol, 2-butanol, methoxypropanol and the like,can be used to provide perfume lift. Buffers with molecular weights of less than about 150 g/mole as described above, can be used advantageously to improve cleaning without harming end result performance. Examples of preferred buffers include ammonia, methanol amine, ethanol amine, 2-amino-2-methyl-1-propanol, 2-dimethylamino-2-methyl-1-propanol, acetic acid, glycolic acid and the like. Most preferred among these are ammonia, 2-dimethylamino-2-methyl-1-propanol and acetic acid. When used, these buffers are present in from about 0.005% to about 0.5%, with the higher levels being more preferred for the more volatile chemicals. In the context of glass wipes, simple compositions using low levels of non-volatile surfactant with preferably high levels of the preferred organic cleaning solvent are sufficient to provide excellent cleaning and wetting performance even in the absence of the hydrophilic polymer. However, the addition of polymer can advantageously be used to provide other benefits such as anti-spotting, antifogging and easier next-time-cleaning.

The art recognizes the use of pre-moistened wipes. For example, U.S. Pat. No. 4,276,338 discloses a multi-laminate absorbent article comprising adjacent first and second layers maintained together to improve wicking. U.S. Pat. No. 4,178,407 discloses a single towel having absorbent surface on both sides that additionally comprises an inner layer impermeable to liquid. The towel is designed to have little wet strength and the layer of absorbent material consists of loose fibers. The art also discloses pre-moistened wipes for use in glass cleaner applications. U.S. Pat. No. 4,448,704 discloses an article suitable for cleaning hard surfaces such as glass. The article may be wet or consist of present within ruptural pouches. The article of U.S. Pat. No. 4,448,704 is pre-washed with demineralized water or the solution used to impregnate said article; the liquid composition has a surface tension of less than 35 dynes/cm, and preferably includes a surface-active agent and a partially esterified resin such as a partially esterified styrene/maleic anhydride copolymer. All of said patents are incorporated herein by reference.

The pre-moistened wipes of the present invention advantageously are not pre-washed, yet the inventors have found that they deliver excellent end result even as single layered sheets. An additional benefit of the premoistened glass wipes is to keep Tinting at a minimum. Steps such as pre-washing typically loosens up fibers, making the substrate more prone to linting. In the context of hydroentangled structures specifically, the tightness of the fiber integration is optimally achieved in processing of the fibrous materials, not during the making or preparation of the pre-moistened wipe. As a result, preferred compositions of the present invention display improved linting. Additionally, the liquid composition used on the pre-moistened wipes is preferably substantially free of surface active agents. As such, the surface tension of the liquid does not need to reduce surface tension below 35 dynes/cm. In the context of a multi-layered sheet of the present invention has two sides that differ in function. One side is pre-moistened and acts to deliver the liquid while the other is preferably not wet and is designed for buffing or finishing.

In the context of glass and other cleaning situations where lower levels of liquid are required to reduce amount of liquids left on surfaces and grease cleaning efficacy is required, a preferred embodiment includes a dry fibrous web substrate where at least about 65% of the dry fibrous web is composed of hydrophobic fibers such as polyester, polypropylene, polyethylene and the like, and lower levels of hydrophilic fibers such as wood pulp, cotton, and the like are at levels of less than about 35%. The lower level of hydrophilic fibers helps reduce how much liquid the wipe can retain while the higher level of hydrophobic fibers helps to better absorb grease. Aside from benefits associated with improved grease cleaning, the inventors have found that hydrophobic fibers also improve the feel of the wipe on glass and other hard surfaces, providing an easier cleaning feel to both the consumer and to the surface being treated. This improved ease-of-cleaning, lubricity, or "glide" can be experimentally quantified by friction measurements on relevant hard surfaces. Improved glide from the wipe provides additional freedom in the formulation of the liquid composition. Hydrophobic fibers provide glide benefits whether the wipe is completely pre-moistened and when the wipe is completely dry. This is significant since wipes become increasingly dry as they are used. Thus, the level of $C_{14}$ or higher chainlength surfactants which are known to provide lubricity benefits can be substantially reduced or preferably altogether eliminated from the liquid composition used in the pre-moistened wipe while still preserving excellent glide (low friction) characteristics. The use of wipes comprising some level of hydrophobic fibers, particularly polyester, also provides increased flexibility in formulating pre-moistened wipes for glass at acidic pH. It has been found that acidic cleaning compositions significantly hinder the glide of cellulosic substrates such as common paper towels or cellulosic pre-moistened wipes.

In addition to using material composition wipe dimension can also be used to control dosing as well as provide ergonomic appeal. Preferred wipe dimensions are from about 5½ inches to about 9 inches in length, and from about 5½ inches to about 9 inches in width to comfortably fit in a hand. As such, the wipe preferably has dimensions such that the length and width differ by no more than about 2 inches. In the context of heavier soil cleaning, wipes are preferably bigger so that they can used and then folded, either once or twice, so as to contain dirt within the inside of the fold and then the wipe can be re-used. For this application, the wipe has a length from about 5½ inches to about 13 inches and a width from about 10 inches to about 13 inches. As such, the wipe can be folded once or twice and still fit comfortably in the hand.

In addition to having wipes prepared using a mono-layer substrate, it is advantageous in some situations to have the pre-moistened wipe constructed having multiple layers. In a preferred embodiment, the wipe consists of a multi-laminate structure comprising a pre-moistened outer layer, an impermeable film or membrane inner layer and second outer-layer which is substantially dry. To improve the wet capacity of the wipe and to protect the back layer from getting prematurely wet, an optional absorbent reservoir can be placed between the pre-moistened first outer-layer and the impermeable film or membrane. Preferably, the dimensions of the reservoir are smaller than the dimensions of the two outer layers to prevent liquid wicking from the front layer onto the back layer.

The use of a multi-laminate structure as herein described can be highly desirable in that it allows for a dry buffing step, aimed at substantially removing most of the liquid remaining on the glass following application of the wet side of the pre-moistened wipe on the glass. The inventors have found that even with a buffing step, hydrophilic polymer in the pre-moistened wipe, if present, remains on the glass providing anti-fog properties to the glass. The buffing step also provides improved overall flexibility in the level of solids used in the liquid composition because most of the solids are wiped up together with the remainder of the aqueous composition during the buffing step. In fact, those skilled in the art can recognize that it can be advantageous to use very low levels, preferably less than about 0.02%, water-soluble though crystalline surfactants because of improved propensity for dry the substrate to remove such crystalline solids from the glass surface.

The multi-laminate structure is further advantageously used in the context of heavier soiled situations, such as those encountered on outside windows or car glass. By allowing use of a fresh, clean surface for buffing, the multi-laminate structure reduces the amount of dirty liquid pushed around by the pre-moistened wipe.

When a multi-laminate structure is used, it is preferred that the outer pre-moistened layer contain at least about 30% hydrophobic fibers for oil remove and glide. The impermeable inner layer is most preferably polyethylene, polypropylene or mixtures thereof. The composition mixture and thickness of the impermeable layer is chosen so as to minimize, or more preferably eliminate any seepage of liquid from the pre-moistened first outer-layer to the dry second outer-layer. Those skilled in the art will appreciate that use of a reservoir core or of a high fluid capacity pre-moistened outer-layer will test the impermeable layer, such that more than one impermeable layer can be required to ensure sufficient dryness for the second outer-layer of the wipe. The reservoir, if present, will preferably consist of treated or untreated cellulose, either as a stand alone material or as a hybrid with hydrophobic fibers. The hydrophobic content of the reservoir layer is preferably less than about 30%, more preferably less than about 20% by weight of the total fiber content of the layer. In a preferred embodiment, the reservoir consists of air-laid cellulose. The second outer-layer, which is substantially dry to the touch, preferably consists of high absorbency cellulose or blends of cellulose and synthetic fibers.

The inventors have recognized that packing of the wipes that contain a pre-moistened side and a dry side can be challenging. To resolve this packing issue, a preferred folding scheme has been developed. The wipes are folded in either halves, thirds or in other other suitable way such that all of the pre-moistened sides of each of the wipes are folded inward and into each other. As a result, all of the outer dry layers of successive wipes piled into a pouch, container or box, do directly contact any pre-moistened wipe sides. By "directly contact", it is meant that all of the pre-moistened sides of the wipes are separated from dry sides by a liquid impermeable layer. By packing the wipes in such a preferred manner, it is ensured that the dry sides of the wipes do not become contaminated with liquid during storage in the wipes container and prior to use. The packing material can be made of any suitable material, including plastic or cellophane. Optionally, another means to further address potential liquid wicking into the buffing layer, is by simply adding superabsorbent polymer into the buffing layer or between the impermeable layer and the buffing layer.

In a preferred embodiment, a starter kit comprises a sturdy box or other receptacle capable of holding from about eight to about twenty four wipes which have been folded at least once, and lower cost packages capable of holding from about five to about twelve wipes are used as refill packages.

Importantly, the pre-moistened wipe can be used as a stand-alone or in conjunction with an implement comprising a handle and attachment device for the wipe. As used herein, implement signifies any physical means for attachment of substrate, such as pad, dry wipe pre-moistened wipe, and the like. Optionally, but preferably, the pre-moistened wipe includes one or more preservatives so as to ensure fungistatic benefits. Examples of preservatives to be used in association with the pre-moistened wipes of the invention include methyl paraben, bronopol, hexetidine, dichloro-s-triazinetrione, trichloro-s-triazinetrione, and quaternary ammonium salts including dioctyl dimethyl ammonium chloride, didecyl dimethyl ammonium chloride, C12, C14 and C16 dimethyl benzyl (Bardac® 2280 and Barquat® MB-80 sold by Lonza), and the like at concentrations below about 0.02%. Preferred preservatives include citric acid, tetrakis (hydroxymethyl phosphonium sulfate (THPS), sodium pyrithione, Kathon® and 1,2-benzisothiazolin-3-one sold by Avicia Chemicals. The preservatives, if used, are in concentrations from about 0.001% to about 0.05%, more preferably from about 0.005% to about 0.02%. Alternatively, preservation can be achieved using product pH, by making the pH of the aqueous lotion squeezed out of the premoistened wipe either greater than about 10.5 or less than about 3.0. Preferred pH-based preservatives include those which are highly volatile such as ammonia (for high pH) and acetic acid (for low pH). When pH-based preservatives are used, particularly when volatile preservatives are used, the concentration of the preservative can be substantially higher than 0.02%. The use of wipes comprising hydrophobic fibers provides sufficient glide on the surface so as to even allow the use of acidic preservation agents. Additionally, a combination of preservatives can be used to achieve the desired preservation benefits. In any event, the preservative(s) can either be applied directly onto the wipe prior to the solution, or alternatively dispersed into the solution prior to moistening the wipe.

Alternatively, it can be beneficial to incorporate antimicrobials directly into the substrate. In this context, it is preferred to use highly water-insoluble antimicrobial actives such as those derived from heavy metals. Examples of insoluble antimicrobials include zinc pyrithione, bismuth pyrithione, copper naphthenate, copper hydroxy quinoline, and the like. Other examples of actives, which do not use heavy metals, include dichloro-s-triazinetrione and trichloro-s-triazinetrione.

V. Cleaning Implement

Figure 6:
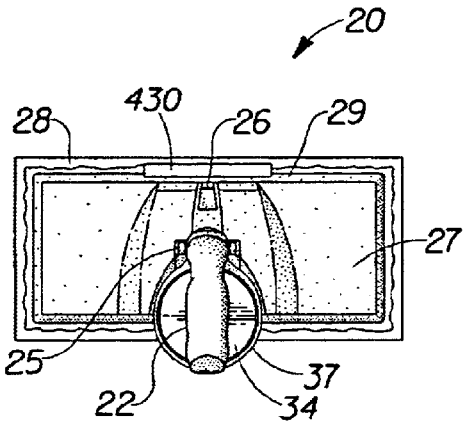
FIG. 6 is a top view of the cleaning implement of FIG. 5.
Figure 5:
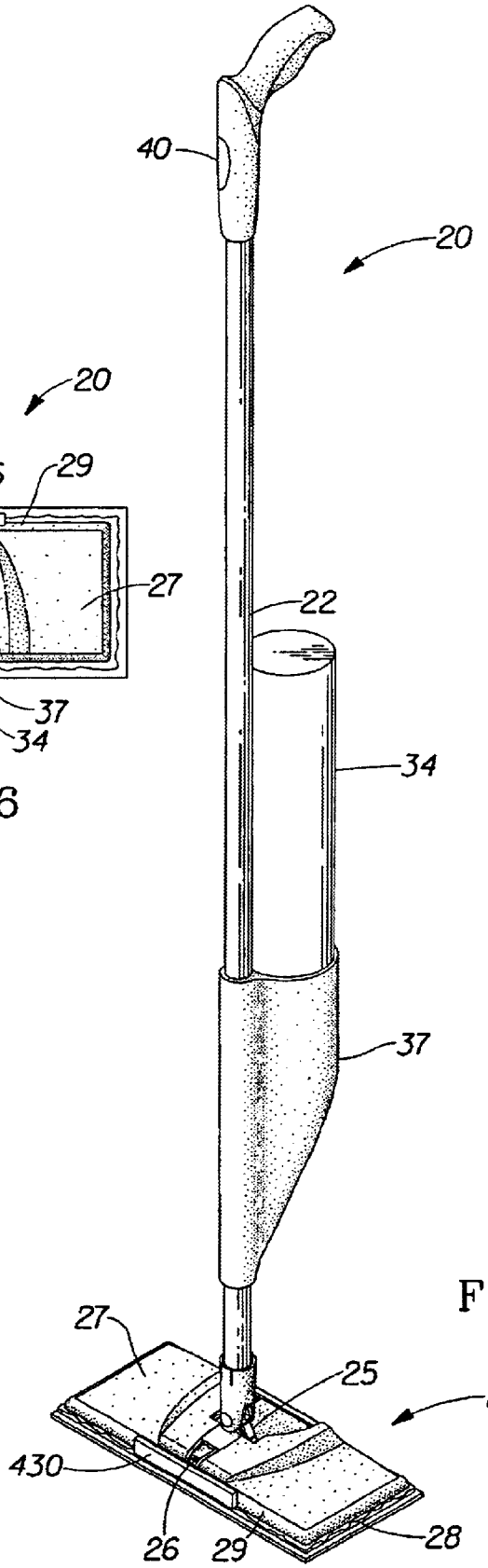
FIG. 5 is a perspective view of a preferred cleaning implement made in accordance with the present invention.
Figure 7A:
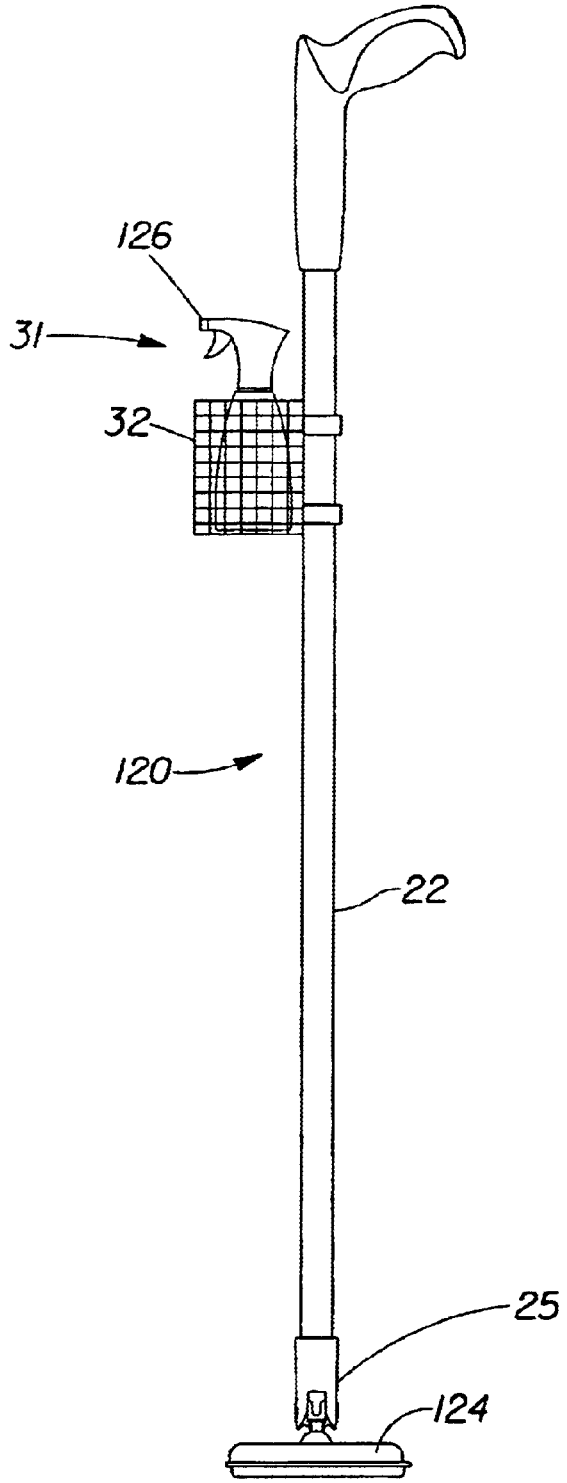
FIG. 7*a* is a side view of yet another preferred cleaning implement made in accordance with the present invention, wherein the cleaning implement comprises a handle, mop head, and a hand-held sprayer stored within a cage having a sleeve.
Figure 7B:
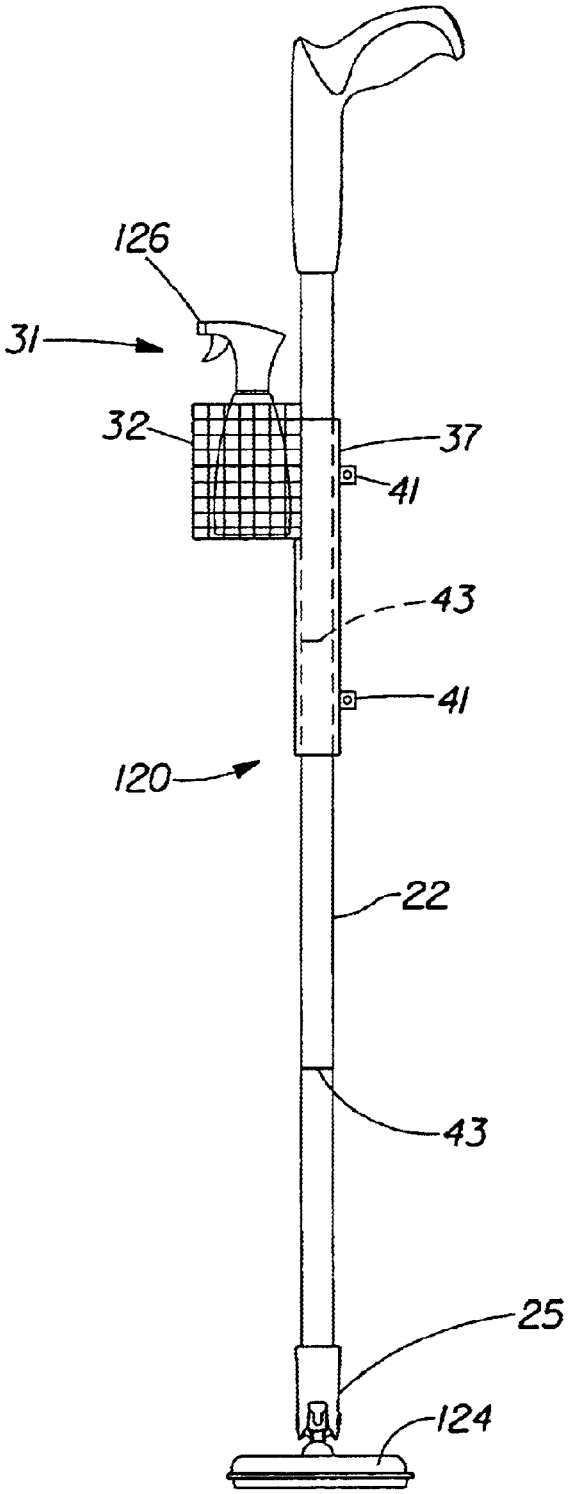
FIG. 7 is a side view of another preferred cleaning implement made in accordance with the present invention, wherein the cleaning implement comprises a handle, mop head, and a hand-held sprayer stored within a cage.

Referring to FIGS. 5 and 6, an exemplary cleaning implement in the form of a mop 20 made in accordance with one aspect of the present invention is illustrated. The mop 20 comprises a handle 22, a support head or mop head 24 attached to the handle by a universal joint 25, and a liquid delivery system which includes at least a spray nozzle 26 preferably attached to the mop head 24, one such arrangement being described in U.S. Pat. No. 5,888,006 to Ping et al., issued Mar. 30, 1999, the substance of which is hereby fully incorporated herein by reference. The spray nozzle 26 is more preferably attached to the upper surface 27 of the mop head 24, adjacent to its leading edge 29. In this way, the sprayer nozzle 26 moves in the direction of the mop head 24 when the mop 20 is maneuvered. Due to the force which is applied through the handle 22 when the mop 20 is maneuvered for mopping, scrubbing, and the like by a user, the mop handle preferably has a Handle Deflection of less than about 15 mm, when measured according to the Handle Deflection Test Method described hereafter, and preferably has a deflection less than about 9 mm. More preferably the handle 22 has a Handle Deflection of less than about 0.4 mm. While the spray nozzle is preferably attached independent of the handle 22 for directional control of the spray nozzle 26, it will be appreciated that the spray nozzle can be attached at locations other than the mop head 24. For example, the spray nozzle 26 can be attached to the universal joint 25 or the handle 22. In addition, a cleaning liquid can be applied by a spray nozzle which is not attached to the mop 20. For instance, as shown in FIG. 7, a mop 120 comprises a handle 22 attached to a mop head 124 by a universal joint 25 and a manually operated, hand-held liquid sprayer 31 having a container storing the cleaning solution, or, alternatively, a self contained electrical, hand-held liquid sprayer 31 can be provided, both hand-held liquid sprayers having a spray nozzle 126. The hand-held liquid sprayers 31 are preferably selected to provide enough cleaning liquid 35 per actuation of the sprayer to cover an adequate area of the surface to be cleaned with a minimal number actuations for user friendliness and to minimize hand fatigue. Low volume hand-held liquid sprayers typically dispense at least about 1 mil of liquid per actuation and high volume hand-held liquid sprayers typically dispense at least about 2 mils per actuation. More preferably, a low volume hand-held liquid sprayer dispenses between about 1 mil and about 2 mils per actuation and a high volume hand-held liquid spray dispenses between about 2 mils per actuation and about 5 mils per actuation. An exemplary low volume manually operated hand-held liquid sprayer suitable for use with the present invention is model no. T8500 manufactured by Indesco, Inc. of Saint Peters, Mich. An exemplary high volume manually operated hand-held liquid sprayer suitable for use with the present invention is model no. 813N manufactured by Indesco, Inc. of Saint Peters, Mich. An exemplary electric hand-held liquid sprayer suitable for use with the present invention is model no. 460PH manufactured by Solo, Inc, of Newport News, Va. The hand-held liquid sprayer 31 is preferably stored in a cage 32 which is attached to the handle 22. As shown in FIG. 7A, the cage 32 can further include a sleeve 37 with one or more screw type clamps 41 for securing the cage 32 about the handle 22. As will be appreciated, other types of mechanical fasteners known in the art can be used to secure the cage 32 to the handle 22. Further, other structures for releaseably securing the hand-held liquid sprayer to the mop 120 can be employed. For example, a shelf having an opening for receiving the sprayer could be used. The sleeve 37 can advantageously strengthen the handle 22, especially where the handle 22 comprises one or more joints 43 and the sleeve 37 extends over a joint 43.

The cleaning implements made in accordance with the present invention (e.g., mop 20 and 120) use a removably attached cleaning substrate 28 for absorbing the cleaning liquid and particulates from the surface to be cleaned. The cleaning substrate 28 can be provided in one or more forms, such as a liquid absorbent pad (e.g., as described hereinbefore in Section III), a cleaning sheet for dusting (e.g., as described hereinbefore in Section III), or a liquid pre-moistened wipe (e.g., as described hereinbefore in Section IV), etc. Optionally, a scrubbing strip 430 (FIGS. 5 and 6) can be adhesively attached adjacent to the leading edge 29 of a mop in combination with a cleaning substrate 28. The scrubbing strip 430 can be provided in a form as previously discussed in Section III(G). In this context, the cleaning substrate 28 can remain attached to the mop. When scrubbing is required, a user of the mop would simply turn the mop around 90 degrees, place the mop head 24 in an upright position such that the leading edge 29 is contacting the floor. A further alternative to placing the scrubbing strip 430 adjacent the leading edge 29 is to place the scrubbing strip adjacent a side edge of the mop head 24. Again, the mop is turned 90 degrees and the mop head 24 is adjusted to an upright position to achieve scrubbing. The cleaning substrate 28 can be mechanically attached in a variety ways to mop head 24. For example, hook fasteners which are molded onto the lower surface of the mop head 24 can be used in combination with loop fasteners attached to the cleaning fabric 28. As shown in FIG. 8, the upper surface 27 the mop head 24 can further comprise a plurality of attachment structures 33 for attaching the cleaning substrate 28 to the mop head 24. The attachment structures 33 can be provided in the form of those described in U.S. patent application Ser. No. 09/374,714 entitled CLEANING IMPLEMENTS HAVING STRUCTURES FOR RETAINING A SHEET, filed Aug. 13, 1999, the substance of which is fully incorporated herein by reference. Alternatively, other attachment structures known in the art might be used. For example, other flexible slitted structures might be used.

In accordance with another aspect of the present invention, a kit can be provided which comprises the cage 32 and the container storing a cleaning liquid which is adapted for use with the hand-held liquid sprayer 126. Further, the kit can optionally contain one more cleaning substrates 28. The kit can further include the mop 120 and the remaining structures for a complete hand-held liquid sprayer (e.g., a sprayer head having the spray nozzle 126). A set of instructions can be provided in association with the kit, or with another article of manufactures (e.g., a package comprising merely the sprayer 126), which comprise an instruction, that for a unit area (e.g., every 1 $m^2$), apply a liquid over the unit area, preferably evenly, before mopping. Depending upon the liquid delivered per stroke of the hand-held liquid sprayer, the set of instructions can further include one or more instructions directed to applying a select volume of liquid (e.g., between about 10 to 25 mls per square meter of surface area to be cleaned) per unit area of surface followed by an instruction to move the mop in a predetermined motion (e.g., up and/or down and/or in an overlapping motion).

Figure 9:
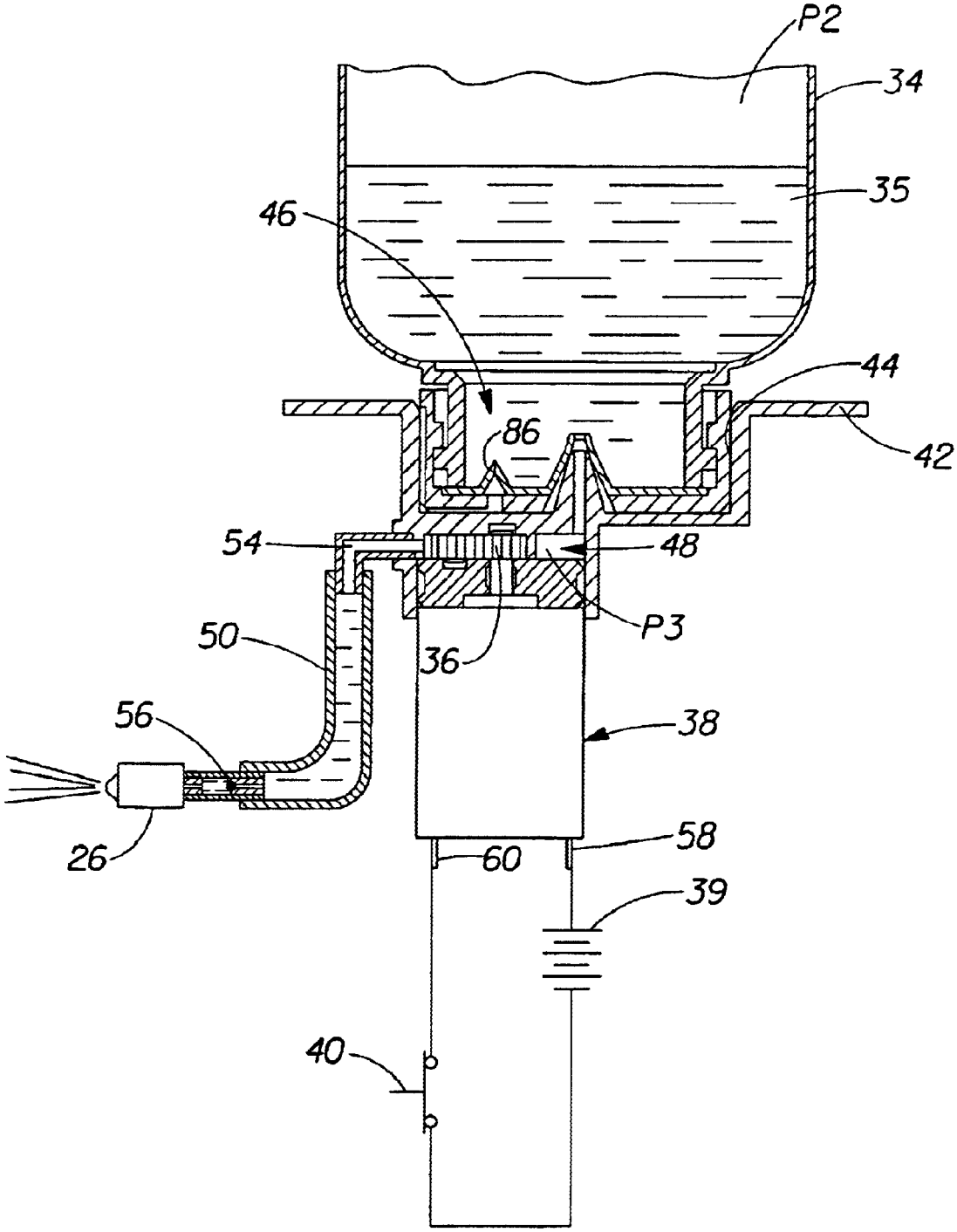
FIG. 9 is a schematic illustration of a liquid delivery system suitable for use with the cleaning implement of FIG. 5.

Referring to FIG. 9, the liquid delivery system further includes a canister 34 storing a liquid 35 and a gear pump 36 which is driven by an electric motor 38. The liquid can be any type of liquid, although preferably the liquid 35 is a hard surface cleaning composition as described in Section II hereinbefore. A canister housing 37 (FIGS. 5 and 9) attached to the handle 22 removably receives the canister 34. The canister housing 37 houses the gear pump 36, the electric motor 38, and a voltage source 39 which is used to power the electric motor 38. The voltage source 39 is connected in series with a switch 40 attached to the handle 22. As described more fully hereafter, the characteristics of the spray nozzle (e.g., the quantity, trajectory, particle size, spray angle, etc.) and/or the balance of the liquid delivery system (e.g., the voltage characteristics, pump and motor efficiencies, pump input and output, etc.) are configured to provide a mop 20 which provides maximum cleaning effectiveness in a user friendly implement. While the pump 36 is preferably provided in the form of a gear pump, other pumps and structures for pressurizing the liquid 35 to deliver the liquid to the spray nozzle 26 can be used. For example, vane, piston, lobe, or diaphragm pumps would be acceptable for use. In addition, aerosols and other compressed gas delivery systems can be used in place of an electric or manually driven pump. The gear pump 36 is attached to a pump housing 42 disposed within the canister housing 37. The pump housing 42 also has a recessed portion 44 for receiving the canister 34. A fluid transfer fitment 46, such as that described in U.S. patent application Ser. No. 09/188,604 entitled INTEGRATED VENT AND FLUID TRANSFER FITMENT, filed Nov. 9, 1998, the substance of which is hereby fully incorporated herein by reference, is disposed within the recessed portion 44. The fluid transfer fitment 46 interfaces with the canister 34 to transfer the liquid 35 from the canister 34 to the inlet 48 of the gear pump 36. The canister 34 has a closure [62] which preferably includes a venting arrangement such as that described in U.S. patent application Ser. No. 09/188,604.

A flexible fluid line 50 is connected to the pump outlet 54, which directs the liquid 35 from the pump outlet 54 to the spray nozzle 26. A discharge check valve 56 is located adjacent to and immediately upstream of the spray nozzle 26. The check valve 56 may be a spring loaded ball valve or other type of check valve commonly known in the art. The purpose of the check valve 56 is to limit dribbling of liquid 35 from the spray nozzle 26. As discussed more fully hereafter, the cracking pressure of the check valve 56 should be sufficient so that the liquid entering the spray nozzle 26 has sufficient energy to drive the fluid through the spray nozzle 26 and break the fluid up into fine droplets.

The electric motor 38 is preferably a direct current electric motor. The electric motor 38 has two electrical connections 58 and 60 to which is preferably connected the voltage source 39, which can be provided in the form of a plurality of batteries. When the switch 40 is closed, as shown in FIG. 9, a current flows through the electric motor 38 which rotates the gears of the pump 36 to generate a pressure sufficient to open the check valve 56 so that the liquid 35 can flow through the spray nozzle 26. An exemplary motor is a 3 volt to 6 volt series 200 or 300 motor manufactured by Mabuchi Industry Company, Ltd. of China while an exemplary spray nozzle is manufactured by Bowles Fluidics Corporation of Columbia, Mo. This exemplary spray nozzle is more fully described in one or more of U.S. Pat. No. 4,508,206 to Stouffer, issued Apr. 2, 1985; U.S. Pat. No. 5,788,394 to Hess et al., issued Aug. 4, 1998; and U.S. Pat. No. 5,860,603 to Raghu et al., issued Jan. 19, 1999, the substances of which are fully incorporated herein by reference. The handle 22, canister housing 37, mop head 24, universal joint 25, and pump gears can be injection molded using thermoplastic materials as is known in the art. Preferably, the canister housing 37 and mop head 24 are formed from polypropylene, the universal joint 25 is formed from DELRIN, and the pump gears are formed from an Acetal co-polymer. The handle 22 can be formed from aluminum by extrusion. The voltage source 39 is preferably four AA, 1.5 volt Panasonic Alkaline Plus batteries which are connected in series.

Figure 10:
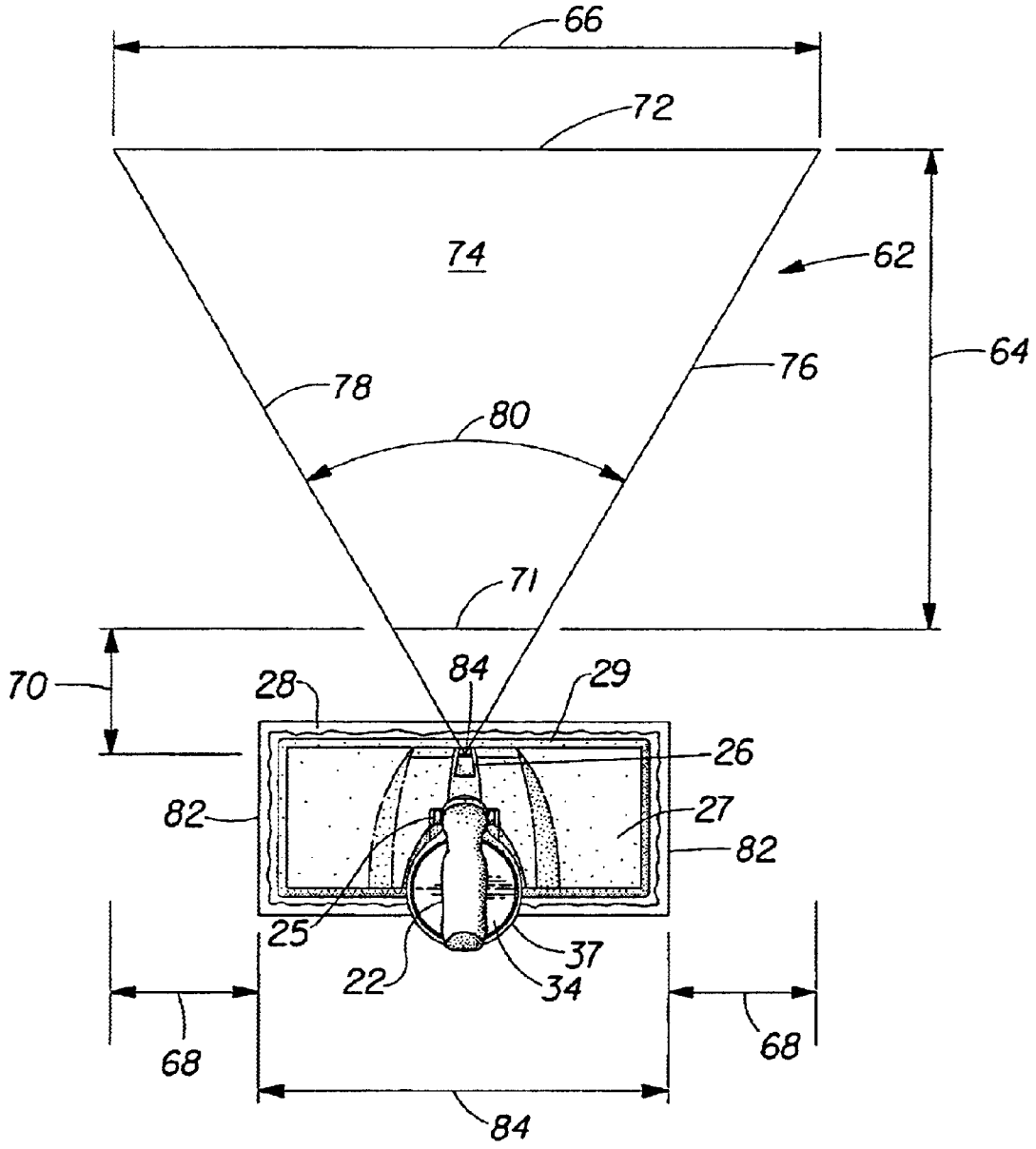
FIG. 10 is an illustration of a spray pattern from the cleaning implement of FIG. 5.

Referring to FIG. 10, the spray nozzle 26 and the other various components of the liquid delivery system are selected to provide a spray pattern 62 having dimensions and one or more spray efficiencies which facilitate effective cleaning with the mop 20. As used herein, the phrase "spray pattern" is intended to refer to the shape and dimensions of the liquid surface deposition pattern at any given set of operating conditions (e.g., volumetric flow rate, inlet pressure to the spray nozzle, etc.). As used herein, the phrase "spray efficiency" can refer to any one of three spray efficiency parameters. First, the Rated Spray Efficiency which is intended to refer to a volumetric flow rate of the liquid 35 through a spray nozzle per unit area of the spray pattern. Second, T1200 Absorbent Capacity Spray Efficiency which is intended to refer to a volumetric flow rate of the liquid 35 through a spray nozzle per unit area of the spray pattern and per unit $T_{1200}$ absorbent capacity of a cleaning substrate 28 which interacts with the sprayed liquid 35 during the cleaning process. Third, Squeeze Out Spray Efficiency which is intended to refer to a volumetric flow rate of the liquid 35 through a spray nozzle per unit area of the spray pattern and per unit squeeze out of a substrate 25 which interacts with the sprayed liquid 35 during the cleaning process. T1200 Absorbent Capacity and Squeeze Out are more fully described in Sections III (I), VIII(A), VIII(B) herein. In other words, the spray efficiency can be expressed in units of either mils/(sec×$cm^2$), mils/(sec×$cm^2$×g/g), or mils/(sec×$cm^2$×% squeeze out/100). The various spray efficiencies are intended to be measures of the cleaning effectiveness of both the liquid delivery system itself and the combination of the liquid delivery system and the cleaning substrate 28.

Not intending to be bound by any theory, it is believed that the selection of an appropriate spray pattern and/or spray efficiency of the liquid delivery system for a cleaning implement can be useful for delivering effective cleaning and/or doing so in a user friendly manner. It is further believed that improved cleaning performance can be achieved when a specific volume of cleaning liquid is applied over a relatively large area. By applying a specific volume of cleaning liquid over a relatively larger area, the cleaning liquid typically will have a greater residence time on the surface to be cleaned which facilitates loosening and suspension of soil and other particulates before cleaning liquid is absorbed by cleaning substrate. Furthermore, when the cleaning substrate has high absorbent capacity as determined by T1200 absorbent capacity methods herein and/or a low squeeze-out as determined by the test methods herein, covering a relatively larger surface area of floor as compared to a smaller area with the same volume cleaning liquid can be more desirable, because if said volume of cleaning liquid is dispensed in too small of an area, the cleaning substrate might absorb a large portion of the cleaning liquid prematurely before a user has a chance to effectively mop an adequate amount of surface area. This can lead to user convenience problems as a user of the mop might be forced to stop mopping more often than desired to apply additional cleaning liquid. Alternatively, a user might get inconsistent cleaning results between areas where there was adequate liquid coverage versus areas with inadequate coverage from wiping a partially wet or even dry floor. While it is preferred that the liquid delivery system provides a spray pattern which is larger rather than smaller, a spray pattern that covers too large of an area can create other problems. For example, if the spray pattern is too large, a user may not be able to reach all of the floor area saturated with the cleaning liquid with the cleaning implement without stepping into the spray pattern area. Additionally, a spray pattern which is too wide could make it difficult to conveniently cleanin more confined situations (e.g., in a bathroom) without depositing cleaning liquid on undesired surfaces such as walls and the like. In fact this is an example of where a smaller spray pattern could actually be preferred. If the smaller spray pattern is desired, the cleaning substrate could be provided with a relatively lower T1200 absorbent capacity and/or a relatively higher squeeze-out to minimize premature absorption of the cleaning liquid.

In order to achieve the desired spray patterns and spray efficiencies, the liquid delivery system can be configured to provide the desired spray pattern and/or spray efficiencies or a user can be instructed to maneuver the mop in a particular manner. A preferred set of instructions can be provided in association with an article of manufacture, such as a package, for cleaning implements having liquid delivery systems which produce a relatively small spray pattern (e.g., less than about 0.1 $m^2$), wherein an instruction is provided to actuate the liquid delivery system for a predetermined amount of time for a predetermined surface area to be cleaned (e.g., for about every 1 m2 apply the cleaning liquid by actuating the liquid delivery system for between about 2 seconds and about 8 seconds) by sweeping the cleaning implement from side-to-side with the cleaning implement lifted above the surface to be cleaned. Alternatively or in addition to the previous instruction, another instruction could instruct the user of the cleaning implement to move the cleaning implement in an up and down motion and/or in an overlapping motion while it is lifted above the surface to be cleaned. Either of the previously described instructions can be implemented with the nozzle pointed in a downward direction toward the surface to be cleaned. Another preferred set of instructions can be provided in association with an article of manufacture, such as a package, for cleaning implements having liquid delivery systems which produce a relatively large spray pattern (e.g., between about 0.1 $m^2$ and about 0.4 $m^2$), wherein an instruction is provided to actuate the liquid delivery system for a predetermined amount of time for a predetermined surface area to be cleaned (e.g., for about every 1 $m^2$ apply the cleaning liquid by actuating the liquid delivery system for between about 2 seconds and about 8 seconds) by moving the cleaning implement on the floor in a predetermined motion (e.g., up and down, side to side, or in an overlapping motion).

An alternative approach is to provide a spray pattern that can be adjusted by a user of the cleaning implement to be larger or smaller depending upon the surface to be cleaned and/or the surrounding structures which must be cleaned around.

As shown in FIG. 10, the spray pattern 62 (the phrase "spray pattern" is intended to refer to the pattern generated by a single nozzle 26) has a spray depth 64, a spray width 66, a mop head overspray 68, and a spray gap 70. As used herein, the phrase "spray depth" is intended to refer to the distance from line 71, which is where less than 0.1 mils±0.05 mils of the sprayed liquid is first deposited on a surface to be cleaned, to the line 72 such that 90% ±2% of the liquid sprayed by the spray nozzle 26 is within the area 74 bounded by the spray angle lines 76 and 78 and the lines 71 and 72. The spray angle lines 76 and 78 are defined by the spray angle 80 of the spray nozzle 26. The phrase "spray angle" is intended to refer to the angle 80 between the lines 76 and 78 such that 95% ±2% of the liquid sprayed by the nozzle 26 falls within the open ended triangle formed by the lines 76 and 78. As used herein, the phrase "mop head overspray" is intended to refer to the distance which the spray pattern 62 extends beyond the side edges 82 of the cleaning substrate 28. As used herein, the phrase "spray gap" is intended to refer to the distance from the exit plane 84 of the spray nozzle 26 to the line 71 where 0.1 mils±0.05 mils of the first liquid deposition occurs. Table 1 sets forth the spray pattern dimensions which are preferred in order to provide previously described user and cleaning benefits. The dimensions set forth in Tables 1 and 2 are intended to refer to spray pattern dimensions at any operating condition of the liquid delivery system of a cleaning implement. More preferably, the spray pattern dimensions of Tables 1 and 2 are intended to refer the dimensions generated by a liquid delivery at both its maximum intended spray nozzle inlet pressure and maximum spray nozzle volumetric flow rate during normal use. As used herein, the phrase "spray nozzle inlet pressure" is intended to refer to the gage pressure at either the spray nozzle inlet or, if a check valve is provided immeadiately upstream of the spray nozzle, to the gage pressure at the inlet to the check valve. Most preferably, the spray pattern dimensions of Tables 1 and 2 are intended to refer to the dimensions generated by a liquid delivery system comprising a spray nozzle, a pump, an electric motor, a check valve, and a battery voltage source, wherein the spray pattern dimensions are generated at the maximum intended voltage of the battery voltage source during normal use. As used herein, the phrase "maximum intended voltage" is intended to refer to the voltage across electric motor terminals 58 and 60 when the voltage source is fully charged. Exemplary ranges for the above-described pressure, flow rate, and voltage operating conditions are discussed in further detail hereafter.

TABLE 1

| | Depth 64 | Width 66 | Mop Head Overspray 68 | Spray Gap 70 |
|---|---|---|---|---|
| Preferred Range | At least about 20 cm | At least about 20 cm | At least about 0 cm | At least about 0 cm |
| More Preferred Range | Between about 20 cm and about 90 cm | Between about 20 cm and about 90 cm | Between about 0 cm and about 30 cm | Between about 0 cm and about 30 cm |
| Most Preferred Range | Between about 30 cm and about 60 cm | Between about 30 cm and about 60 cm | Between about 0 cm and about 15 cm | Between about 5 cm and about 15 cm |

Table 2 sets forth the preferred spray pattern dimensions of Table 1 as a percentage of the spray pattern dimension divided by the width 84 of the cleaning substrate 28.

TABLE 2

| | Depth 64 | Width 66 |
|---|---|---|
| Preferred Range | At least about 60% | At least about 60% |
| More Preferred Range | Between about 60% and about 300% | Between about 60% and about 300% |
| Most Preferred Range | Between about 100% and about 200% | Between about 100% and about 200% |

The T1200 Absorbent Capacity Spray Efficiency of the mop 20 is at least about 0.000006 mils/(sec×cm$^2$×g/g) and preferably is between about 0.000006 mils/(sec×cm$^2$×g/g) and about 0.01 mils/(sec×cm$^2$×g/g). More preferably, the T1200 Absorbent Capacity Spray Efficiency of the mop 20 is between about 0.0003 mils/(sec×cm$^2$×g/g) and about 0.0004 mils/(sec×cm$^2$×g/g). The Squeeze Out Spray Efficiency of the mop 20 is at least about 0.0006 mils/(sec×cm$^2$×(per unit Squeeze Out)) and preferably is between about 0.0006 mils/(sec×cm$^2$×(per unit Squeeze Out)) and about 1 mils/(sec×cm$^2$×(per unit Squeeze Out)), wherein per unit Squeeze Out is (%Squeeze Out)/100. More preferably, the Squeeze Out Spray Efficiency of the mop 20 is between about 0.05 mils/(sec×cm$^2$×(per unit Squeeze Out)) and about 0.01 mils/(sec×cm$^2$×(per unit Squeeze Out)). The Rated Spray Efficiency is at least about 0.0002 mils/(sec×cm$^2$) and more preferably is between about 0.0002 mils/(sec×cm$^2$) about 0.02 mils/(sec×cm$^2$). More preferably, the Rated Spray Efficiency is between about 0.001 mils/(sec×cm$^2$) and about 0.002 mils/(sec×cm$^2$).

While the spray pattern 62 has been described herein according the absolute and relative dimensions of the spray pattern 62, the spray pattern 62 can also be characterized according to exit conditions at the spray nozzle 26, in particular the average exit velocity, spray angle, and average drop size of the spray exiting the spray nozzle 26. As used herein, the phrase "average exit velocity" is intended to refer to the velocity of the liquid spray at the exit plane 84 of the spray nozzle 26, which is equal to the volumetric flow rate of the liquid divided by the exit area of the spray nozzle 26. The average exit velocity of the nozzle 26 is at least about 0.009 cm/sec and more preferably is between about 0.009 cm/sec and about 0.9 cm/sec. Most preferably, the average exit velocity is between about 0.01 cm/sec and about 0.02 cm/sec. These preferred average exit velocity ranges are further preferably combined with a spray nozzle 26 having a spray angle 80 of at least about 30 degrees and/or an average liquid particle size of at least about 100 $\mu$m and more preferably with a spray angle 80 between about 30 degrees and about 120 degrees and/or an average liquid particle size of between about 100 $\mu$m and about 3050 $\mu$m. Most preferably, average exit velocity ranges are combined with a spray angle 80 of between about 50 and about 75 degrees and/or an average liquid particle size of between about 500 $\mu$m to about 1050 $\mu$m. The above-described spray nozzle exit conditions are intended to refer to spray nozzle exit conditions at any operating condition of the liquid delivery system of a cleaning implement. More preferably, the above-described spray nozzle exit conditions are intended to refer spray nozzle exit conditions generated by a liquid delivery at both its maximum intended spray nozzle inlet pressure and maximum volumetric flow rate during normal use. Most preferably, the above-described spray nozzle exit conditions are intended to refer spray nozzle exit conditions generated by a liquid delivery system comprising a spray nozzle, a pump, an electric motor, a check valve, and a battery voltage source, wherein the spray nozzle exit conditions are generated at the maximum intended voltage of the battery voltage source during normal use. Exemplary ranges for the above-described pressure, flow rate, and voltage operating conditions are discussed in further detail hereafter.

The various components of the liquid delivery system of the mop 20 cooperate in order to achieve the previously described preferred spray patterns and/or spray efficiencies over an adequate period of time so that a user of the mop 20 receives relatively consistent spraying performance over the useful life of the voltage source 39. In a preferred approach, the gear pump 36 delivers a volumetric flow rate of at least about 2 mils/sec and more preferably has a volumetric flow rate between about 2 mils/sec and about 20 mils/sec. Most preferably, the gear pump 36 delivers a volumetric flow rate between about 3 mils/sec and about 10 mils/sec. Moreover, the gear pump 36 delivers the above-described volumetric flow rates at a spray nozzle inlet pressure of at least about 6 Kpa and more preferably at a spray nozzle inlet pressure of between about 6 Kpa and about 320 Kpa. Most preferably, the gear pump 36 delivers the above-described volumetric flow rates at a spray nozzle inlet pressure between about 50 Kpa and about 160 Kpa. For a liquid delivery system comprising a spray nozzle, a pump, an electric motor, a check valve, and a battery voltage source, the previously described pump flow rates and spray nozzle inlet pressures are generated at the maximum intended voltage of the battery voltage source during normal use.

Moreover, the pump 36 delivers the above-described volumetric flow rates and spray nozzle inlet pressures for a time period of continuous pump operation of at least about 5 minutes and more preferably for a time period of continuous pump operation (as opposed to cyclical pump operation) of at least about 15 minutes. Most preferably, the pump 36 delivers the subject volumetric flow rates and spray nozzle inlet pressures for a time period of continuous pump operation between about 5 minutes and 20 minutes. In order to achieve these periods of continuous pump operation, the voltage input to the terminals 58 and 68 of electric motor 38 is at least about 1.5 volts over the subject time periods of continuous pump operation. More preferably, the voltage input to the terminals 58 and 68 is between about 1.5 volts and about 6 volts over the subject time periods of continuous pump operation. Most preferably, the voltage input to the terminals 58 and 68 is between about 1.8 volts to about 3.6 volts over the subject periods of continuous pump operation.

Figure 11:
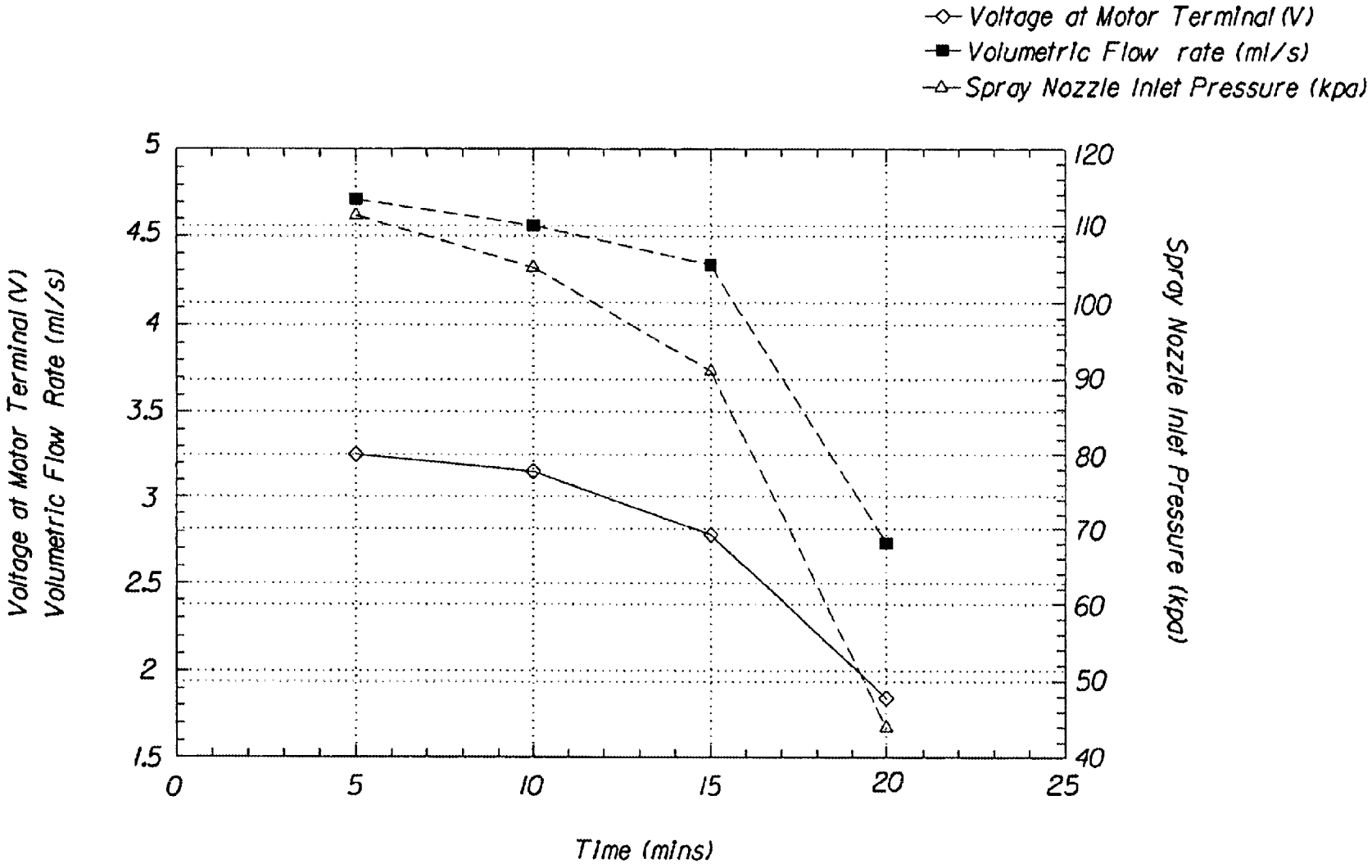
FIG. 11 is a plot of exemplary voltages, volumetric flow rates, and spray nozzle inlet pressures as a function of continuous pump operation for a cleaning implement made in accordance with the present invention.

Exemplary voltage, volumetric flow rate, and spray nozzle inlet pressure plots as a function of continuous pump operation for a cleaning implement made in accordance with the present invention are illustrated in FIG. 11.

The volumetric flow rate and spray nozzle inlet pressure at a given voltage is also a function of the efficiencies of the pump 36 and/or the electric motor 38. The efficiency of the pump 36 is at least about 3% and more preferably is at least about 6% and most preferably is at least about 12%. Most preferably, the efficiency of the pump is between about 3% and about 30%. The electric motor efficiency is at least about 50% and more preferably is at least about 70% and most preferably is between about 70% about 100%. As used herein, the term "motor efficiency" or "pump efficiency" is intended to refer to the ratio of pump or motor output to its input. As will be appreciated, a given volumetric flow rate and/or spray nozzle inlet pressure at a given voltage can be increased by increasing the pump and/or electric motor efficiencies which, in turn, will upwardly shift the pressure and volumetric rate curves of FIG. 11.

Referring again to FIG. 9, while the canister 34 is preferably situated above the pump 36 so that a static head is provided to the pump inlet 48 for priming of the pump, the canister 34 is also preferably substantially non-deformable (i.e., the walls of the canister do not measurably deflect to substantially affect generation of suction or sub-atmospheric pressure $P_2$ within the canister 34) at the pump generated pressure differential of $P_1$ minus $P_2$. Preferably the difference between the static pressure $P_2$ and the pressure $P_1$, the latter being equal to atmospheric pressure, when the pump 48 is priming (i.e., when the gears of the pump 36 have become immersed in the liquid 35) is sufficient to open the venting valve 86 as quickly as possible. In a preferred arrangement, the vent valve 86 has an opening or cracking pressure of at least about 0.6 Kpa and more preferably is between about 0.6 Kpa and about 20 Kpa for ease of pump priming. In other words, the pump 36 is able to generate a static suction pressure $P_2$ of at least about 0.7 Kpa within the canister 34 and more preferably the static suction pressure is between about 0.7 Kpa and about 20.1 Kpa. Most preferably, the vent valve 86 has a cracking pressure of between about 1 Kpa and about 10 Kpa and the pump 36 is able to generate a static pressure $P_2$ of between about 1.1 Kpa and about 10.1 Kpa. In the event that the pump 36 is unable to develop a suction pressure $P_2$ which is sufficient to open the vent valve 86, the user of the mop 20 can be instructed to squeeze the canister 34 to assist in priming the pump 36. For example, a set of instructions provided in association with an article of manufacture (such as a kit or package comprising the mop 20) which comprise an instruction to squeeze the canister 34 either before, during and/or after actuation of the pump 36.

TEST METHODS

The following procedures are useful for determination of parameters used to evaluate the cleaning implements of the present invention. In particular, these procedures are used to characterize the performance of a cleaning implement. Specific units may be suggested in connection with measurement and/or calculation of parameters described in the procedures. These units are provided for exemplary purposes only. Other units consistent with the intent and purpose of the procedures can be used.

Handle Deflection Test Method

Figure 12:
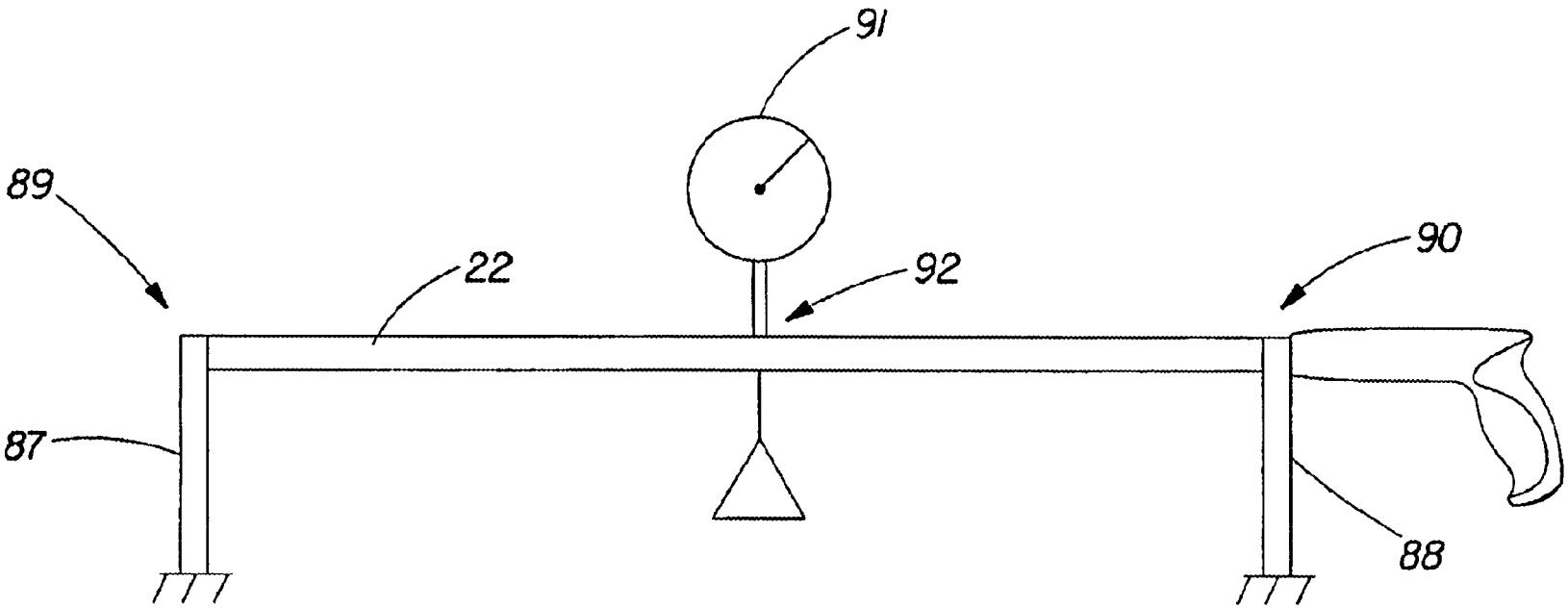
FIG. 12 is a schematic illustration of a test setup suitable for measuring mop handle deflection.

This procedure is used to determine the Handle Deflection of a cleaning implement. Referring to FIG. 12, the handle 22 is placed upon a first support cradle 87 and a second support cradle 88, wherein the support cradles 87 and 88 are disposed at about the ends 89 and 90 of the handle 22. The support cradles 87 and 88 should simply support the handle 22. A dial indicator 91, such as model no. ID-C150EB having a range of 0.001 mm to 50.8 mm which is manufactured by Mitutoyo of Japan is placed at the midpoint 92 of the handle 22 and a first reading is recorded. A 5 kg weight is applied at the midpoint 92 of the handle 22. After 10 minutes, a second reading is recorded. The Handle Deflection is difference between the first reading and the second reading.

The following are illustrative examples of application of the Handle Deflection Test Method:

EXAMPLE 1

A handle having a length of 94 cm, an outside diameter of 22 mm and an inside diameter of 16 mm, and which is made from aluminum is placed between the first and second cradles 87 and 88. The first reading is 0.299 mm and the second reading is 1.001 mm. Therefore, the Handle Deflection is 0.702 mm.

EXAMPLE 2

A handle having a length of 91 cm, an outside diameter of 22 mm and an inside diameter of 16 mm, and which is made from aluminum is placed between the first and second cradles 87 and 88. The first reading is 0.005 mm and the second reading is 0.395 mm. Therefore, the Handle Deflection is 0.390 mm.

Spray Pattern Test Methods

These procedures are used to determine the spray pattern of a cleaning implement. The test procedures are described herein for purposes of clarity with respect to an exemplary mop. As will be appreciated, however, the subject test methods can be used to evaluate any cleaning implement however configured. These spray pattern test methods are intended to be applied to cleaning implements on a per spray nozzle basis. The water which is sprayed by the mop is dyed, using any dye as is known in the art.

a) Spray Depth

The dimension of a spray depth is determined as follows. The leading edge of the subject mop is situated adjacent a rectangular first absorbent sheet whose dimensions are sufficient to capture at least 98% of the water discharged by the mop. The first absorbent sheet can be any absorbent sheet which substantially absorbs the sprayed water upon impact with the sheet and which has a water impermeable barrier on the bottom side so that the water absorbed by the sheet is retained by the sheet. A satisfactory absorbent sheet is manufactured by Buckeye Absorbant Technologies, Inc. of Memphis, Tenn. under the tradename VIZORBPLUS™. This preferred absorbent sheet is an air-laid tissue comprising three components, namely a celluose pulp, bi-component fibers, and an absorbent gel material, wherein the absorbent sheet material has an absorbent capacity of at least 17 gm of saline solution per gram of sheet material. The first absorbent sheet is weighed to determine its dry weight. After priming the mop, a water spray is discharged from the spray nozzle until at least 10 mils of water has been discharged, wherein at least the volumetric flow rate and spray nozzle inlet pressure are at the maximum values for the intended use of the subject mop during the discharge. The first absorbent sheet is weighed (the wet weight) and the wet weight is subtracted from the dry weight to determine the weight of water captured by the first absorbent sheet. This water weight is converted to a volume as is known in the art. If the water volume captured by the absorbent sheet is greater than 95% of the water volume discharged by the spray nozzle, then a second absorbent sheet will be tested, wherein the depth 93 (FIG. 13) of the second absorbent sheet is 98% of depth 93 of the first absorbent sheet. If less than 95% of the water volume is captured by the first absorbent sheet, a larger first absorbent sheet is tested until greater than 95% of the water is captured by the absorbent sheet and thereafter a second absorbent sheet is tested as described herein. The second absorbent sheet, as well as each subsequent absorbent sheet herein, is made from the same material as the first absorbent sheet. The second absorbent sheet is weighed (the dry weight). After priming the mop, a water spray is discharged from the spray nozzle until at least 10 mils of water has been discharged, wherein at least the volumetric flow rate and spray nozzle inlet pressure are at the maximum values for the intended use of the subject mop during the discharge. The second absorbent sheet is weighed (the wet weight) and the wet weight is subtracted from the dry weight to determine the weight of water captured by the second absorbent sheet. This water weight is converted to a volume as is known in the art. If the water volume captured by the second absorbent sheet is greater than 90±2% of the water volume discharged by the spray nozzle, then a third absorbent sheet is tested, wherein the depth 93 of the third absorbent sheet is 98% of depth of the second absorbent sheet. The above-described process is repeated until 90%±2% of the water discharged by the spray nozzle is captured by the absorbent sheet. Once this absorbent sheet has captured a water volume which is 90%±2% of the volume discharged by the spray nozzle, the depth 93 of this sheet is measured and this dimension is the depth of the spray pattern.

b) Spray Angle

Figure 13A:
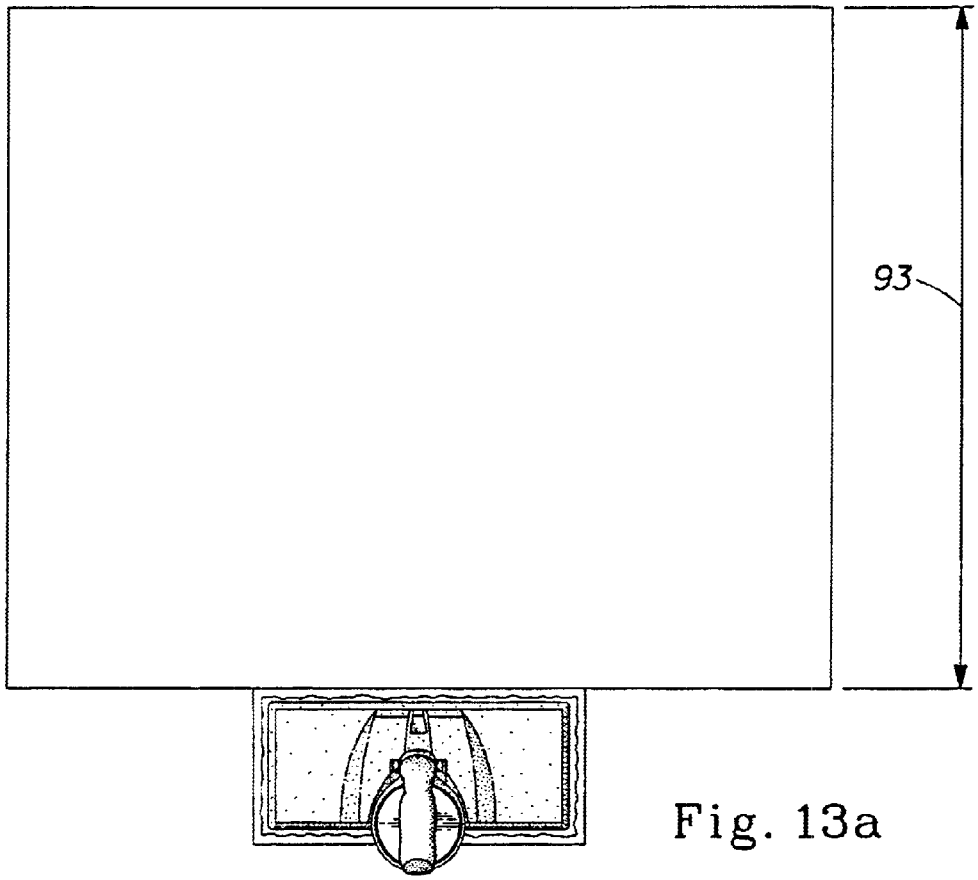
FIGS. 13 and 13A are schematic illustrations of test setups suitable for determining Spray Pattern dimensions.
Figure 13B:
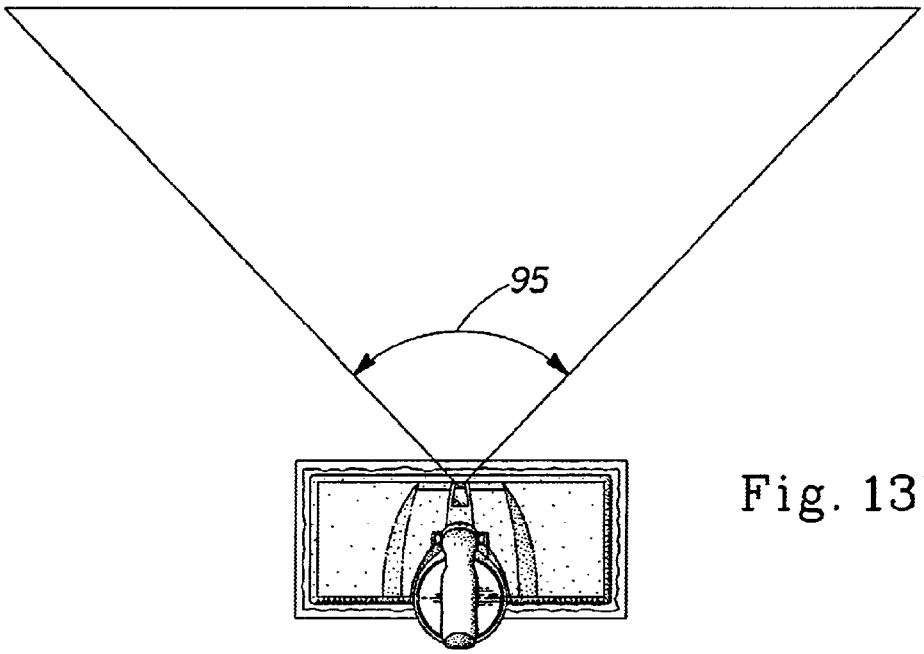

The spray angle is determined as follows. In the event that the spray pattern is generally triangular in shape (i.e., which has a generally triangular shape in a planar projection), the spray angle can be determined in a manner similar to that used to determine the spray depth. Namely, a first absorbent sheet which is large enough to capture at least 98% of the sprayed water is placed in front of the mop. The first absorbent sheet is in the form of an equilateral triangular, as shown in FIG. 13A, wherein the angle 95 of the apex of the absorbent sheet which is adjacent the spray nozzle is large enough to capture at least 98% of the water volume discharged by spray nozzle within the triangle defined by the apex. The first absorbent sheet is weighed to determine its dry weight. After priming the mop, a water spray is discharged from the spray nozzle until at least 10 mils of water has been discharged, wherein at least the volumetric flow rate and spray nozzle inlet pressure are at the maximum values for the intended use of the subject mop during the discharge. The first absorbent sheet is weighed (the wet weight) and the wet weight is subtracted from the dry weight to determine the weight of water captured by the first absorbent sheet. This water weight is converted to a volume as is known in the art. If the water volume captured by the absorbent sheet is greater than 98% of the water volume discharged by the spray nozzle, then a second absorbent sheet will be tested, wherein the angle of the apex is 98% of the angle of the apex of the first absorbent sheet. If less than 98% of the water volume is captured by the first absorbent sheet, a larger first absorbent sheet is tested until greater than 98% of the water is captured by the absorbent sheet and thereafter a second absorbent sheet is tested as described herein. The second absorbent sheet is weighed (the dry weight). After priming the mop, a water spray is discharged from the spray nozzle until at least 10 mils of water has been discharged, wherein at least the volumetric flow rate and spray nozzle inlet pressure are at the maximum values for the intended use of the subject mop during the discharge. The second absorbent sheet is weighed (the wet weight) and the wet weight is subtracted from the dry weight to determine the weight of water captured by the second absorbent sheet. This water weight is converted to a volume as is known in the art. If the water volume captured by the second absorbent sheet is greater than 95±2% of the water volume discharged by the spray nozzle, then a third absorbent sheet is tested, wherein the angle 95 of the apex of the third absorbent sheet is 98% of angle 95 of the apex of the second absorbent sheet. The above-described process is repeated until 95%±2% of the water discharged by the spray nozzle is captured by the absorbent sheet. Once this absorbent sheet has captured a water volume which is 95%±2% of the volume discharged by the spray nozzle, the angle 95 of the apex adjacent the spray nozzle is measured and this dimension is the spray angle of the spray pattern.

c) Spray Width

The spray width is determined as follows. For sprays which are not fan-shaped, the width of the spray pattern is the width, at a previously determined depth of the spray pattern, which is sufficient to define a box which is wide enough to capture all of the water up to the depth of the spray pattern. For spray patterns which are triangular in shape, the spray width is defined by the spray angle and the spray depth as previously determined.

d) Spray Gap

The spray gap is determined as follows. The leading edge of the mop is situated adjacent a rectangular first absorbent sheet whose dimensions are sufficient to capture less than 10% of the water discharged by the mop. The first absorbent sheet is weighed to determine its dry weight. After priming the mop, a water spray is discharged from the spray nozzle until at least 10 mils of water has been discharged, wherein at least the volumetric flow rate and spray nozzle inlet pressure are at the maximum values for the intended use of the subject mop during the discharge. The first absorbent sheet is weighed (the wet weight) and the wet weight is subtracted from the dry weight to determine the weight of water captured by the first absorbent sheet. This water weight is converted to a volume as is known in the art. If the water volume captured by the absorbent sheet is greater than 5% of the water volume discharged by the spray nozzle, then a second absorbent sheet will be tested, wherein the depth 93 (FIG. 13) of the second absorbent sheet is 98% of depth of the first absorbent sheet. The second absorbent sheet is weighed (the dry weight). After priming the mop, a water spray is discharged from the spray nozzle until at least 10 mils of water has been discharged, wherein at least the volumetric flow rate and spray nozzle inlet pressure are at the maximum values for the intended use of the subject mop during the discharge. The second absorbent sheet is weighed (the wet weight) and the wet weight is subtracted from the dry weight to determine the weight of water captured by the second absorbent sheet. This water weight is converted to a volume as is known in the art. If the water volume captured by the second absorbent sheet is greater than 0.1 mils±0.05 mils of the water volume discharged by the spray nozzle, then a third absorbent sheet is tested, wherein the depth 93 of the third absorbent sheet is 98% of the depth 93 of the second absorbent sheet. The above-described process is repeated until 0.1 mils±0.05 mils of the water discharged by the spray nozzle is captured by the absorbent sheet. Once this absorbent sheet has captured a water volume which is 0.1 mils±0.05 mils of the volume discharged by the spray nozzle, the depth 93 of this sheet is measured and this dimension is the spray gap of the spray pattern.

e) Spray Pattern Area

The spray pattern area is determined as follows. For triangular shaped sprays, the spray pattern area is the area bounded by the spray depth, the spray angle lines as set by the spray angle, and the spray gap, if any. For non-triangular shaped sprays, the spray pattern area is the rectangular area bounded by the spray depth and the spray width.

Spray Efficiency Test Methods

This procedure is used to determine the various spray efficiencies of a cleaning implement. This test procedure is described herein for purposes of clarity with respect to an exemplary mop. As will be appreciated, however, the subject test method can be used to evaluate any cleaning implement however configured. The water which is sprayed by the mop is dyed, using any dye as is known in the art.

The spray pattern of the subject mop is first determined according to the Spray Pattern Test Methods. The mop is next situated before an absorbent sheet such that the leading edge over which the water spray projects during use is directly adjacent to the absorbent sheet. The first absorbent sheet can be any absorbent sheet which substantially absorbs the sprayed water upon impact with the sheet and which has a water impermeable barrier on the bottom side so that the water absorbed by the sheet is retained by the sheet. A satisfactory absorbent sheet is manufactured by Buckeye Absorbant Technologies, Inc. of Memphis, Tenn. under the tradename VIZORBPLUS™. This preferred absorbent sheet is an air-laid tissue comprising three components, namely a celluose pulp, bi-component fibers, and an absorbent gel material, wherein the absorbent sheet material has an absorbent capacity of at least 17 gm of saline solution per gram of sheet material. The shape and dimensions of the absorbent sheet match the spray pattern dimensions (i.e., depth, width, spray angle, spray gap) previously determined above and the absorbent sheet is aligned with the spray nozzle so that the orientation of the absorbent sheet matches the spray pattern of the nozzle.

The absorbent sheet is weighed prior to wetting (i.e., the dry weight of the absorbent sheet). After priming the mop, a water spray is discharged from the spray nozzle until at least 10 mils of water is sprayed, wherein at least the average exit velocity and spray angle at the exit plane of the spray nozzle are at the maximum values for intended use of the subject cleaning implement. The elapsed time (in seconds) of discharge is monitored and recorded. The absorbent sheet is weighed after completion of the water spray discharge (i.e., the wet weight of the absorbent sheet). The difference between the measured absorbent sheet weights is the weight of water which was absorbed by the absorbent sheet. The weight of water is converted to a volume of water (in mils), as is known in the art.

The T1200 Absorbent Capacity Spray Efficiency is calculated as follows, wherein the T1200 Absorbent Capacity value (in g/g) is the value for a selected cleaning substrate of interest:

T1200 Absorbent Capacity Spray Efficiency=((Volume of Water Absorbed/time of discharge)/(Spray Pattern Area×T1200 Absorbent Capacity)

The Squeeze Out Spray Efficiency is calculated as follows, wherein the Squeeze Out value (as %/100) is the value for a selected cleaning substrate of interest:

Squeeze Out Spray Efficiency=((Volume of Water Absorbed/time of discharge)/(Spray Pattern Area×Squeeze Out)

The Rated Spray Efficiency is calculated as follows:

Rated Spray Efficiency=((Volume of Water Absorbed/time of discharge)/(Spray Pattern Area)

Removable Cleaning Pad and/or Sheet

The present invention is based on the convenience of a cleaning pad, preferably disposable, that provides significant cleaning benefits. The cleaning performance benefits are related to the structural characteristics of the present cleaning pad as described hereinbefore, combined with the ability of the pad to remove and retain solubilized soils. The cleaning pad and/or sheet can be designed to be used in conjunction with a handle to provide a cleaning implement. As a removable, preferably disposable, cleaning pad, the cleaning pad preferably comprises an attachment layer, as described hereinbefore. The attachment layer preferably comprises a clear or translucent polyethylene film and/or hook and loop technology or adhesive tape.

Figure 8A:
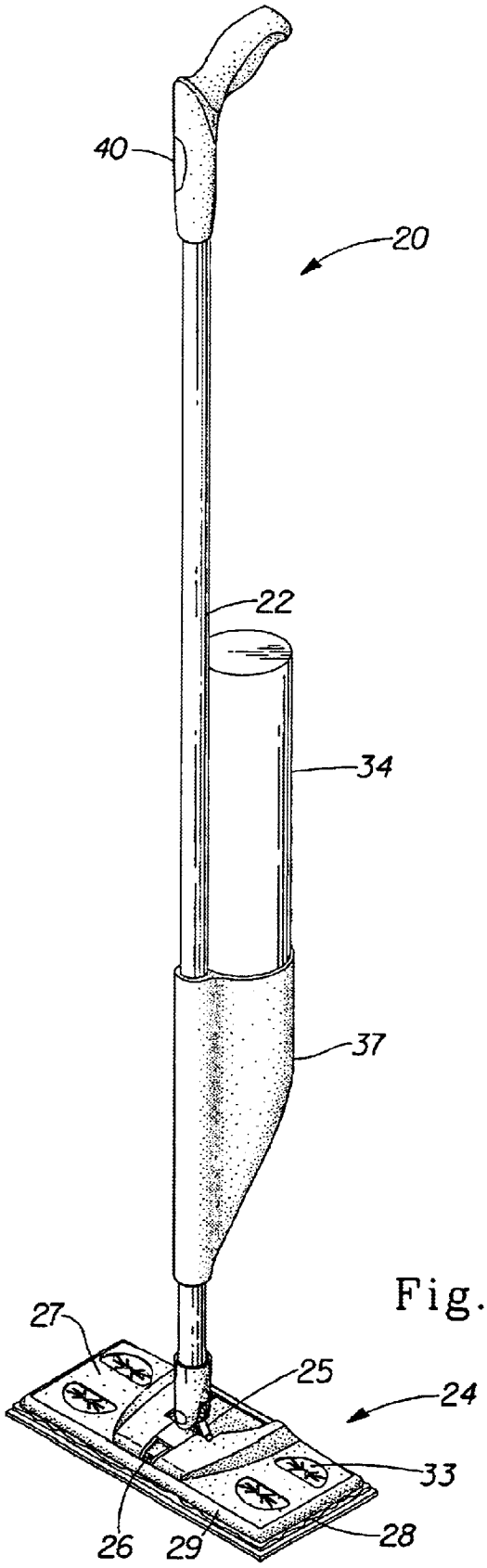
FIG. 8A is a perspective view of yet another preferred cleaning implement made in accordance with the present invention, wherein the cleaning implement comprises a plurality of attachment structures.
Figure 8B:
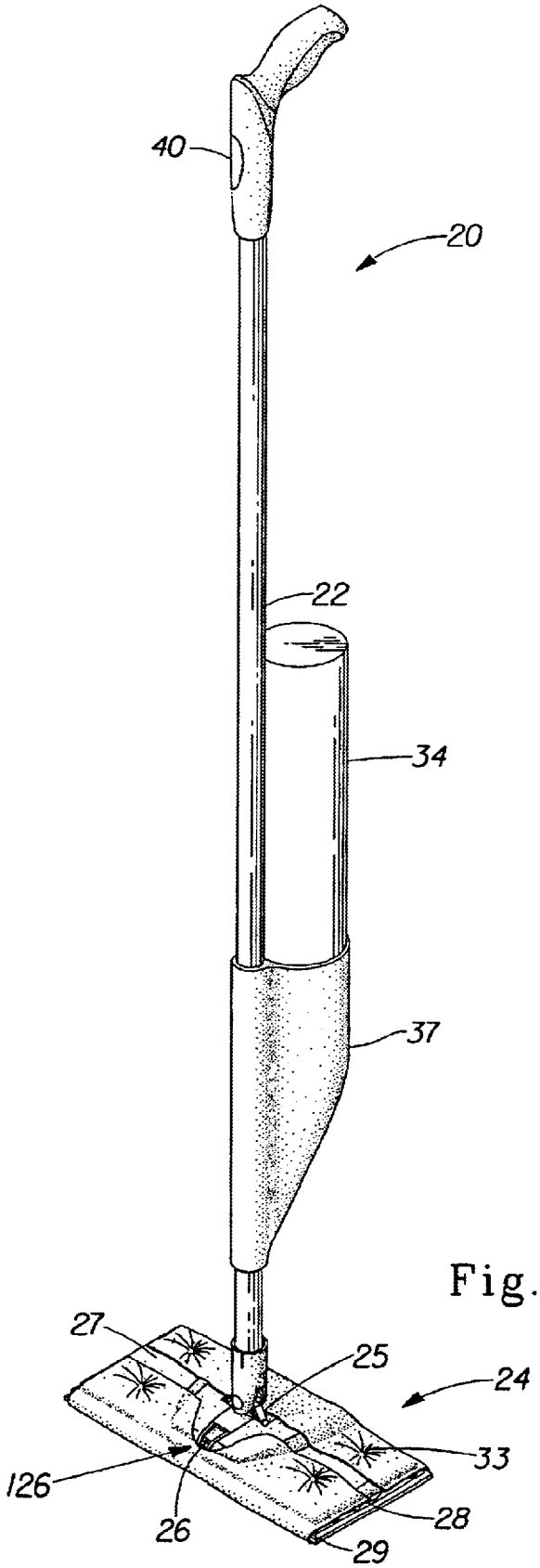
FIG. 8B is a perspective view of the cleaning implement of FIG. 8A with a cleaning pad attached to the mop head of the implement.

In an alternative embodiment, the attachment layer 403 of a cleaning pad 400 as shown in FIG. 4*b* can be designed such that the y-dimension (width) of the attachment layer is greater than the y-dimension of the other cleaning pad elements such that the extra width of the attachment layer can engage attachment structures 33 located on a mop head 24 as shown in FIG. 8A.

Removable Pre-Moistened Cleaning Wipe

Removable pre-moistened cleaning wipes can be used in combination with handles described hereinbefore to form a cleaning implement. Such a cleaning implement can be used for light duty cleaning of hard surfaces and can be used in the cleaning methods, preferably in the two-step cleaning methods, described hereinafter.

VI. Other Aspects and Specific Embodiments

While particular embodiments of the present invention have been illustrated and/or described, it will be obvious to those skilled in the art that various changes and modifications may be made without departing from the spirit and scope of the invention, and it is intended to cover in the appended claims all such modifications that are within the scope of the invention.

VII. Methods of Use and Methods of Cleaning

A. Wall Cleaning Process

In the context of a wall cleaner, the compositions can be distributed using a spray device combined with a buffing implement, or dosed more conveniently using a roller, such as manual or powered paint rollers. When using rollers, it is important to remove soil from the roller. This can be achieved by either washing the device with water when it becomes very soiled, or using a wringer to scrape the soil from the roller. The wringing device can be used separately or housed together with the roller. Hand implements for wall cleaning can also be used.

Optionally, the implement is attached to a handle for harder to reach areas, coverage and ease of use. For increased convenience, the compositions can be delivered in the form of a pre-moistened wipe. The pre-moistened wipe can provides cleaning liquid and scrubbing surface all in one execution.

It is especially important to control dosing and coverage where the surface is susceptible to damage. For best results, i.e., soil removal with minimal or no surface damage, dosing should be preferably from about 1 milliliter to about 20 milliliters per square meter, more preferably from about 2 milliliters to about 10 milliliters per square meter. For best results, the product is applied at the above-recommended doses, covering surfaces to be treated completely, and allowed to air-dry. Instructions for use include pictures and/or words detailing preferred application pattern and dosing. The compositions of this invention are mild and minimize harm to most painted surfaces. Preferably solvent use is limited or not present for this application. Preferred compositions for wall cleaning include the preferred $C_{8-16}$ alkylpolyglycoside either with or without hydrophilic polymers. The compositions are ideally suited for light duty jobs, i.e., general maintenance of painted and/or wall-papered surfaces, because of product mildness and generally low levels of actives. Additional benefits for painted walls, provided by the hydrophilic polymer, include shine, luster restoration, and soil prevention.

B. Counter and/or Cabinet Cleaning Process

In the context of a counter and cabinet cleaner, the compositions can be distributed using a spray device combined with a buffing implement, or dosed more conveniently using a hand-implement or an implement attached to a handle for harder to reach areas, coverage, and ease of use. Optionally, for increased convenience, the compositions can be delivered in the form of a pre-moistened wipe. The pre-moistened wipe provides liquid and scrubbing all in one execution. The wipe can also incorporate soft and abrasive materials as needed for spot cleaning. For best results, i.e., soil removal with delivery of high gloss and no streaks to treated areas such that no rinsing is required, dosing should be preferably from about 5 milliliter to about 30 milliliters per square meter, more preferably from about 10 milliliters to about 20 milliliters per square meter. The compositions of this invention are mild and minimize harm to most painted surfaces and woods or worn Formica. Preferred compositions for wall cleaning include the preferred $C_{8-16}$ alkylpolyglycoside either with or without hydrophilic polymers. The compositions are ideally suited for light duty jobs, i.e., daily or weekly maintenance, because of product mildness and generally low levels of actives. Importantly, residual levels of the hydrophilic polymers provide shine and soil prevention. Solvents, particularly volatile solvents, are preferably incorporated in these compositions, as they can provide additional cleaning, if needed, without streaking in a no-rinse application. The compositions also deliver next-time easier cleaning advantages of grease, encrusted foods and stains via the residual polymer left on surface. Additionally, the compositions can be used with articles to improve cleaning, such as abrasive pads, heat and steam. For counters, antimicrobial benefits are particularly desirable. It is found that compositions comprising can enhance the bacteriocidal benefits of disinfectant compositions delivered via cleaning substrates. Moreover, frequent of the product in a maintenance fashion will provide bacteria prevention benefits.

C. Floor Cleaning Process

In the context of a floor surfaces cleaner, the compositions can be distributed using a sponge, string or strip mop. By floor cleaners, we mean compositions intended to clean and preserve common flooring inside or outside of the home or office. Floors that can be cleaned with compositions of the present invention include living room, dining room, kitchen, bathroom, cellar, attic, patio etc. These floors can consist of ceramic, porcelain, marble, Formica®, no-wax vinyl, linoleum, wood, quarry tile, brick or cement, and the like.

In the context of conventional, i.e., sponge, string and strip implements preferably equipped with mop heads and handles, the compositions can be ready to use, i.e., used as is, or diluted in a bucket or other suitable receptacle at dilution factors specified in the instructions. For best results, thorough sweeping and/or vacuuming is recommended before wet mopping. It is recommended that the lowest soiled floors be cleaned first, with progression toward more heavily surfaces. This maximizes the mileage of the solution and limits room to room contamination. The implement head is dunked or immersed into the solution (either dilute or ready to use) and wrung out. The implement should not be completely dry nor should it be dripping wet prior to mopping.

A preferred mopping pattern with a sponge mop or floor cloth used with a brush with a handle is performed in an up-and-down overlapping motion from left to right (or right to left) and then repeated using an up-and-down overlapping pattern from right to left (or left to right). The up-and-down motion preferentially covers about 0.5 meters to about 1 meter. The left to right distance preferentially is about 1 to about 2 meters. After mopping this area, i.e., from about 0.5 square meters to about 2 square meters, the sponge mop or floor cloth should be re-immersed in solution and wrung again. By following this procedure the volume of solution left on solution left on the floor is from about 20 milliliters to about 50 milliliters per square meter, preferably from about 30 milliliters to about 40 milliliters per square meter.

Using a string or strip mop(e.g., cellulose, polyvinyl alcohol (PVA), cotton, synthetic or blends, and mixtures thereof), a preferred mopping pattern consists of an up-and-down overlapping motion from left to right (or right to left) which is then repeated using a side to side overlapping motion from right to left (or left to right). The up-and-down motion preferentially covers about 0.5 meters to about 1 meter. The side-to-side pattern right to left (or left to right) is preferably covers from about 0.5 meters to about 1 meter. The mopping pattern preferably outlines a square shape, i.e., from about 0.5 square meters to about 1 square meter. After mopping this area, the strip or string mop should be re-immersed in solution and wrung again. By following this procedure the volume of solution left on solution left on the floor is from about 20 milliliters to about 50 milliliters per square meter, preferably from about 30 milliliters to about 40 milliliters per square meter.

Optionally, to better control consistency of results using conventional mops, the composition (either diluted or ready to use) is stored in one receptacle, and the mop-rinsing water is stored in another receptacle. This dual-receptacle approach can consist of two separate units or can be combined as one. Examples of this mode of use include squirt bottles, trigger sprays, mechanical sprays, garden misters, and electrical or battery-operated dosing devices. The advantages of this mode of use include always providing fresh solution to the floor, and keeping soiled water (from the cleaning of the floors) from re-contaminating the floor. Additionally, this approach effectively controls micro-organisms through less re-inoculation, thereby providing a more germ-free end result. This mode of use is also advantageous for spot cleaning, i.e., tough-to-clean areas can be pre-treated with product before the mopping begins; this mode of use also allows flexibility with respect to dosage control in that more solution can be administered to dirty areas, and less to cleaner areas, thereby improving value.

Optionally, to achieve more consistent and higher quality results, the composition can be applied directly to the floor as a ready to use solution in either liquid or spray form.

Examples of this mode of use include squirt bottles, trigger sprays, mechanical sprays, garden misters, and electrical or battery-operated dosing devices. Advantages of this mode of use include always providing fresh solution to the floor, and better mop maintenance, particularly if the mop is not re-exposed to dirty solution (i.e., the mop can be preserved longer by wringing out old solution and only applying fresh solution to the floor.). Additionally, this approach more effectively removes microorganisms from the cleaning mechanism, thereby providing a more germ-free end result (i.e., less re-inoculation of the microorganisms). This mode of use is also advantageous for spot cleaning, i.e., tough-to-clean areas can be pre-treated with product before the mopping begins; this mode of use also allows flexibility with respect to dosage control in that more solution can be administered to dirty areas, and less to cleaner areas, thereby improving value.

Optionally, the fresh solution dispensing approach can be delivered using a motorized system. An example of a motorized system for floor cleaning is the Dirt Devil® Wet Vac. Preferably, the motorized system would comprise a chamber containing fresh solution and a second chamber to suck up and hold the dirty solution removed from the floor. The motorized unit also preferably comprises squeegee and/or scrubbing devices. The scrubbing device can be made of cotton, cellulose sponge etc. The dispensing unit can consist of a simple unit containing a lever (which can be calibrated for one or more dosing levels) to meter liquid onto the floor. Thorough sweeping and/or vacuuming is recommended prior to using the motorized cleaning system. A preferred wiping pattern consists of an up-and-down overlapping motion from left to right (or right to left) and then repeated using an up-and-down overlapping pattern from right to left (or left to right). The up-and-down motion preferentially covers about 0.5 meters to about 1 meter. The left to right distance preferentially is about 1 to about 2 meters. After mopping this area, i.e., from about 0.5 square meters to about 2 square meters, the motorized cleaning unit is engaged, solution is squeezed into a puddle in a raking motion, and then sucked up into the dirty solution containment chamber using vacuum.

D. General Purpose and Floor Cleaning Using Pre-Moistened Cleaning Wipe

Optionally, for increased floor cleaning convenience, the compositions can be delivered in the form of a pre-moistened wipe as described hereinbefore, preferably attached to a mop head and/or handle. The pre-moistened wipe can provide liquid and scrubbing all in one execution. Mopping pattern with a pre-moistened mop used with a handle is preferably performed in an up-and-down overlapping motion from left to right (or right to left) and then repeated using an up-and-down overlapping pattern from left to right (or right to left). The up-and-down motion preferentially covers about 0.5 meters to about 1 meter. The left to right distance preferentially is about 1 to about 2 meters. This mopping pattern is then repeated until the wipe is either substantially exhausted or dried out. Pre-moistened wipes can be advantageous particularly for cleaning small areas, such as encountered in typical bathrooms. They are also readily available and versatile in that they can be used to clean surfaces other than floors, such as counter tops, walls etc., without having to use a variety of other liquids and/or implements. This approach also effectively removes and controls microorganisms by minimizing implement inoculation, which is often seen with conventional re-usable systems such as sponge, string and strip mops. Lack of implement inoculation leads to a cleaner and more germ-free end result.

E. Floor Cleaning Using a Disposable Cleaning Pad

Optionally, and most preferably, convenience and performance can be maximized by using a system composed of a disposable cleaning pad as described hereinbefore and a mode for applying fresh solution onto the floor. The pad can be composed of a laminate of non-wovens, cellulose and super-absorbent polymer. This cleaning pad is attached to a handle comprising a support head as described hereinbefore. In such a system, solution application can be achieved via a separate squirt bottle or spray trigger system, or can be directly attached or built-in to the device (i.e., on the mop head or the handle). The delivery mechanism can be actuated by the operator, or can be battery-induced or electrical.

This system provides multiple benefits versus conventional cleaning modes. It reduces time to clean the floor, because the pad sucks up dirty solution. It eliminates the need to carry heavy, messy buckets. Due to the absorbent pad which absorbs and locks away dirty solution, a single pad can clean large surface areas.

Additionally, since a fresh pad is used every time, germs and dirt are trapped, removed and thrown away, promoting better hygiene and malodor control. Conventional mops, which are re-usable, can harbor dirt and germs, which can be spread throughout the household and create persistent bad odors in the mop and in the home. Through operator-controlled dosing and more efficient removal of dirty solution from the floor, better end result is also achieved.

Additionally, because the cleaning process involves use of low levels of solution in contact with the floor for much shorter periods of time relative to conventional cleaning systems, (less solution is applied on the floor and the super-absorbent polymer absorbs most of it such that volume left behind with the disposable pad and mop is only from about 1 to about 5 milliliters of solution per square meter), the system provides improved surface safety on delicate surfaces. This is particularly important for the cleaning of wood, which tends to expand and then contract when excess treated with excess water.

Finally, this system is well suited for pre-treating tough soil spots prior to full floor cleaning because of the controlled dosing of solution. Unlike conventional mops, this system is more effective and more convenient for removal of spills. For example, conventional mops actually wet the floor in attempting to control spills, while absorbent paper towels or cloths require the user to bend down to achieve spill removal. Finally, the implement plus pad can be designed to allow easy access to tough to clean and hard to reach areas, e.g., under appliances, tables, counters, and the like. The use of super-absorbent polymer allows a reduction in volume of the pad, i.e., the pad is thin though highly absorbent due to the super-absorbent structure being able to absorb 100 times its weight; this is achievable with conventional mops, which require greater bulk for absorption purposes (cellulose or a synthetic structures absorb only up to about from 5 to about 10 times their weight).

For best results using the disposable pad and implement cleaning system, first thoroughly sweep and/or vacuum before wet mopping. Prior to application of the solution to the areas to be cleaned, preferably apply from about 10 to about 20 milliliters in small area (e.g., about one-half a square meter) and wipe pad across area back and forth several times until solution is almost completely absorbed. This is important in that it primes the pad, allowing it to function most effectively. In an application where the dosing mechanism is separate from the implement (i.e., a detached dosing system), a priming set can optionally be to spray solution directly onto the pad, with even coverage using from about 10 to about 20 milliliters. Apply solution at rate of from about 5 to about 40 milliliters, more preferably from about 10 to about 30 milliliters per square meter, spreading the liquid out as much as possible over the area section to be cleaned. This is followed by wiping using the disposable pad.

A preferred wiping pattern consists of an up-and-down overlapping motion starting in the bottom left hand (or right hand) side of the section to be cleaned, and progressing the wiping pattern across the floor continuing to use up-and-down wiping motions. Wiping is then continued beginning at the top right (or left) side of the section to be cleaned and reversing the direction of the wipe pattern using a side-to-side motion. Another preferred wipe pattern consists of an up-and-down wiping motion, followed by an up-and-down wiping motion in the reverse direction. These thorough preferred wiping patterns allow the pad to loosen and absorb more solution, dirt and germs, and provide a better end result in doing so by minimizing residue left behind. Another benefit of the above wiping patterns is minimization of streaks as a result of improved spreading of solution and the elimination of streak lines from the edges of the pad.

The pads are versatile in that they can be used for multiple cleanings and multiple surfaces. Each pad is designed to clean one average size floor (i.e., from about 10 to about 20 square meters) with an average soil load. Pads can need to be changed sooner if floors are larger than average, or especially dirty. To determine if the pad needs changing, look at the back of the pad and ascertain if the back absorbent layer is saturated with liquid and/or dirt.

The use of the compositions herein, where no rinsing is desirable, as opposed to the types of compositions sold heretofore for treating non-bathtub/shower area surfaces including floor surfaces, walls and counter tops, provides improved performance.

F. Two-Step Floor Cleaning Process

The present invention further encompasses a method of cleaning hard surfaces, especially floors such as vinyl, linoleum, wood, and laminates, that generally includes a dry mopping step followed by a wet mopping step. It has been found that performing a dry mopping step before performing a wet mopping step, especially using the preferred implements herein, results in a much more visually acceptable surface in terms of filming and/or streaking and much better soil removal which results in a cleaner surface. The present method of cleaning a hard surface can comprise:

(a) contacting the surface with a cleaning implement comprising a handle and a removable, dry, cleaning substrate, preferably a nonwoven hydroentangled cleaning sheet as described herein before, to remove dust and fine particulate matter from the surface;

(b) contacting the surface with a hard surface cleaning composition, preferably a hard surface cleaning composition as described herein, to wet the surface;

(c) contacting the wet surface with a cleaning implement comprising a handle and a removable cleaning pad, preferably a cleaning pad as described herein, to substantially remove the hard surface cleaning composition from the surface; and (d) allowing the surface to dry without rinsing the surface with a separate rinse solution.

The present invention further relates to a method of cleaning hard surfaces, especially floors such as vinyl, linoleum, wood, and laminates, comprising:

(a) contacting the surface with a cleaning implement comprising a handle and a removable, dry, cleaning substrate, preferably a nonwoven hydroentangled cleaning sheet as described herein, to remove dust and fine particulate matter from the surface;

(b) contacting the surface with a cleaning implement comprising a handle and a removable, pre-moistened cleaning wipe, preferably a pre-moistened cleaning wipe as described herein, to remove additional soil from the surface; and (c) allowing the surface to dry without rinsing the surface with a separate rinse solution.

The utilization of a two-step floor cleaning method comprising a dry mopping step followed by a wet mopping step helps to improve the overall end result performance of a wet mopping system such as the cleaning implement described hereinbefore comprising a disposable cleaning pad. In addition to providing better overall end result, especially in regard to the filming and/or streaking and soil removal of the hard surface being cleaned, this method provides the potential to increase the area that could be cleaned with a single cleaning pad of the present invention and therefore increases the cleaning pad mileage. Increased cleaning pad mileage also leads to better consumer value.

The present two-step floor cleaning method can be executed in the context of a two-implement system—i.e. one cleaning implement for dry mopping/dusting and one cleaning implement for wet mopping—or the present method can be executed as an all-in-one mopping system—i.e. using the same cleaning implement for both steps. If the present method is executed using an all-in-one mopping system, additional benefits include greater convenience due to easier storage and potentially lower cost.

In addition, the present two-step floor cleaning method can optionally comprise an additional step, wherein the third step comprises polishing and/or buffing the surface to improve shine, and/or add a protective coating and/or soil repellence coating.

The improvement in end result is typically due to the ability to remove more particulate soil (especially fine particulate) prior to wet mopping. In the context of wet mopping with a disposable cleaning pad, particulate load and cleaning pad saturation are important factors in overall performance because there is no pad-rinsing and/or surface-rinsing step. Specifically, while a disposable cleaning pad is typically very effective at picking up soils, including particulate soils, eventually it reaches a saturation point where soil can be re-deposited onto the surface being cleaned. Even though the amount of soil re-deposited is typically very low, it is normally spread out evenly over a much larger area than from where it was picked up originally. Additionally, this fine particulate can combine with solution residue to create an end result which looks hazy (low shine) due to filming and/or streaking of the surface.

While conventional dry mopping systems, such as vacuuming or using a broom, can be used in the present method, such dry mopping systems are not as effective at picking up finer particulate due to several reasons including the following: (1) with conventional systems consumers sweep or vacuum soils which are visible (usually larger soils) and miss soils that are less visible (fine particulate); (2) brooms typically are made with large bristles where finer particulate can pass through and be missed; (3) many vacuum cleaners are effective at picking up larger particulate but can stir up and blow around finer particulate. Indeed, standard vacuums have to allow enough air flow through the vacuum cleaner bags for proper function. This air flow contains fine particulate. This is supported in the literature including Lioy, Wainman, Zhang and Goldsmith, "Typical household vacuum cleaners: the collection efficiency and emission characteristics of fine particles" (1999) J. Air Waste Management Association, 49:200–206.

By creating a method of cleaning a hard surface where consumers can do a thorough and effective dry mopping step prior to wet mopping, the end result of such a cleaning method can be improved dramatically particularly in the context of using a disposable cleaning pad, such as those described herein, for wet mopping. Using cleaning sheets composed of hydro-entangled polyester fibers can achieve outstanding particulate pick-up. Such nonwoven hydroentangled cleaning sheets are described in Fereshtehkhou et al., U.S. Ser. No. 09/082,349, filed May 20, 1998 (Case 6664M); Fereshtehkhou et al., U.S. Ser. No. 09/082,396, filed May 20, 1998 (Case 6798M); and U.S. Pat. No. 20 5,525,397, issued Jun. 11, 1996 to Shizuno et al.; all of which are hereby incorporated herein by reference.

To maximize the synergy between dry dusting and wet mopping, the present methods can be carried out using several varying executions and instructions for use. In one embodiment, a "kit" can be provided that has two implements and two substrate types. One implement would be used with dry mopping sheets the other implement would be used with wet mopping pads. Such a kit preferably provides the consumer a set of instructions to always dry mop before wet mopping for best results. The kit can also be sold separately with advertising and instructions in each kit being used to explain the benefits of using the two systems together. Optionally, the advertising could include a coupon or mail-in rebate in each of the separate kits that will encourage purchase and usage of both to get the synergistic benefits. In another embodiment, the present methods can be carried out using an "all-in-one" mop, that includes dry cleaning sheets that can be attached and cleaning pads and/or wipes for wet mopping that can be attached to same mop to be used for both tasks. Again, the kit can provide consumers instructions to always dry mop before wet mopping for best results.

While the benefits can be seen on any floor, floors with more texture, pores and cavities, like vinyl and ceramic, especially benefit when doing an efficient dry mopping step prior to wet mopping. The benefit seen is significant improvements in end result appearance, especially in terms of filming and/or streaking and soil left behind. This improvement can be seen when cleaning areas with either loose fine particulate or areas with tacked-down particulate mixed with grease. The improvement in performance is apparent when doing a dry mopping step with separate implement or using the same implement as used in the wet mopping step. Without an efficient dry mopping step first, a wet mopping cleaning method is preferably carried out using a cleaning pad comprising functional cuffs as described hereinbefore, because the functional cuffs aid in scrubbing and particulate pick-up. However, if a hard surface cleaning method includes an efficient dry mopping step, then acceptable end result performance, especially in terms of filming and/or streaking, can be achieved with a wet mopping step using a cleaning pad as described herein, without the optional functional cuffs. This is due to the fact that an efficient dry mopping step effectively removes a significant amount of particulate from the surface, particularly larger particulate which is typically soil trapped in functional cuffs of the present cleaning pads.

In one embodiment, a dry mopping system comprises a cleaning implement that is light-weight (about 200–400 g) with multi-position universal joint and would be designed with mechanism to attach dry dusting sheets (for example, attachment structures located on a mop head as described hereinbefore, or mechanical clips). The light weight and flexibility is important to allow frequent use to keep particulate soil and dust, lint and hair under control. The dry mopping system further comprises dry, cleaning sheets that are preferably made of hydroentangled polyester with patterning and additives as described in Fereshtehkhou et al., U.S. Ser. No. 09/082,396, filed May 20, 1998 (Case 6798M); Fereshtehkhou et al., U.S. Ser. No. 09/082,349, filed May 20, 1998 (Case 6664M); and U.S. Pat. No. 5,525,397, issued Jun. 11, 1996 to Shizuno et al.; which are all hereby incorporated herein by reference.

In this embodiment, a wet mopping system comprises a cleaning implement having a more solid, durable structure (weight about 1100–1300 g) that is primarily designed for wet mopping. The wet mopping system preferably has a reservoir for attaching a bottle with a hard surface cleaning composition and have a spraying mechanism built-in. Such a cleaning implement has been described hereinbefore and is shown in FIGS. 5 and 8. The mop head of such a cleaning implement preferably has velcro hooks on under side for attaching a cleaning pad having an attachment layer comprising loop material. The wet mopping system further comprises a cleaning pad as described hereinbefore.

In another embodiment, an "all-in-one" cleaning implement is provided that is compatible with both dry, cleaning sheets for dry mopping and absorbent cleaning pads for wet mopping. Such a cleaning implement preferably is lightweight, yet reasonably durable (about 600–900 g). It preferably has a universal joint that is a multi-position joint to allow for easy dry and wet mopping, but also allows for a sweeping motion. A handle of such a cleaning implement preferably has a reservoir for attaching a bottle with hard surface cleaning solution and have a spraying mechanism built-in. The handle of the cleaning implement can alternatively be devoid of a liquid delivery system. With such a cleaning implement, a hard surface cleaning solution can be dispensed with a bottle that is separate from the cleaning implement with either a trigger sprayer or simple dosing cap (similar to water bottle). This implement can optionally have feature for attaching bottle to mop to allow two hands to be used during mopping, such as a cage structure for holding the bottle as described hereinbefore and as shown in FIG. 7. The mop head of the handle of the cleaning implement preferably has velcro hooks on the bottom surface to attach a cleaning pad and having attachment structures or mechanical clips on top of the mop head for attaching a dry, cleaning sheet. Such an "all-in-one" cleaning implement handle is shown in FIG. 8A and described hereinbefore. The "all-in-one" cleaning implement further comprises a dry, cleaning sheet preferably made of a hydroentangled polyester material with patterning and additives as described in Fereshtehkhou et al., U.S. Ser. No. 09/082,396, filed May 20, 1998 (Case 6798M); Fereshtehkhou et al., U.S. Ser. No. 09/082,349, filed May 20, 1998 (Case 6664M); and U.S. Pat. No. 5,525,397, issued Jun. 11, 1996 to Shizuno et al. The dry, cleaning sheets are preferably made large enough to attach over a wet pad and be inserted into attachment structures on the mop head or be clipped onto mechanical attachments. This provides an additional benefit of the dry, cleaning sheet conforming to a pyramid shape of a cleaning pad having multiple planar surfaces. In an alternative embodiment of the dry, cleaning sheet, the dry, cleaning sheet has a notch cut out at both ends of the dry, cleaning sheet. These notches can get pushed into the mechanical clips or attachment structures on top of the mop head. These notches allow for this sheet to be used with a cleaning pad, in either a dry or wet environment. In a wet environment, the notch 126 (shown in FIG. 8B) allows for solution to be dispensed from a spray nozzle without blocking solution. Also the notch provides freedom for a universal joint to be moved around. The "all-in-one" cleaning implement further comprises a cleaning pad of the present invention.

In an alternative embodiment of an "all-in-one" cleaning implement, the cleaning implement comprises a dry, cleaning sheet in combination with an absorbent cleaning pad to form a single dry/wet cleaning substrate. The dry/wet cleaning substrate can comprise a storage layer having a high absorptive capacity (e.g., 100–1000 grams), an attachment layer, and a liquid pervious scrubbing layer. This storage layer preferably attaches directly to velcro hooks located on a mop head of the "all-in-one" cleaning implement. The other part of the pad preferably lays directly over the storage layer and is preferably in direct contact with floor (this defined as a primary floor pad). The primary floor pad can be used for dry mopping and/or wet mopping. This primary pad floor pad can be a composite having an outer layer of materials effective at picking up particulate soils (i.e. hydroentangled polyester), an absorbent layer for absorbing some liquid (20–100 g capacity), and an outer layer that would allow solution and dirt to pass through into the lower higher absorbing storage pad and could be used for attaching primary pad to mop head by attaching on top of mop head containing attachment structures or mechanical clips.

A set of instructions for use can be provided comprising an instruction to place a primary pad over a storage pad and perform a dry mopping step first. The set of instuctions can further comprise an instruction to then remove the dirty primary floor pad and replace with a clean primary floor pad. Then wet mop a small area (10 sqm) with this primary pad over storage pad. Remove this dirty primary pad and place a new clean primary pad put over same storage pad to clean another 10 sqm area. The idea here is to improve performance by having a detachable mini pad in order to have fresh layer contacting floor to minimize soil re-deposition. At the same time by having a lower storage pad with high absorptive capacity cost is reduced. In otherwords a consumer could use up to anywhere from 2 to 10 primary pads for every storage pad.

The storage pad can attach to the mop via a loop (on a pad) to hook design (on a mop). On the other hand the primary pad could attach through several mechanisms: (1) have "wings" that can attach to mechanical clips or attachment structures on top of mop head; (2) have "wings" with an adhesive, such as described hereinbefore, that can attach to primary pad; or (3) have loop material on a primary pad that can attach to hook material on storage pad.

In another alternative embodiment of an "all-in-one" cleaning implement, the dry/wet cleaning can be achieved in a single pad that has two distinct sides. In such a pad, one side is comprised of a substrate design that is effective for dry mopping. The opposite side (by opposite it is meant flipping the pad 180 degrees) is comprised of a substrate that is designed for wet mopping. The benefits of such a design is that the consumer can easily alternate between dry and wet mopping which can be advantageous when dry/wet cleaning is done on a room by room basis as opposed to dry mop entire house first then finish with wet mopping. To protect the dry mopping side of the pad from getting wet when doing wet mopping, the pad can optionally include a liquid impermeable layer comprising a material such as polyethelene. The dry mopping sheet can then be placed over this liquid impermeable layer. Optionally, the liquid impermeable layer can be made wider than the mop head such that it could be used as an attachment layer which is clipped or mechanically attached to structures on top of the mop head. To further protect the dry mopping substrate from getting wet during wet mopping, the dry mopping substrate would be made narrower than the liquid impermeable barrier attachment layer. With this design the liquid impermeable attachment layer shields the dry mopping layer from liquid contact. Instructions for use can be provided on how to best use both sides effectively, including the instruction to attach the mopping/cleaning pad to the mop head such that the dry mopping substrate contacts the surface to be cleaned, then wiping the surface with the mopping/cleaning pad, then removing the mopping/cleaning pad and reattaching the pad to the mop head such that the wet mopping substrate contacts the surface to be cleaned, then wiping the surface with the mopping/cleaning pad.

VIII. Test Methods

A. Performance Under Pressure

This test determines the gram/gram absorption of deionized water for a cleaning pad that is laterally confined in a piston/cylinder assembly under an initial confining pressure of 0.09 psi (about 0.6 kPa). (Depending on the composition of the cleaning pad sample, the confining pressure can decrease slightly as the sample absorbs water and swells during the time of the test.) The objective of the test is to assess the ability of a cleaning pad to absorb fluid, over a practical period of time, when the pad is exposed to usage conditions (horizontal wicking and pressures).

The test fluid for the PUP capacity test is deionized water. This fluid is absorbed by the cleaning pad under demand absorption conditions at near-zero hydrostatic pressure.

Figure 14:
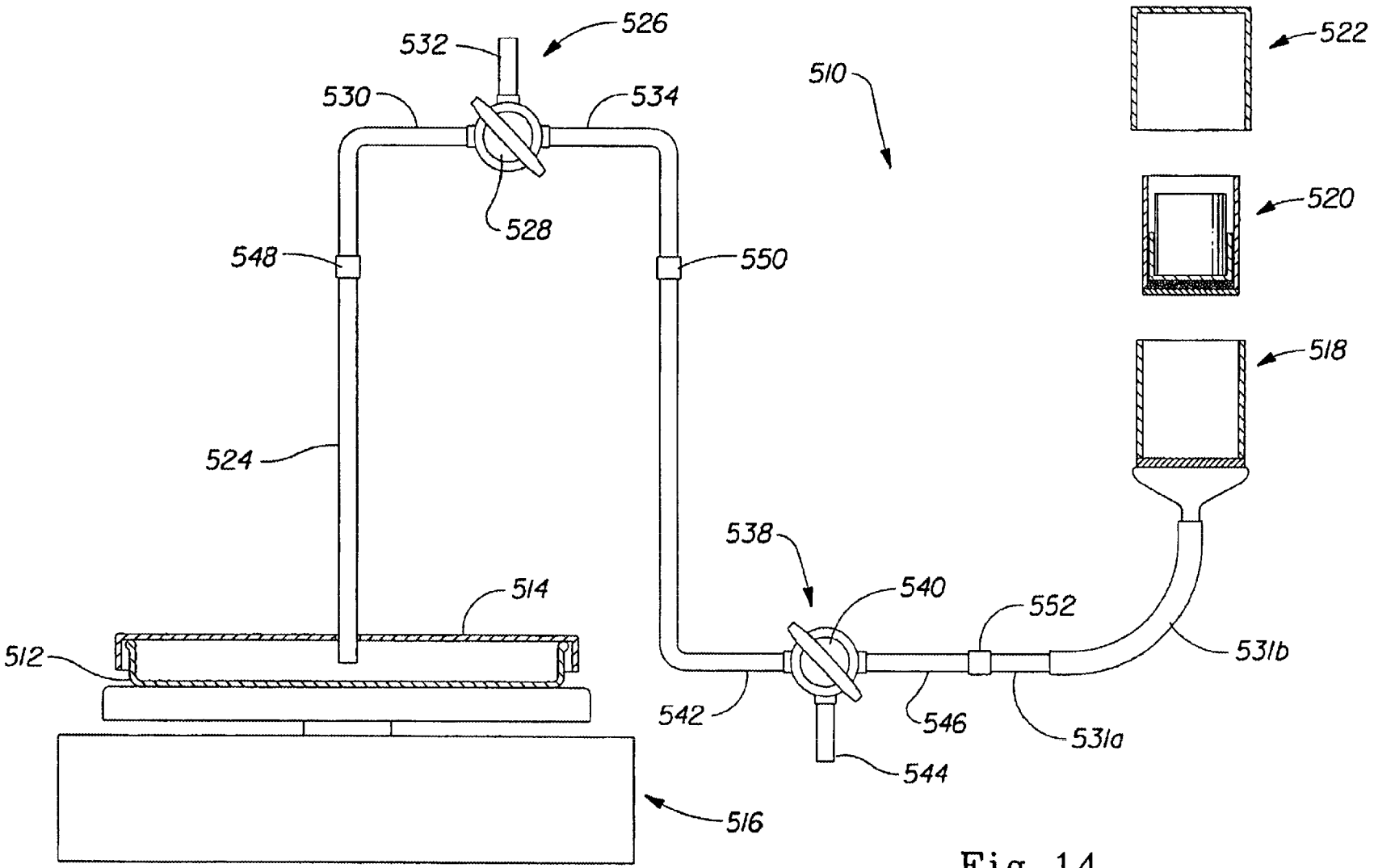
FIG. 14 represents a schematic view of an apparatus for measuring the Performance Under Pressure (PUP) capacity of a cleaning pad.

A suitable apparatus 510 for this test is shown in FIG. 14. At one end of this apparatus is a fluid reservoir 512 (such as a petri dish) having a cover 514. Reservoir 512 rests on an analytical balance indicated generally as 516. The other end of apparatus 510 is a fritted funnel indicated generally as 518, a piston/cylinder assembly indicated generally as 520 that fits inside funnel 518, and cylindrical plastic fritted funnel cover indicated generally as 522 that fits over funnel 518 and is open at the bottom and closed at the top, the top having a pinhole. Apparatus 510 has a system for conveying fluid in either direction that consists of sections glass capillary tubing indicated as 524 and 531a, flexible plastic tubing (e.g., ¼ inch i.d. and ⅜ inch o.d. Tygon tubing) indicated as 531*b*, stopcock assemblies 526 and 538 and Teflon connectors 548, 550 and 552 to connect glass tubing 524 and 531a and stopcock assemblies 526 and 538. Stopcock assembly 526 consists of a 3-way valve 528, glass capillary tubing 530 and 534 in the main fluid system, and a section of glass capillary tubing 532 for replenishing reservoir 512 and forward flushing the fritted disc in fritted funnel 518. Stopcock assembly 538 similarly consists of a 3-way valve 540, glass capillary tubing 542 and 546 in the main fluid line, and a section of glass capillary tubing 544 that acts as a drain for the system.

Figure 15:
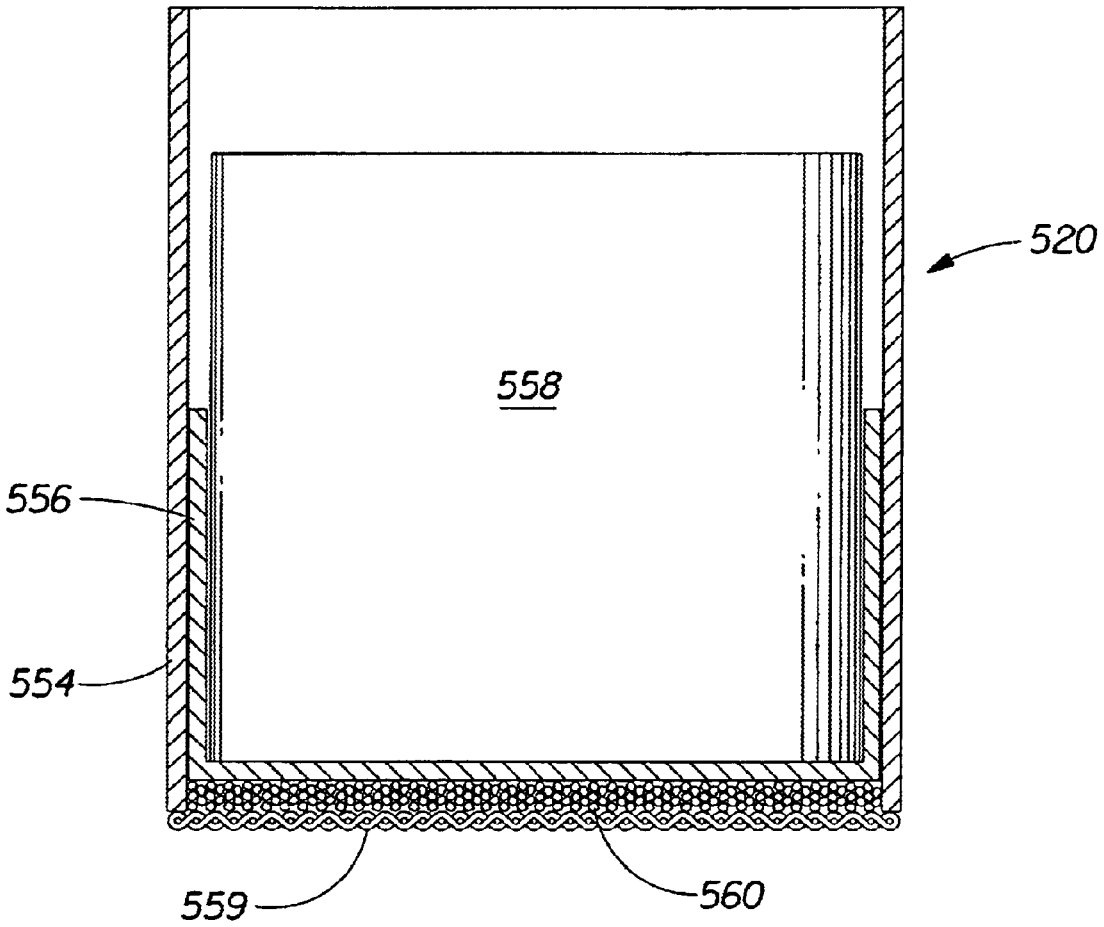
FIG. 15 represents an enlarged sectional view of the piston/cylinder assembly shown in FIG. 14.

Referring to FIG. 15, assembly 520 consists of a cylinder 554, a cup-like piston indicated by 556 and a weight 558 that fits inside piston 556. Attached to bottom end of cylinder 554 is a No. 400 mesh stainless steel cloth screen 559 that is biaxially stretched to tautness prior to attachment. The cleaning pad sample indicated generally as 560 rests on screen 559 with the surface-contacting (or scrubbing) layer in contact with screen 559. The cleaning pad sample is a circular sample having a diameter of 5.4 cm. While sample 560 is depicted as a single layer, the sample will actually consist of a circular sample having all layers contained by the pad from which the sample is cut. Furthermore, it is understood that a pad from which a circular sample taken anywhere within the pad, having the absorbent capacity defined herein, is within the scope of the present invention. That is, where a cleaning pad has regions comprised of different materials through the thickness of the pad, samples should be taken from each of those regions and the absorbent capacity should be measured for each sample. If any of the samples has the absorbent capacity values described above, the pad is deemed to have this absorbent capacity and therefore is within the scope of the present invention.

Cylinder 554 is bored from a transparent LEXAN® rod (or equivalent) and has an inner diameter of 6.00 cm (area=28.25 $cm^2$), with a wall thickness of approximately 5 mm and a height of approximately 5 cm. The piston 556 is in the form of a Teflon cup and is machined to fit into cylinder 554 within tight tolerances. Cylindrical stainless steel weight 558 is machined to fit snugly within piston 556 and is fitted with a handle on the top (not shown) for ease in removing. The combined weight of piston 556 and weight 558 is 145.3 g, which corresponds to a pressure of 0.09 psi for an area of 22.9 $cm^2$.

The components of apparatus 510 are sized such that the flow rate of deionized water therethrough, under a 10 cm hydrostatic head, is at least 0.01 g/cm /sec, where the flow rate is normalized by the area of fritted funnel 518. Factors particularly impactful on flow rate are the permeability of the fritted disc in fritted funnel 518 and the inner diameters of glass tubing 524, 530, 534, 542, 546 and 531*a*, and stopcock valves 528 and 540.

Reservoir 512 is positioned on an analytical balance 516 that is accurate to at least 0.01 g with a drift of less than 0.1 g/hr. The balance is preferably interfaced to a computer with software that can (i) monitor balance weight change at pre-set time intervals from the initiation of the PUP test and (ii) be set to auto initiate on a weight change of 0.01–0.05 g, depending on balance sensitivity. Capillary tubing 524 entering the reservoir 512 should not contact either the bottom thereof or cover 514. The volume of fluid (not shown) in reservoir 512 should be sufficient such that air is not drawn into capillary tubing 524 during the measurement. The fluid level in reservoir 512, at the initiation of the measurement, should be approximately 2 mm below the top surface of fritted disc in fritted funnel 518. This can be confirmed by placing a small drop of fluid on the fritted disc and gravimetrically monitoring its slow flow back into reservoir 512. This level should not change significantly when piston/cylinder assembly 520 is positioned within funnel 518. The reservoir should have a sufficiently large diameter (e.g., ~14 cm) so that withdrawal of ~40 ml portions results in a change in the fluid height of less than 3 mm.

Prior to measurement, the assembly is filled with deionized water. The fritted disc in fritted funnel 518 is forward flushed so that it is filled with fresh deionized water. To the extent possible, air bubbles are removed from the bottom surface of the fritted disc and the system that connects the funnel to the reservoir. The following procedures are carried out by sequential operation of the 3-way stopcocks:

1. Excess fluid on the upper surface of the fritted disc is removed (e.g. poured) from fritted funnel 518.
2. The solution height/weight of reservoir 512 is adjusted to the proper level/value.
3. Fritted funnel 518 is positioned at the correct height relative to reservoir 512.
4. Fritted funnel 518 is then covered with fritted funnel cover 522.
5. The reservoir 512 and fritted funnel 518 are equilibrated with valves 528 and 540 of stopcock assemblies 526 and 538 in the open connecting position.
6. Valves 528 and 540 are then closed.
7. Valve 540 is then turned so that the funnel is open to the drain tube 544.
8. The system is allowed to equilibrate in this position for 5 minutes.
9. Valve 540 is then returned to its closed position.

Steps Nos. 7–9 temporarily "dry" the surface of fritted funnel 518 by exposing it to a small hydrostatic suction of ~5 cm. This suction is applied if the open end of tube 544 extends ~5 cm below the level of the fritted disc in fritted funnel 518 and is filled with deionized water. Typically ~0.04 g of fluid is drained from the system during this procedure. This procedure prevents premature absorption of deionized water when piston/cylinder assembly 520 is positioned within fritted funnel 518. The quantity of fluid that drains from the fritted funnel in this procedure (referred to as the fritted funnel correction weight, or "Wffc")) is measured by conducting the PUP test (see below) for a time period of 20 minutes without piston/cylinder assembly 520. Essentially all of the fluid drained from the fritted funnel by this procedure is very quickly reabsorbed by the funnel when the test is initiated. Thus, it is necessary to subtract this correction weight from weights of fluid removed from the reservoir during the PUP test (see below).

A round die-cut sample 560 is placed in cylinder 554. The piston 556 is slid into cylinder 554 and positioned on top of the cleaning pad sample 560. The piston/cylinder assembly 520 is placed on top of the frit portion of funnel 518, the weight 558 is slipped into piston 556, and the top of funnel 518 is then covered with fritted funnel cover 522. After the balance reading is checked for stability, the test is initiated by opening valves 528 and 540 so as to connect funnel 518 and reservoir 512. With auto initiation, data collection commences immediately, as funnel 518 begins to reabsorb fluid.

Data is recorded at intervals over a total time period of 1200 seconds (20 minutes). PUP absorbent capacity is determined as follows:

$$t_{1200} \text{ absorbent capacity (g/g)} = [Wr_{(t=0)} - Wr_{(t=1200)} - Wffc]/Wds$$

where $t_{1200}$ absorbent capacity is the g/g capacity of the pad after 1200 seconds, $Wr_{(t=0)}$ is the weight in grams of reservoir 512 prior to initiation, $Wr_{(t=1200)}$ is the weight in grams of reservoir 512 at 1200 seconds after initiation, Wffc is the fritted funnel correction weight and Wds is the dry weight of the cleaning pad sample.

B. Squeeze-out

The ability of the cleaning pad to retain fluid when exposed to in-use pressures, and therefor to avoid fluid "squeeze-out", is another important parameter to the present invention. "Squeeze-out" is measured on an entire cleaning pad by determining the amount of fluid that can be blotted from the sample with Whatman filter paper under pressures of 0.25 psi (1.5 kPa). Squeeze-out is performed on a sample that has been saturated to capacity with deionized water via horizontal wicking (specifically, via wicking from the surface of the pad consisting of the scrubbing or surface-contacting layer). (One means for obtaining a saturated sample is described as the Horizontal Gravimetric Wicking method of copending U.S. application Ser. No. 08/542,497 (Dyer et al.), filed Oct. 13, 1995, which is incorporated by reference herein.) The fluid-containing sample is placed horizontally in an apparatus capable of supplying the respective pressures, preferably by using an air-filled bag that will provide evenly distributed pressure across the surface of the sample. The squeeze-out value is reported as the weight of test fluid lost per weight of the wet sample.

Again, where a cleaning pad has regions comprised of different materials through the thickness of the pad, samples should be taken from each of those regions and squeeze-out should be measured on all of the samples. If any of the samples has a squeeze-out value described above, the pad is deemed to have this squeeze-out value.

C. Resiliency

"Resiliency" is the ability of a cleaning pad to "spring back" to its original thickness (z-dimension) when dry after being subjected to saturation with water and compression due to a downward force is another important parameter to the present invention. Resiliency is measured according to the following method. A cleaning pad is saturated with an aqueous nonionic buffered solution. The original thickness of the cleaning pad (the z-dimension) is then measured. A downward pressure (equivalent to about 0.25 psi) is then exerted on the cleaning pad, parallel to its z-dimension. The pressure is released, and the thickness of the cleaning pad is measured after a period of 30 seconds. The resiliency is calculated as a percentage, representing the ratio of its thickness after being compressed under pressure to its original thickness before any pressure is applied and pad has been saturated.

The following are non-limiting examples of the present invention.

IX. EXAMPLES

A. Perfume

The following are non-limiting examples of perfumes that are suitable for incorporation in the present hard surface cleaning compositions.

Perfume A

| Perfume Material | Wt % Range |
|---|---|
| Phenyl Hexanol | 0.1–1.0 |
| Cis-3-Hexenyl Acetate | 0.1–1.0 |
| Phenyl Ethyl Alcohol | 10.0–50.0 |
| Benzyl Acetate | 1.0–10.0 |
| Benzyl Propionate | 1.0–10.0 |
| Dihydro Myrcenol | 1.0–10.0 |
| Hydroxycitronellal | 1.0–10.0 |
| Geraniol | 1.0–10.0 |
| Citronellol | 1.0–10.0 |
| Citronellal Nitrile | 1.0–10.0 |
| Linalool | 1.0–10.0 |
| Dipropylene Glycol | 10.0–50.0 |

Perfume B

| Perfume Material | Wt % Range |
|---|---|
| Hexyl Acetate | 1.0–10.0 |
| Cis-3-Hexenyl Acetate | 0.5–5.0 |
| Beta Gamma Hexanol | 0.5–5.0 |
| Prenyl Acetate | 0.5–5.0 |
| Ligustral | 0.5–5.0 |
| Ethyl-2-Methyl Butyrate | 0.01–1.0 |
| Nerol | 10.0–50.0 |
| Citral | 1.0–10.0 |
| Citronellal Nitrile | 0.5–5.0 |
| Decyl Aldehyde | 0.5–5.0 |
| Octyl Aldehyde | 0.5–5.0 |
| Verdox | 1.0–10.0 |
| Methyl Dihydro Jasmonate | 0.5–5.0 |
| Limate | 0.01–1.0 |
| Dipropylene Gylcol | 10.0–50.0 |

Perfume C

| Perfume Material | Wt % Range |
|---|---|
| Hydroxycitronellal | 1.0–10.0 |
| Helional | 1.0–10.0 |
| Dimethyl Benzyl Carbinol | 0.5–5.0 |
| Citral | 1.0–10.0 |
| Methyl Dihydro Jasmonate | 0.5–5.0 |
| Hexyl Cinnamic Aldehyde | 0.5–5.0 |
| Citronellal Nitrile | 0.5–5.0 |
| Dihydro Myrcenol | 10.0–50.0 |
| Orange Terpenes | 10.0–50.0 |
| Dipropylene Gylcol | 10.0–50.0 |

These perfumes are non-limiting examples of perfume suitable for use in the present hard surface cleaning compositions to provide a positive scent signal, while not negatively impacting filming and/or streaking of the surface being cleaned.

B. Hard Surface Cleaning Compositions

The following are non-limiting examples of hard surface cleaning compositions that are useful in the present invention, especially in combination with the present cleaning pads and/or cleaning implements. Ingredient amounts are percentages by weight of the composition.

| | EXAMPLE | | | | | | | | |
|---|---|---|---|---|---|---|---|---|---|
| Ingredient | A | B | C | D | E | F | G | H | I |
| Neodol 1-5[1] | 0.03% | — | 0.03% | — | — | — | 0.03% | 0.03% | 0.03% |
| Witconate NAS-8[2] | 0.01% | 0.02% | 0.01% | — | — | — | 0.01% | 0.01% | 0.01% |
| Planteran 2000[3] | — | 0.05% | — | 0.004% | 0.004% | 0.004% | — | — | — |
| Ammonia Hydroxide | — | — | — | 0.1% | — | 0.01% | — | — | — |
| Glacial Acetic Acid | — | — | — | — | — | — | 0.05% | 0.05% | — |

-continued

| Ingredient | EXAMPLE A | B | C | D | E | F | G | H | I |
|---|---|---|---|---|---|---|---|---|---|
| DMAMP-80[4] | 0.01% | 0.01% | 0.06% | — | 0.01% | — | — | — | 0.01% |
| Dowanol PnP[5] | 2.0% | 2.0% | 2.0% | 4.0% | 4.0% | 4.0% | — | 2.0% | — |
| Polyvinvyl-pyridine N-oxide | 0.015% | 0.015% | 0.015% | 0.003% | 0.003% | 0.003% | 0.015% | 0.015% | 0.015% |
| 1-Methoxy-2-Butanol | — | — | — | — | — | — | — | — | 2.0% |
| Silicone suds suppressor[6] | 0.00125% | 0.00125% | 0.00125% | — | — | — | 0.00125% | 0.00125% | 0.00125% |
| Perfume | 0.033% | 0.06% | 0.035% | — | — | 0.015% | 0.03% | 0.03% | 0.03% |
| Xylenol-phthalein | — | — | 0.001% | — | — | — | — | — | — |
| Deionized water | Balance | Balance | Balance | Balance | Balance | Balance | Balance | Balance | Balance |

[1]$C_{11}E_5$ alcohol ethoxylate commercially available from Shell Chemical.
[2]Linear $C_8$ sulfonate commercially available from Witco Chemical.
[3]$C_8$–$C_{16}$ alkyl polyglucoside commercially available from Henkel.
[4]2-dimethylamino-2-methyl-1-propanol commercially available from Angus Chemical.
[5]Propylene glycol n-propyl ether commercially available from Dow Chemical.
[6]Silicone suds suppressor commercially available from Dow Corning under the trade name Dow Corning AF ® Emulsion.

What is claimed is:

1. A cleaning implement comprising:

a handle;

a mop head pivotably attached to said handle, said mop head having a leading edge and a trailing edge;

a liquid delivery system comprising a container filled with a cleaning solution, said container being removably attached to a fitment, said fitment having a fluid transfer check valve, a vent valve and a tubular probe for engaging said fluid transfer check valve wherein said tubular probe is in fluid communication with a nozzle connected to said mop head adjacent to said leading edge of said mop head and wherein said cleaning solution flows by gravity through said transfer check valve and said tubular probe, when said fitment is attached to said container and said container is inverted and said tubular probe engages said transfer check valve; and a disposable cleaning pad comprising an absorbent layer having a lower surface and an upper surface, an attachment layer adjacent said lower surface of said absorbent layer for removably attaching said disposable cleaning pad about said mop head, wherein said attachment layer has a leading edge and a trailing edge, and wherein said attachment layer comprises at least one notch located on said leading edge such that said cleaning solution is dispensed from said nozzle without being obstructed by said attachment layer.

2. The cleaning implement of claim 1 wherein said vent valve has a cracking pressure such that venting occurs in said container when the pressure differential defined by P1–P2 is superior to said cracking pressure, wherein P1 is the atmospheric pressure and P2 is the pressure inside said container.

3. The cleaning implement of claim 2 wherein said cracking pressure of said venting check valve is at least about 0.6 Kpa.

4. The cleaning implement of claim 3 wherein said cracking pressure between about 0.6 Kpa and about 20 Kpa.

5. The cleaning implement of claim 4 wherein said cracking pressure between about 1 Kpa and about 10 Kpa.

6. The cleaning implement of claim 1 wherein said vent valve is a duckbill valve.

7. The cleaning implement of claim 1 wherein said vent valve is an umbrella valve.

8. The cleaning implement of claim 1 wherein said vent valve is a ball and spring check valve.

9. The cleaning implement of claim 1 wherein said vent valve is a slit valve.

10. The cleaning implement of claim 1 wherein said mop head further comprises at least one attachment structure disposed on said mop head for receiving and retaining said attachment layer of said cleaning pad about said mop head, wherein said attachment structure is formed from a flexible material and wherein said attachment structure further comprises a plurality of substantially pie-shaped sections wherein two sides of each of said pie-shaped sections are defined by slits passing through said flexible material such that each of said pie-shaped sections can be deflected to receive the cleaning sheet or cleaning pad.

11. A cleaning implement comprising:

a handle;

a mop head pivotably attached to said handle, said mop head having a leading edge and a trailing edge;

a liquid delivery system comprising a container filled with a cleaning solution, said cleaning container being removably attached to a fitment, wherein said fitment comprises a fluid transfer check valve and a vent valve wherein said fluid transfer check valve is in fluid communication with a nozzle connected to said mop head adjacent to said leading edge of said mop head and wherein said vent valve has a cracking pressure such that venting occurs in said container when the pressure differential defined by P1–P2 is superior to said cracking pressure, wherein P1 is the atmospheric pressure and P2 is the pressure inside said container; and a disposable cleaning pad comprising an absorbent layer having a lower surface and an upper surface, an attachment layer adjacent said lower surface of said absorbent layer for removably attaching said disposable cleaning pad about said mop head, wherein said attachment layer has a leading edge and a trailing edge, and wherein said attachment layer comprises at least one notch located on said leading edge such that said cleaning solution is dispensed from said nozzle without being obstructed by said attachment layer.

12. The cleaning implement of claim 11 wherein said mop head further comprises at least one attachment structure disposed on said mop head for receiving and retaining said attachment layer of said cleaning pad about said mop head, wherein said attachment structure is formed from a flexible material and wherein said attachment structure further comprises a plurality of substantially pie-shaped sections wherein two sides of each of said pie-shaped sections are defined by slits passing through said flexible material such that each of said pie-shaped sections can be deflected to receive the cleaning sheet or cleaning pad.

13. The cleaning implement of claim 12 wherein each of said slits terminates at one end with a substantially circular opening.

14. The cleaning implement 13 of claim wherein said mop head comprises four attachment structures.

15. The cleaning implement of claim 14 further comprising a dry cleaning sheet.

16. The cleaning implement of claim 11 wherein said attachment layer is a scrubbing layer.

17. The cleaning implement of claim 11 wherein the width of said attachment layer is greater than the width of said mop head such that said attachment layer engages in said attachment structures.

18. The cleaning implement of claim 11 wherein said absorbent layer has a $t_{1200}$ absorbent capacity of at least about 5 grams/gram.

19. The cleaning implement of claim 18 wherein said absorbent layer is in fluid communication with said scrubbing layer.

20. The cleaning implement of claim 19 wherein said cleaning pad further comprises an impervious layer adjacent said upper surface of said absorbent layer.

21. A method of cleaning a hard surface, said method comprising the steps of:

providing a cleaning implement comprising:

a handle;

a mop head pivotably attached to said handle, said mop head having a leading edge and a trailing edge;

a liquid delivery system comprising a container filled with a cleaning solution, said container being removably attached to a fitment, said fitment having a fluid transfer check valve, a vent valve and a tubular probe for engaging said fluid transfer check valve wherein said tubular probe is in fluid communication with a nozzle connected to said mop head adjacent to said leading edge of said mop head and wherein said cleaning solution flows by gravity through said transfer check valve and said tubular probe, when said fitment is attached to said container and said container is inverted and said tubular probe engages said transfer check valve;

providing a disposable cleaning pad comprising an absorbent layer having a lower surface and an upper surface, an attachment layer adjacent said lower surface of said absorbent layer for removably attaching said disposable cleaning pad about said mop head, wherein said attachment layer has a leading edge and a trailing edge, and wherein said attachment layer comprises at least one notch located on said leading edge such that said cleaning solution is dispensed from said nozzle without being obstructed by said attachment layer;

attaching said container to said fitment;

inverting said container;

attaching said disposable cleaning pad to said mop head;

actuating said fluid delivery system; and mopping said hard surface with said pad.

22. The method of claim 21 wherein said vent valve has a cracking pressure such that venting occurs in said container when the pressure differential defined by P1–P2 is superior to said cracking pressure, wherein P1 is the atmospheric pressure and P2 is the pressure inside said container.

23. The method of claim 22 wherein said cracking pressure of said venting check valve is at least about 0.6 Kpa.

24. The method of claim 21 wherein the width of said attachment layer is greater than the width of said mop head such that said attachment layer engages in said attachment structures.

25. The method of claim 21 wherein said absorbent layer has a $t_{1200}$ absorbent capacity of at least about 5 grams/gram.

26. The method of claim 25 wherein said attachment layer is a liquid pervious scrubbing layer.

27. The method of claim 26 wherein said absorbent layer is in fluid communication with said scrubbing layer.

28. The cleaning implement of claim 29 wherein said cleaning pad further comprises an impervious layer adjacent said upper surface of said absorbent layer.

29. The cleaning implement of claim 1 wherein the width of said attachment layer is greater than the width of said mop head such that said attachment layer engages in said attachment structures.

30. The cleaning implement of claim 1 wherein said absorbent layer has a $t_{1200}$ absorbent capacity of at least about 5 grams/gram.

31. The cleaning implement of claim 1 wherein said attachment layer is a liquid pervious scrubbing layer.

32. The cleaning implement of claim 31 wherein said absorbent layer is in fluid communication with said scrubbing layer.

33. The cleaning implement of claim 32 wherein said cleaning pad further comprises an impervious layer adjacent said upper surface of said absorbent layer.

* * * * *